US009523223B2

(12) United States Patent
DeBoer et al.

(10) Patent No.: US 9,523,223 B2
(45) **Date of Patent: *Dec. 20, 2016**

(54) DOUBLE HUNG OPERATION HARDWARE

(71) Applicant: Marvin Lumber and Cedar Company, Warroad, MN (US)

(72) Inventors: Nathan H. DeBoer, Salol, MN (US); Eric Salentine, Warroad, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/609,174

(22) Filed: Jan. 29, 2015

(65) Prior Publication Data

US 2015/0167377 A1 Jun. 18, 2015

Related U.S. Application Data

(63) Continuation of application No. 13/872,842, filed on Apr. 29, 2013, now Pat. No. 8,955,255.

(Continued)

(51) Int. Cl.
*E05D 15/22* (2006.01)
*E06B 3/50* (2006.01)

(Continued)

(52) U.S. Cl.
CPC ..... *E05C 1/08* (2013.01); *E05B 15/0006* (2013.01); *E05B 15/0053* (2013.01);

(Continued)

(58) Field of Classification Search
CPC E05B 53/003; E05B 65/0876; E05B 65/0841; E05B 5/003; E05B 63/06; E05B 63/185; Y10S 292/20; Y10S 292/47; E05C 2007/007; E05C 3/046; E05C 9/00; E05C 1/14; E05C 9/04

(Continued)

(56) References Cited

U.S. PATENT DOCUMENTS 398,039 A 2/1889 Flatman et al.
660,438 A 10/1900 Holly et al.

(Continued)

FOREIGN PATENT DOCUMENTS

GB 2333555 A 7/1999
WO WO-2006116675 A2 11/2006

OTHER PUBLICATIONS

U.S. Appl. No. 14/658,834, Preliminary Amendment mailed Mar. 18, 2015, 7 pgs.

(Continued)

*Primary Examiner* — Justin Rephann

(74) *Attorney, Agent, or Firm* — Schwegman Lundberg & Woessner, P.A.

(57) ABSTRACT

A fenestration operation hardware assembly includes at least one latch mechanism and an operation hardware assembly configured for coupling with a panel slidable within a frame. The latch mechanism includes a latch bolt and a latch biasing element coupled with the latch bolt. An operator of the operation hardware assembly is remote from the latch mechanism and is coupled with the panel. The operator includes an operator interface feature movable between initial and operating positions. In the initial position the latch bolt is in a projecting position, and in the operating position the operator interface feature moves the latch bolt into one or more withdrawn positions. The operation hardware assembly includes a retention assembly for retaining the latch bolt in a withdrawn position.

22 Claims, 30 Drawing Sheets

Related U.S. Application Data

(60) Provisional application No. 61/640,525, filed on Apr. 30, 2012, provisional application No. 61/640,535, filed on Apr. 30, 2012, provisional application No. 61/732,763, filed on Dec. 3, 2012, provisional application No. 61/790,192, filed on Mar. 15, 2013, provisional application No. 61/800,143, filed on Mar. 15, 2013.

(51) Int. Cl.

| | |
|---|---|
| ***E05C 1/08*** | (2006.01) |
| ***E05C 1/10*** | (2006.01) |
| ***E05B 53/00*** | (2006.01) |
| ***E05B 63/14*** | (2006.01) |
| ***E05C 1/12*** | (2006.01) |
| ***E05C 3/04*** | (2006.01) |
| ***E05B 15/00*** | (2006.01) |
| ***E05C 3/12*** | (2006.01) |
| ***E06B 7/02*** | (2006.01) |
| ***E06B 7/28*** | (2006.01) |
| ***E06B 9/00*** | (2006.01) |
| ***E05F 7/04*** | (2006.01) |
| ***E06B 3/34*** | (2006.01) |
| *E05C 17/62* | (2006.01) |
| *E05C 7/00* | (2006.01) |

(52) U.S. Cl.
CPC ..... *E05B 53/003* (2013.01); *E05B 63/14* (2013.01); *E05C 1/10* (2013.01); *E05C 1/12* (2013.01); *E05C 3/046* (2013.01); *E05C 3/12* (2013.01); *E05C 3/124* (2013.01); *E05D 15/22* (2013.01); *E05F 7/04* (2013.01); *E06B 3/341* (2013.01); *E06B 3/5063* (2013.01); *E06B 7/02* (2013.01); *E06B 7/28* (2013.01); *E06B 9/00* (2013.01); *E05C 17/62* (2013.01); *E05C 2007/007* (2013.01); *Y10T 292/0836* (2015.04); *Y10T 292/1039* (2015.04)

(58) Field of Classification Search
USPC .. 49/176, 181, 183, 184, 185, 449; 292/241, DIG. 20, DIG. 47
See application file for complete search history.

(56) References Cited

U.S. PATENT DOCUMENTS

| | | | | |
|---|---|---|---|---|
| 1,434,371 | A | 11/1922 | Crompton et al. | |
| 2,104,134 | A | 1/1938 | Mellebrand | |
| 2,274,711 | A | 3/1942 | Krause | |
| 2,545,645 | A | 3/1951 | Blakely | |
| 2,778,326 | A | 1/1957 | Guzik | |
| 2,883,225 | A | 4/1959 | Akehurst | |
| 2,967,595 | A * | 1/1961 | Zitomer | E06B 3/44 292/175 |
| 4,351,288 | A | 9/1982 | Gasloli | |
| 4,624,073 | A | 11/1986 | Randall | |
| 4,639,021 | A | 1/1987 | Hope | |
| 5,090,750 | A | 2/1992 | Lindqvist | |
| 5,301,989 | A | 4/1994 | Dallmann et al. | |
| 5,398,447 | A | 3/1995 | Morse | |
| 5,437,173 | A | 8/1995 | Spinar | |
| 5,592,781 | A | 1/1997 | Mauro | |
| 5,791,700 | A | 8/1998 | Biro | |
| 5,992,907 | A | 11/1999 | Sheldon et al. | |
| 6,141,913 | A | 11/2000 | Wong et al. | |
| 6,176,041 | B1 | 1/2001 | Roberts | |
| 6,588,150 | B1 | 7/2003 | Wong et al. | |
| 6,669,242 | B2 | 12/2003 | Fountaine et al. | |
| 6,672,009 | B1 | 1/2004 | Wong et al. | |
| 6,817,142 | B2 | 11/2004 | Marshik et al. | |
| 6,871,885 | B2 | 3/2005 | Goldenberg et al. | |
| 6,877,784 | B2 | 4/2005 | Kelley et al. | |
| 6,938,373 | B2 | 9/2005 | Wong et al. | |
| 6,957,513 | B2 | 10/2005 | Pettit et al. | |
| 7,013,603 | B2 | 3/2006 | Eenigenburg et al. | |
| 7,070,215 | B2 | 7/2006 | Kelley et al. | |
| 7,118,142 | B2 | 10/2006 | Xu | |
| 7,165,791 | B2 | 1/2007 | Rebel et al. | |
| 7,322,619 | B2 | 1/2008 | Nolte et al. | |
| 7,407,199 | B2 | 8/2008 | Richardson | |
| 7,412,800 | B2 | 8/2008 | Maier | |
| 7,481,470 | B2 | 1/2009 | Eenigenburg et al. | |
| 7,591,494 | B2 | 9/2009 | Mitchell | |
| 7,607,262 | B2 | 10/2009 | Pettit et al. | |
| 7,731,251 | B2 | 6/2010 | Ye | |
| 7,812,800 | B2 | 10/2010 | Peng et al. | |
| 7,874,598 | B2 | 1/2011 | Chung | |
| 7,963,577 | B2 | 6/2011 | Wolf | |
| 7,976,077 | B2 | 7/2011 | Flory et al. | |
| 8,020,904 | B2 | 9/2011 | Flory et al. | |
| 8,182,001 | B2 | 5/2012 | Tremble et al. | |
| 8,205,920 | B2 | 6/2012 | Flory | |
| 8,955,255 | B2 | 2/2015 | DeBoer et al. | |
| 8,978,304 | B2 | 3/2015 | Hollermann et al. | |
| 2002/0116874 | A1 | 8/2002 | Marshik | |
| 2003/0084614 | A1 | 5/2003 | Pettit et al. | |
| 2003/0110698 | A1 | 6/2003 | Polowinczak et al. | |
| 2003/0110699 | A1 | 6/2003 | Eenigenburg et al. | |
| 2004/0003541 | A1 | 1/2004 | Wong et al. | |
| 2004/0168370 | A1* | 9/2004 | Pettit | E05B 5/003 49/185 |
| 2004/0195843 | A1 | 10/2004 | Rotondi et al. | |
| 2004/0200150 | A1 | 10/2004 | Kelley et al. | |
| 2005/0097823 | A1 | 5/2005 | Marshik | |
| 2006/0225354 | A1 | 10/2006 | Kelley et al. | |
| 2006/0244270 | A1 | 11/2006 | Rotondi | |
| 2007/0046036 | A1 | 3/2007 | Kinsey | |
| 2007/0209281 | A1 | 9/2007 | Flory et al. | |
| 2008/0129054 | A1 | 6/2008 | Tremble et al. | |
| 2008/0163551 | A1 | 7/2008 | Nolte et al. | |
| 2009/0241429 | A1 | 10/2009 | Polowinczak et al. | |
| 2010/0050528 | A1 | 3/2010 | Pettit et al. | |
| 2010/0218425 | A1 | 9/2010 | Nolte et al. | |
| 2010/0263415 | A1 | 10/2010 | Ruspil | |
| 2011/0113695 | A1 | 5/2011 | Derham | |
| 2011/0192089 | A1 | 8/2011 | Barton et al. | |
| 2011/0296880 | A1 | 12/2011 | Sieglaar et al. | |
| 2011/0304163 | A1 | 12/2011 | Liang et al. | |
| 2012/0313386 | A1 | 12/2012 | Liang | |
| 2012/0313387 | A1 | 12/2012 | Liang | |
| 2013/0214545 | A1 | 8/2013 | Wolf | |
| 2013/0283694 | A1 | 10/2013 | Deboer et al. | |
| 2013/0283695 | A1 | 10/2013 | Hollermann et al. | |
| 2014/0230331 | A1 | 8/2014 | Kellum, III | |
| 2015/0184434 | A1 | 7/2015 | Hollermann et al. | |

OTHER PUBLICATIONS

U.S. Appl. No. 13/872,842, Examiner Interview Summary mailed Aug. 15, 2014, 3 pgs.
U.S. Appl. No. 13/872,842, Non Final Office Action mailed Apr. 11, 2014, 16 pgs.
U.S. Appl. No. 13/872,842, Notice of Allowance mailed Sep. 29, 2014, 10 pgs.
U.S. Appl. No. 13/872,842, Response filed Mar. 6, 2014 to Restriction Requirement mailed Jan. 6, 2014, 13 pgs.
U.S. Appl. No. 13/872,842, Response filed Sep. 3, 2014 to Non-Final Office Action mailed Apr. 11, 2014, 24 pgs.
U.S. Appl. No. 13/872,842, Restriction Requirement mailed Jan. 6, 2014, 9 pgs.
U.S. Appl. No. 13/872,864, Amendment and Response filed Aug. 22, 2014 to Final Office Action mailed May 23, 2014, 14 pgs.
U.S. Appl. No. 13/872,864, Corrected Notice of Allowance mailed Dec. 1, 2014, 2 pgs.
U.S. Appl. No. 13/872,864, Non Final Office Action mailed May 23, 2014, 14 pgs.

(56) References Cited

OTHER PUBLICATIONS

U.S. Appl. No. 13/872,864, Notice of Allowance mailed Nov. 10, 2014, 10 pgs.
U.S. Appl. No. 13/872,864, Response filed Mar. 26, 2014 to Restriction Requirement mailed Feb. 23, 2014, 9 pgs.
U.S. Appl. No. 13/872,864, Response filed Aug. 22, 2014 to Non Final Office Action mailed May 23, 2014, 14 pgs.
U.S. Appl. No. 13/872,864, Restriction Requirement mailed Feb. 3, 2014, 7 pgs.
European Application Serial No. 11154029.0, European Search Report and Opinion mailed Sep. 25, 2012, 7 pgs.
"Kolbe & Kolbe Windows & Doors", [online] [retrieved Apr. 23, 2012]. Retrieved from the Internet: <URL: http://www.kolbe-kolbe.com/>, 1 pg.
Sopkowiak, J., et al., "Sash Limited Apparatus and Method", U.S. Appl. No. 13/328,776, filed Dec. 16, 2011, 67 pgs.
Sopkowiak, J., et al., "Sash Limiter Apparatus and Method", U.S. Appl. No. 61/486,813, filed May 17, 2011, 63 pgs.
U.S. Appl. No. 14/658,834, Restriction Requirement mailed Jan. 21, 2016, 7 pgs.
U.S. Appl. No. 14/658,834, Response filed Mar. 21, 2016 to Restriction Requirement mailed Jan. 21, 2016, 9 pgs.
U.S. Appl. No. 14/658,834, Non Final Office Action mailed Apr. 20, 2016, 12 pgs.
U.S. Appl. No. 14/658,834, Examiner Interview Summary mailed Sep. 16, 2016, 3 pgs.
U.S. Appl. No. 14/658,834, Response filed Sep. 12, 2016 to Non Final Office Action mailed Apr. 20, 2016, 14 pgs.

* cited by examiner

FIG. 11A
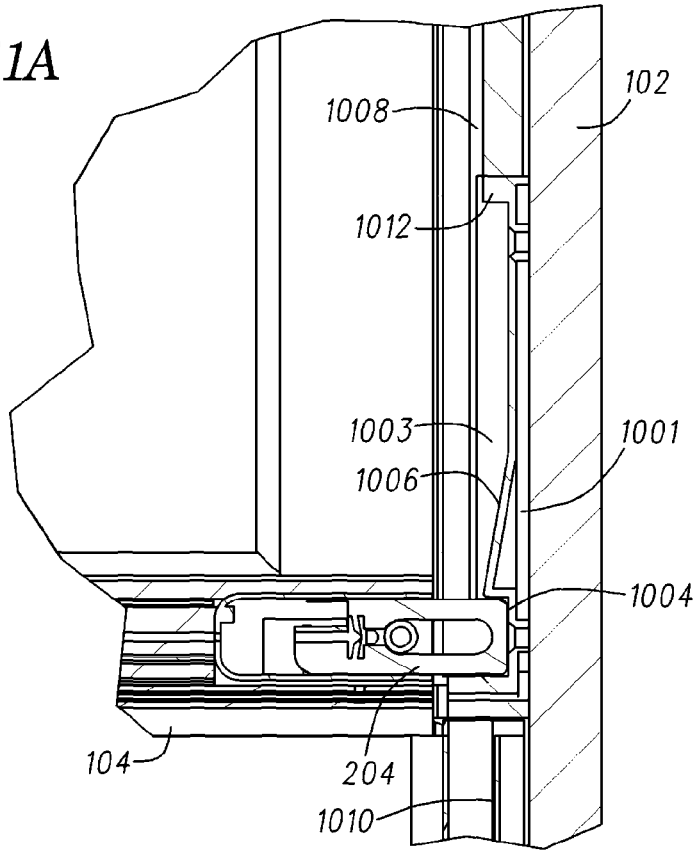
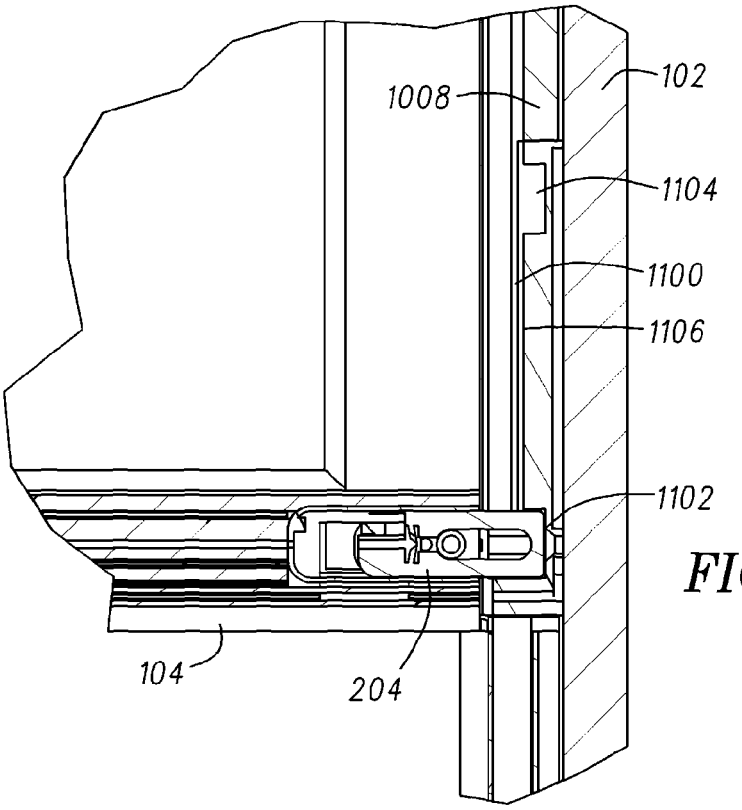
FIG. 11B

FIG. 11C
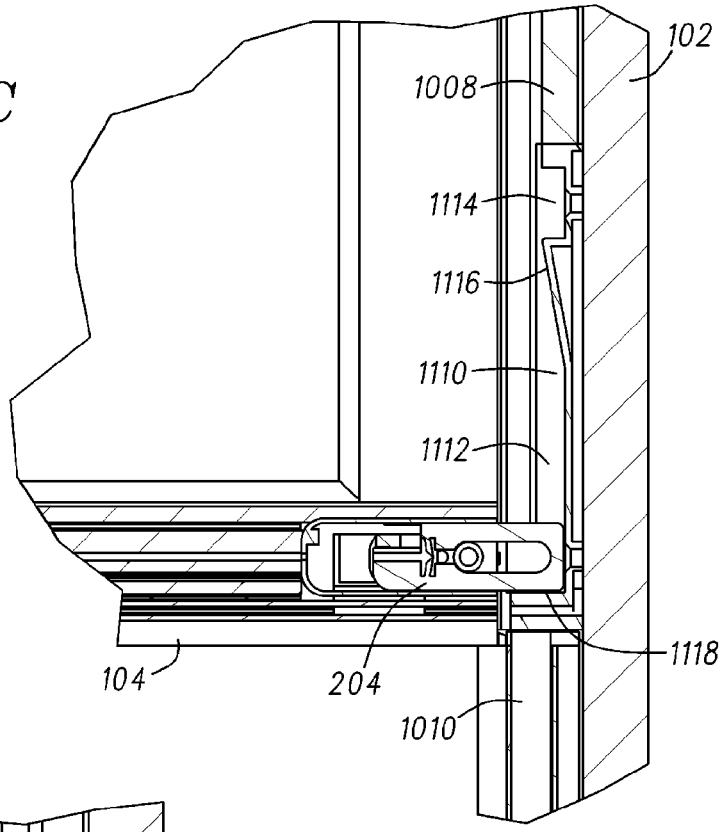
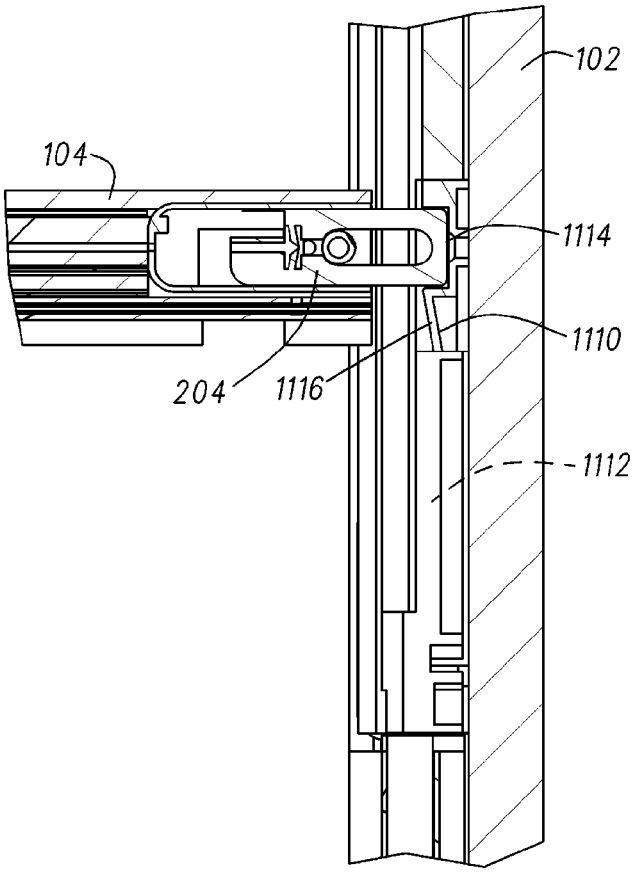
FIG. 11D

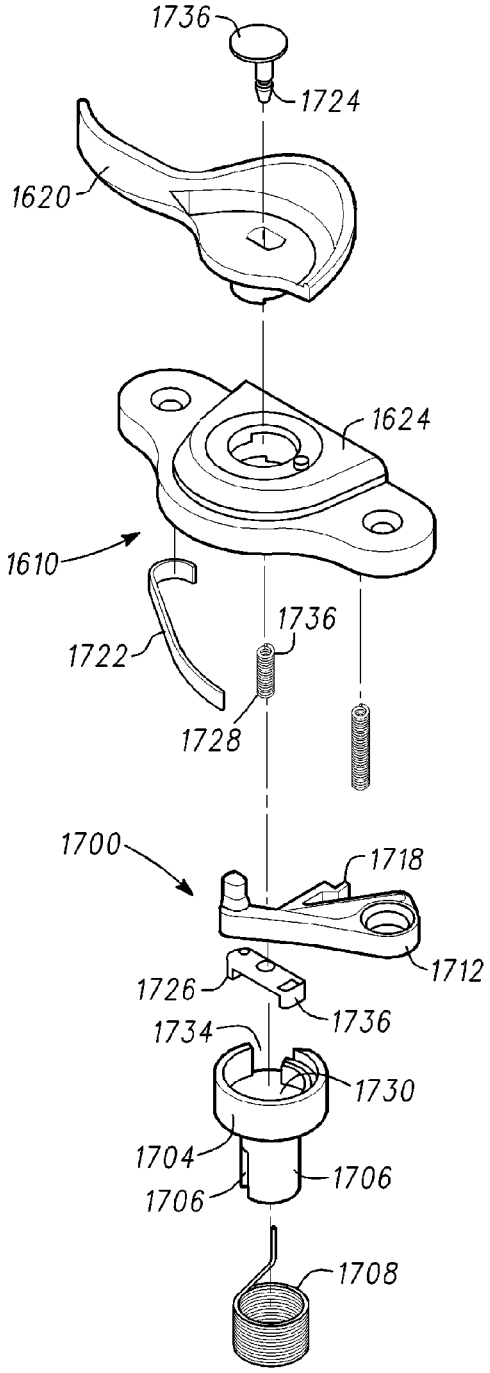
FIG. 17C1
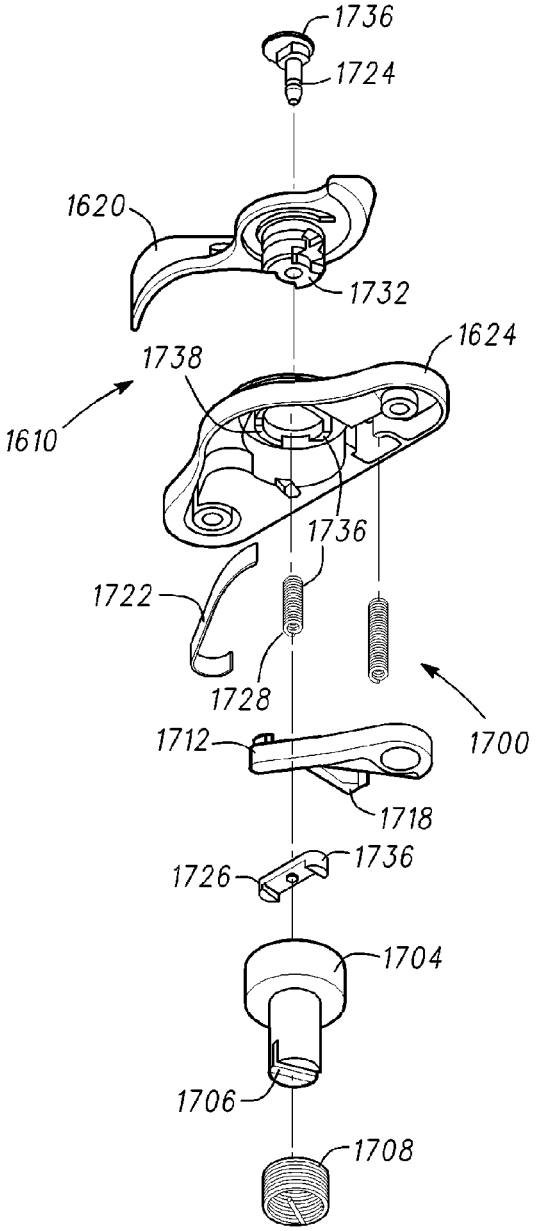
FIG. 17C2

DOUBLE HUNG OPERATION HARDWARE

CROSS-REFERENCE TO RELATED PATENT DOCUMENTS

This patent application is a Continuation of U.S. patent application Ser. No. 13/872,842, filed on Apr. 29, 2013; entitled DOUBLE HUNG OPERATION HARDWARE, which claims priority to U.S. Patent Application Ser. Nos. 61/640,525, filed on Apr. 30, 2012; entitled DOUBLE HUNG OPERATION HARDWARE, 61/732,763, filed on Dec. 3, 2012; entitled DOUBLE HUNG OPERATION HARDWARE and 61/800,143, filed on Mar. 15, 2013; entitled DOUBLE HUNG OPERATION HARDWARE and are incorporated by reference herein.

This patent application also claims priority to U.S. Patent Application Ser. Nos. 61/640,535, filed on Apr. 30, 2012; entitled DOUBLE HUNG LATCH AND JAMB HARDWARE and 61/790,192, filed on Mar. 15, 2013; entitled DOUBLE HUNG LATCH AND JAMB HARDWARE and are incorporated by reference herein.

This patent application is related to U.S. patent application Ser. No. 13/872,864, filed on Apr. 29, 2013; entitled DOUBLE HUNG LATCH AND JAMB HARDWARE and is incorporated by reference herein.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Lumber and Cedar Company (d/b/a Marvin Windows and Doors); Warroad, Minn. All Rights Reserved.

TECHNICAL FIELD

This document pertains generally, but not by way of limitation, to fenestration operation hardware.

BACKGROUND

Tilt latches are used with some examples of double hung windows to facilitate the tilting of the window sashes. Tilting of the window sashes allows for cleaning of the interior and exterior of the window sash while the operator is located, for instance, indoors. In at least some examples, tilt latches are actuated by the operator by applying hand pressure to tilt latches that are otherwise biased outwardly into the adjacent jambs. Actuation of the tilt latches allows for tilting of the window sash.

In some examples, the operator must simultaneously actuate each of two tilt latches installed on opposite sides of the window sash to enable tilting of the sash. The tilt latches must be individually operated and held in a retracted orientation to permit tilting. In other words, the tilt latches are biased into the projected orientation when released, and it is correspondingly difficult to actuate each of the tilt latches while tilting the sash at the same time.

Additionally, at least some examples of tilt latches are located in the center on the bottom check rail. This location coincides with the center of the balance tube. Such an arrangement limits the engagement available for the latch within the jamb and hinders structural performance (e.g., security and wind load). Additionally, tilt latches in this location limits the size of sash balances.

Further, where tilt latches are incorporated within a bottom check rail a pocket is created in the check rail that spans the slot and tenon joints to permit housing of the tilt latch and the components associated with the tilt latch including, but not limited to, the latch housing, the tilt latch bolt, a spring to bias the tilt latch bolt, pins or slides for finger or hand actuation, access orifices to reach the pins or slides and the like. This arrangement compromises the strength of the joints.

OVERVIEW

The present inventors have recognized, among other things, that a problem to be solved can include eliminating redundant hardware used in separate mechanisms for operating tilt mechanisms and locking and unlocking of sashes for movement within a frame. In an example, the present subject matter can provide a solution to this problem, for instance with an operation hardware assembly that remotely actuates latch bolts to lock and unlock a sash for sliding movement within a frame and also further actuate the latch bolts to permit tilting of the sash. The operation hardware assembly consolidates tilting and locking/unlocking functions into a single assembly that is actuated with an operator, such as a rotatable handle. Separated and independently operated hardware including rotating sweeps with keepers and tilt latches are thereby avoided.

Further, the operation hardware assembly examples described herein are usable to independently lock and unlock top and bottom sashes without sweeps and keepers extending between opposed check rails. In one example, the bottom sash is locked relative to the frame with the latch bolts actuated through an operator, such as a rotatable handle. The latch bolts are received within corresponding recesses in the frame, for instance jamb components including recesses sized and shaped to receive the latch bolts. Optionally, the top sash includes its own latch bolts that are sized and shaped to fit within corresponding recesses and thereby independently lock the top sash in place. Alternatively, the latch bolts of the top and bottom sashes are cooperatively opened, for instance by selectively coupling the bolts at the interface of the check rails.

Further still, with jamb components including one or more of planar surfaces, recesses and tapered features, the operation hardware assembly including the latch bolts provides additional functionality including, but not limited to, automatic locking of one or more of the sashes in the closed position, a secure venting position or any other positions within the range of movement for the sash, positioning of the bottom sash in a secure vent position (e.g., with the bottom of the bottom sash at around 4 inches above the sill), and even function of the operation hardware assembly as a window opening control device to allow for limited opening of the sashes to a specified elevation.

Furthermore, as described herein in at least some examples, with the operation hardware assembly married with recesses in the frame that allow for locking through the latch bolts, sweeps and keepers adjacent to the operator are not needed. In other examples, where added security is desired a sweep and keeper may be included with the operator and the opposed checkrail to provide additional locking of the sashes. In still other examples, where a tapered recess or engagement surface is provided that allows for sliding of the latch bolts from the locked position a sweep and keeper are incorporated into the operation hardware to ensure secure locking of the sashes in the closed position.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 11A is a cross sectional view of the jamb component shown in FIG. 10 showing a latch bolt received in a lower recess.

FIG. 11B is a cross sectional view of another example of a jamb component showing a latch bolt received in a lower recess.

FIG. 11C is a cross sectional view of yet another example of a jamb component with the latch bolt in a projecting position and the sash in the closed position.

FIG. 11D is a cross sectional view of the jamb component shown in FIG. 8C with the sash elevated into a secure venting position with the latch bolt received within an upper recess.

FIG. 17C1, 2 are dual exploded views of the operator (top and bottom).

DETAILED DESCRIPTION

Figure 1:
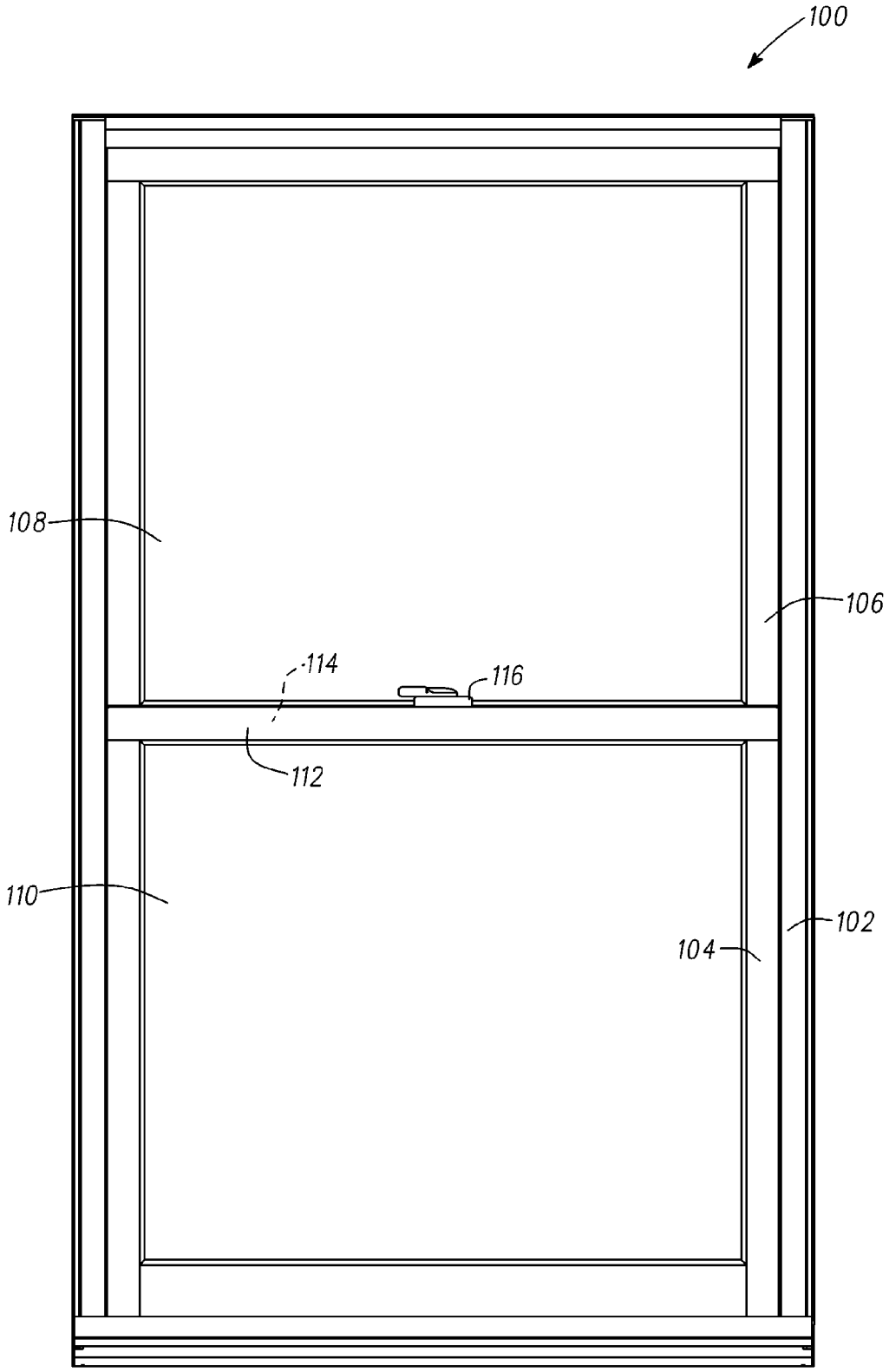
FIG. 1 is front view of one example of a fenestration assembly.

FIG. 1 shows one example of a fenestration assembly 100 including, for instance, a double hung window or sliding door. As shown the fenestration assembly 100 includes a frame 102 surrounding one or more sashes such as a bottom sash 104 and a top sash 106 as shown in FIG. 1. In the example where the fenestration assembly 100 includes a double hung window, in one example, the top and bottom sashes 106, 104 include corresponding glass panes 108, 110. In one example, at least one of the sashes such as the bottom sash 104 slidable within the frame 102, for instance, after unlocking the bottom sash 104 from a closed position as shown in FIG. 1. In another example, both of the sashes 104, 106 are movable within the frame 102, for instance, after operation of an operator 116 as described herein. Optionally, sashes include panels, such as, but not limited to, door panels and the like.

Referring again to FIG. 1, the fenestration assembly 100, for instance, the bottom and top sashes 104, 106, in another example, include corresponding bottom and upper check rails 112, 114. As will be described in further detail herein, the operator 116 is, in one example, positioned within the bottom check rail 112 and is configured to operate one or more locking mechanisms to selectively immobilize and free at least the bottom sash 104 for sliding within the frame 102. In another example, an operator 116 is coupled or positioned along the upper check rail 114 of the top sash 106. In such an example, the operator 116 coupled with the upper check rail 114 is configured to operate in a similar manner to an operator such as that shown in FIG. 1 (e.g., operator 116) to selectively immobilize and free the top sash 106 for movement within the frame 102.

Figure 2A:
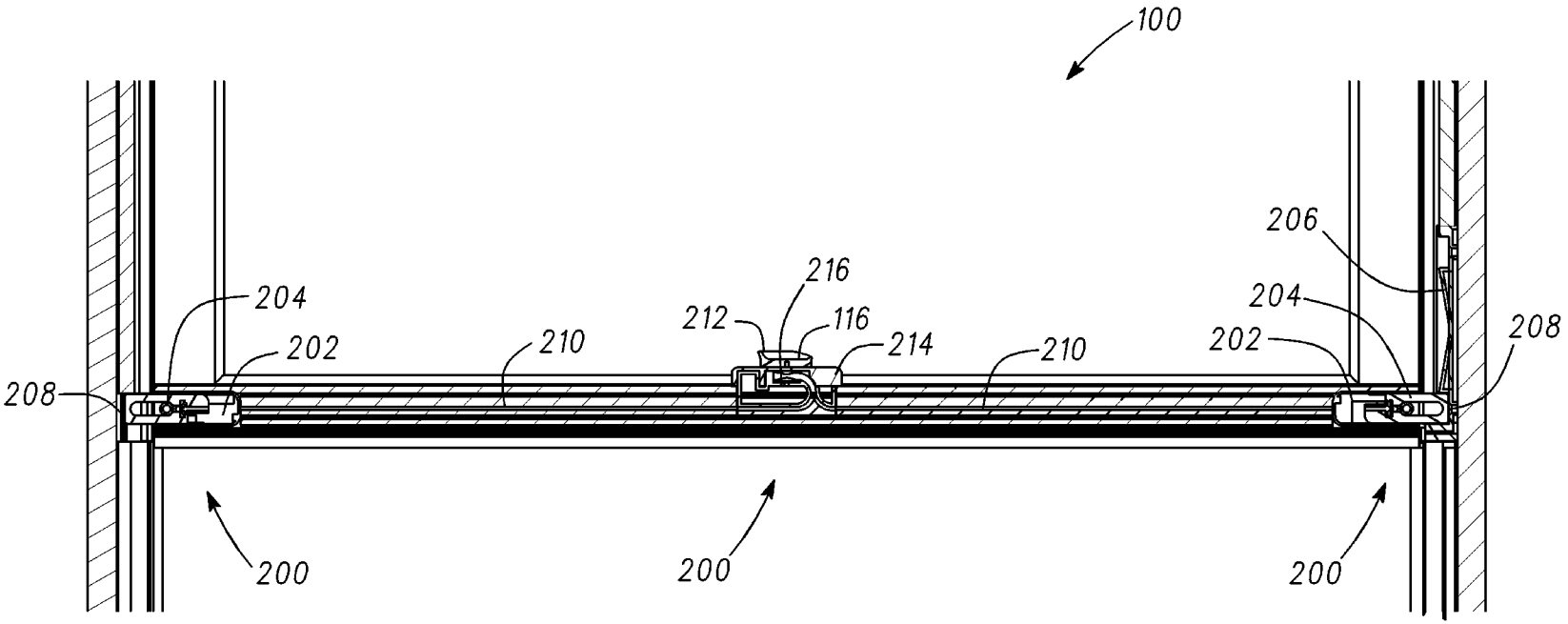
FIG. 2A is a cross sectional view of the fenestration assembly shown in FIG. 1 including one example of an operation hardware assembly installed within a sash.
Figure 2B:
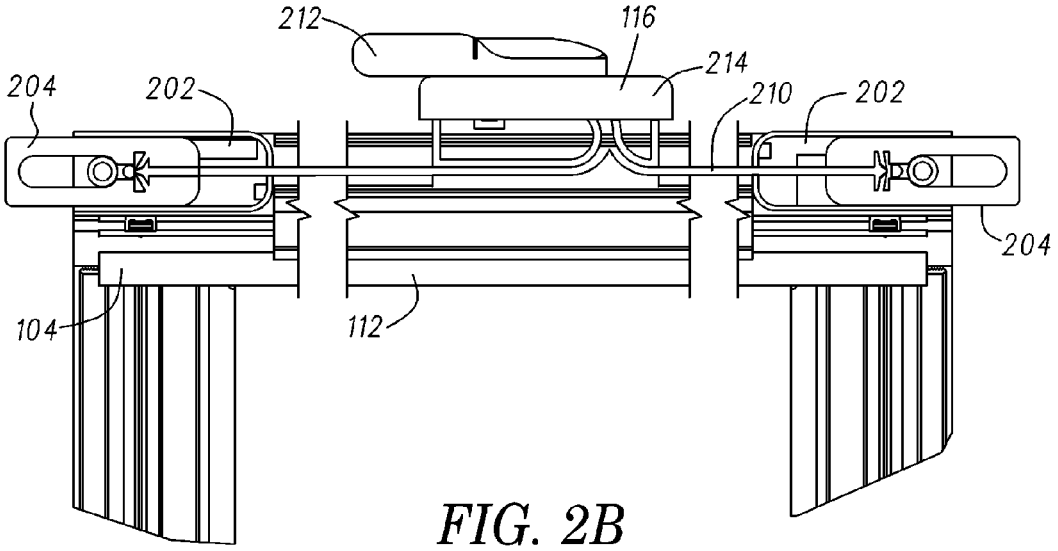
FIG. 2B is a detailed cross sectional view of a sash used with the fenestration assembly including the operation hardware assembly shown in FIG. 1.

Referring now to FIGS. 2A and 2B the fenestration assembly 100 previously shown in FIG. 1 is provided in cross section. As shown the fenestration assembly 100 includes an operation hardware assembly 200 configured to selectively immobilize and free the corresponding sashes such as the bottom and top sashes 104, 106 for sliding within the frame 102. Referring first to FIG. 2A, in one example, the operation hardware assembly 200 includes the operator 116 previously shown in FIG. 1. The operation hardware assembly 200 further includes at least one latch mechanism 202 as shown in FIG. 2A to a latch mechanism 202 are provided in remote positions, for instance, at the ends of the bottom check rail 112 adjacent to portions of the frame 102. As shown the latch mechanism 202 includes a latch bolt 204 movably coupled, for instance, within the bottom check rail or a housing of the latch mechanism. The latch bolt 204 as shown is movable from a projected position (shown in FIGS. 2A, 2B) to a withdrawn position where the latch bolt 204 is at least partially withdrawn into the bottom check rail to allow for movement of the sash such as the bottom sash 104 relative to the frame 102. Referring to both FIGS. 2A and 2B, in another example, the operation hardware assembly 200 includes an actuator cord 210 (e.g., a tying element, such as a string, cable, ribbon, tape and the like) coupling the operator 116 with the one or more latch mechanisms 202. As will be described in further detail herein, the actuator cord 210 transmits rotational force from the operator 116 along the actuator cords 210 to selectively withdraw the latch bolts 204 of each of the latch mechanisms 202. By actuating the operator 116 in this fashion the operation hardware assembly 200 is configured to lock and unlock at least one of the sashes such as the bottom sash 104 relative to the frame 102 for sliding movement within the frame 102. In another example, the operator 116 is further configured to further withdraw on the latch bolts 204 into the bottom check rail 112 to allow tilting of the bottom sash relative to the frame 102, for instance, for cleaning, service and the like of the bottom sash 104. In yet another example, the operator 116 and the operation hardware assembly 200 are correspondingly installed in the top sash 106 to provide the same functionality.

As described above, the operation hardware assembly 200 provides a distributed system across the bottom check rail that utilizes the operator 116 to selectively move the latch bolts 204 of each of the latch mechanisms 202. The operator 116 of the operation hardware assembly 200 is thereby able to remotely operate the latch bolts 204 to effectuate immobilizing and freeing of the sashes such as the bottom and top sashes 104, 106 for movement within the frame 102. Stated another way, the operation hardware assembly 200 consolidates the locking and unlocking of at least the bottom sash 104 relative to the frame 102 without a reaction with another sash such as the top sash 106. That is to say the bottom sash 104 is actuated between locked and unlocked positions (e.g., immobilized and free to move positions) with the actuation with the operation hardware assembly 200 independent from an interaction with the opposed sash such as the top sash 106. This allows for at least the bottom sash 104 to be independently locked and unlocked while the opposing sash such as the top sash 106 is in one example, independently locked itself or free to move after disengagement of the operator 116, for instance, where the operator 116 includes a sweep feature configured for reception with a corresponding keeper on the top sash 106.

Figure 3:
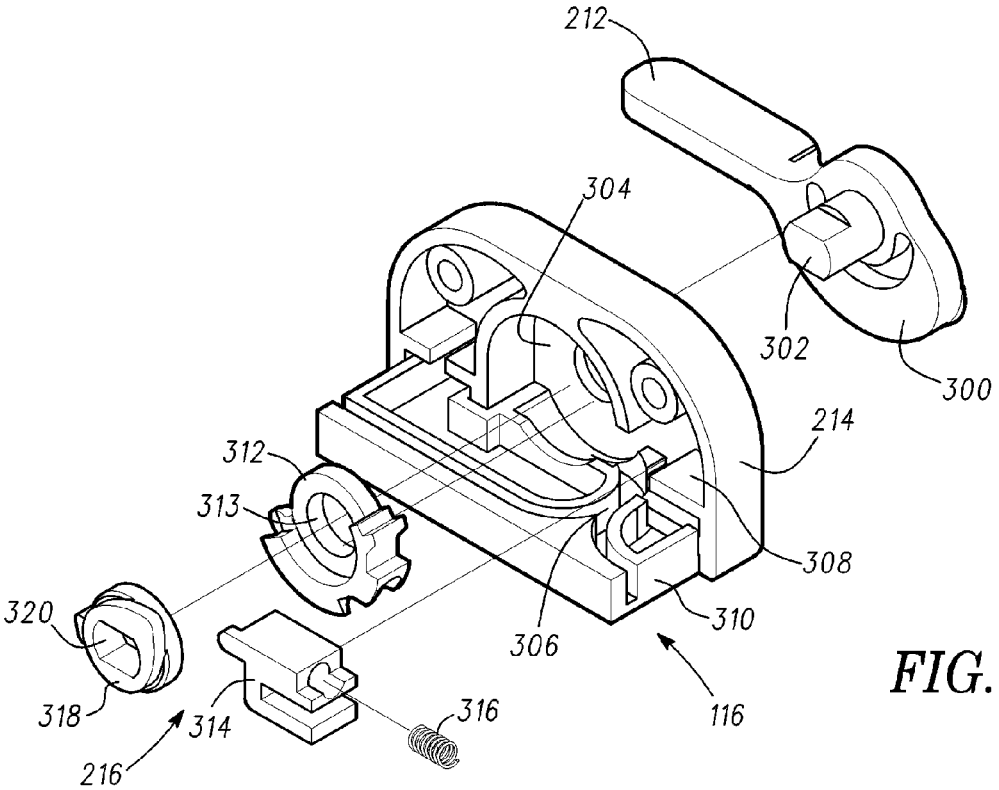
FIG. 3 is an exploded view of the operator shown in FIGS. 2A, B.

FIG. 3 shows one example of the operator 116, previously shown in FIG. 1 in an exploded view. As shown the operator 116 includes a series of elements including the operator hardware body 214 and the operator mechanism 216. The operator 116 further includes an operator interface feature, such as a handle 212 coupled with the operation hardware body 214, for instance, through an orifice extending through the body. In other examples, the operator interface feature includes, but is not limited to, slides, finger pulls and the like. As shown in FIG. 3, the handle 212 includes a shank 302, for instance, a non-circular shank 302 sized and shaped to engage with features of the operator mechanism 216 described herein below. In one example, the handle 212 includes a sweep 300 sized and shaped to engage with a corresponding keeper, for instance, provided on the top sash 106. For instance, the keeper includes a metallic flange sized and shaped to extend over top of the sweep 300 when the sweep 300 projects away from the operation hardware body 214, for instance, in the orientation shown in FIG. 3 (when assembled).

Referring again to FIG. 3, the operator 116 is shown including the operation hardware body 214. As shown, the operation hardware body 214 includes a mechanism recess 304 sized and shaped to receive the operator mechanism 216 described herein. Additionally, the operation hardware body 214 further includes a cord groove 306 extending along a cord flange 310. As shown the cord flange 310 extends the cord groove 306 at angle substantially perpendicular with the point of operation of the handle 212. As will be described herein below the operator mechanism 216 wraps a portion of the cord around a series of elements in the operator mechanism 216 substantially parallel to the handle 212. The cord flange 310 and the cord groove 306 and the cord flange 310 transitions the cord from the orientation parallel to the handle 212 to substantially perpendicular orientation to deliver the cords in a substantially linear fashion to the latch mechanism such as the latch mechanisms 202 shown in FIG. 2A.

As shown in FIG. 3, the operator mechanism 216 includes a plurality of components coupled with the handle 212, for instance, along with the shank 302 of the handle. In one example, the operator mechanism 216 includes a spool 312 including a spool opening 313. The spool 312 is placed over the shank 302 and the spool opening 313 provides a circular inter fit with the handle 212. That is to say the spool 312 without further engagement with other components is free to rotate relative to the shank 302. As will be described further below, the spool 312 includes one or more notches (e.g., detent recesses), fittings and the like sized and shaped to engage with other components of the operator mechanism 216 so that discrete positioning of the handle 212 locks the handle in place and accordingly moves the latch bolts 204 of the latch mechanisms 202 into various positions before differing operation of the sashes such as the bottom and top sashes 104, 106. Referring again to FIG. 3, the operator mechanism 216 further includes a detent 314 sized and shaped for selective engagement with portions of the spool 312, for instance, notches of the spool. As shown the detent 314 is retained within a detent housing 308 (e.g., a recess) formed in the operation hardware body 214. In another example, a detent biasing member 316 is provided between the detent 314 and the operation hardware body 214. In one example, the detent biasing member and the detent 314 form a detent assembly sized and shaped to bias the detent 314 into engagement with one or more portions of the spool 312.

The operator mechanism 216 further includes a cam fitting 318 sized and shaped for coupling along the shank 302 of the handle 212. As shown the cam fitting 318 includes a cam opening 320. The cam opening 320 is non-circular it has a corresponding shape to the non-circular portion of the shank 302. Engagement of the cam fitting 318, for instance, the surfaces of the cam opening 320 with the corresponding surfaces of the shank 302 ensures rotation of the handle 212 is correspondingly transmitted to the cam fitting 318 without rotatable movement therebetween. Stated another way, the cam fitting 318 is mobilized when assembled on the shank 302 so that rotation of the handle 212 is directly applied to the cam fitting 318. As will be described in further detail below the cam fitting 318 cooperates with one or more features of the spool 312 and the detent 314 to transmit rotational movement to the spool 312 and accordingly to the cord coupled with the spool and also provide camming action to the detent 314 to reset the spool 312 and thereby release the spool from engagement with the handle 212 and allow the spool to unwrap thereby releasing the latch bolts 204 of the latch mechanisms 202 to project from the sashes such as one or more of the bottom or top sash 104, 106 as described herein.

Figure 4:
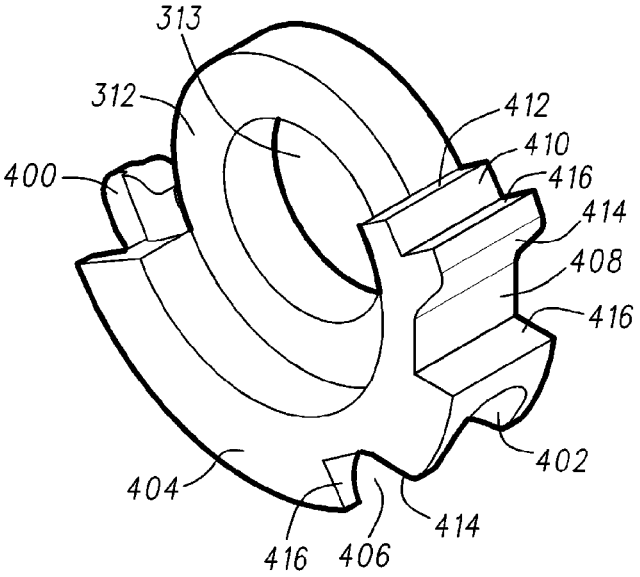
FIG. 4 is a perspective view of one example of a spool for use with the operator shown in FIGS. 2A, B.

FIG. 4 shows a perspective example of the spool 312 previously shown in FIG. 3. As shown the spool 312 includes the previously described spool opening 313 to facilitate rotatable coupling with the shank 302 of the handle 212. As will be described further herein, the spool 312 is coupled with the cord extending from the operator 116 to the one or more latch mechanisms 202, for instance, the latch bolts 204 therein. In the example shown in FIG. 4, the spool 312 includes a cord hook 400 sized and shaped to receive a loop of the cord coupled between the latch mechanisms 202 as shown in FIG. 2A. For instance, the cord extends from each of the latch mechanisms 202, the operator 116, and through the cord groove 306 (shown in FIG. 3) along a cord groove 402 to a cord hook 400 where the loop of cord is fitted over the cord hook to retain the cord in engagement with the spool 312. As will be described in further detail below, rotation of the spool 312, for instance, through engagement with the cam fitting 318 transmits rotation from the handle 212 to the spool 312 and correspondingly pulls or relaxes the cord coupled with the spool 312, for instance, with the cord hook 400.

Referring again to FIG. 4 the spool 312 in another example includes a notch saddle 404 extending along a portion of the spool 312. As shown the notch saddle 404 includes a plurality of notches 406, 408, 410 (e.g., detent recesses) including corresponding tapered and engaging surfaces 414, 416. As will be described in further detail below, each of the first, second and third notches facilitate differing operational positions of the latch bolts 204 to facilitate one or more of locking of the top or bottom sash 106, 104 release of the top and bottom sash, for instance, for sliding within the frame 102 and further withdrawing of the latch bolts 204, for instance, to allow for tilting of one or more of the bottom or top sashes 104, 106. For instance, the detent 314 shown in FIG. 3 engages with the corresponding notches, for instance, their respective engaging surfaces 416 to hold the spool 312 in a desired orientation that correspondingly holds the latch bolts 204 in either a projected, a withdrawn, or fully withdrawn state to facilitate the locking, unlocking and tilting modes of one or more of the top and the bottom sashes 106, 104. In one example, the first notch 406 corresponds to a locked position of the latch bolts 204. In this orientation the latch bolts 204 extend from the latch mechanisms 202 and are fully received within corresponding bolt recesses 208 or grooves within the frame 102. The second notch 408 corresponds to a fully unlocked position wherein the latch bolts 204 are withdrawn to facilitate the sliding movement of the sash such as the bottom sash 104 relative to the frame 102. Similarly, the third notch corresponds to a tilt position wherein the latch bolts 204 are fully withdrawn from the corresponding features within the frame 102 to allow tilting of the sash such as the bottom 104 out of the frame 102.

As shown in FIG. 4, the spool 312 includes other features including, for instance, a spool flange 412 at one end of the notch saddle 404. The spool flange 412 is sized and shaped for engaged with a corresponding feature, a spool engagement boss 600 shown in FIG. 6, it transmits rotational movement from the handle 212 to the spool 312 to allow for rotation of the spool in corresponding operation of the latch bolts 204.

Referring again to FIG. 4 and the first and second and third notches 406, 408, 410 as previously described one or more of the notches include corresponding tapered surfaces 414 and engaging surfaces 416. The tapered surfaces 414 facilitate the sliding movement of the detent such as the detent projection over the tapered surfaces 414 during rotation of the spool 312 to allow the detent to ride over the notch saddle 404 into the next notch. For instance, as shown in FIG. 4, the first notch 406 includes an engaging surface 416 sized and shaped to engage the detent. The engaging surface 416 holds the spool 312 statically when engaged with the detent to thereby prevent unwrapping of the latch bolt 204, for instance, by pulling on the latch bolts 204 relative to the latch mechanisms 202. Stated another way, the actuator cord 210 (e.g., a cable, string, ribbon, tape and the like) shown in FIG. 2A cannot be unwound from the spool 312, in one example, because of the engagement of the detent with the engaging surface 416 with the first notch 406. When it is desired to rotate the spool 312, for instance, into the fully unlocked position the handle 212 is rotated and the detent rides over the corresponding tapered surface 414 of the first notch 406 into the second notch 408. The second notch 408 as well as the third notch 410 include corresponding engaging surfaces 416 sized and shaped to hold the spool 312 in the desired orientation when engaged with the detent to substantially prevent rotation of the spool 312 (e.g., in a counter-clock-wise fashion or clock-wise fashion (if viewed from above)) to thereby move the rotatable handle 212 out of a desired orientation including but not limited to the locked, fully unlocked and tilt positions described herein.

Figure 5:
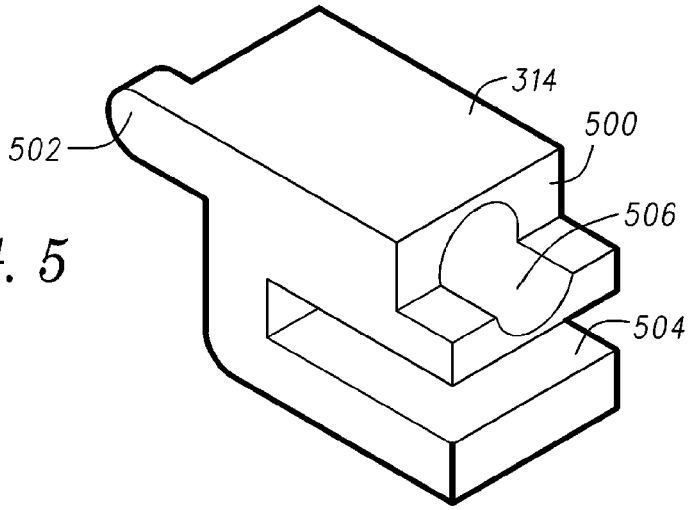
FIG. 5 is a perspective view of one example of a detent for use with the operator shown in FIGS. 2A, B.

FIG. 5 shows one example of the detent 314 previously shown in FIG. 3. As shown the detent 314 includes, in the example, the detent body 500 having a detent projection 502 extending therefrom. The detent projection 502 is sized and shaped to position the detent projection 502 within the first, second and third notches 406, 408, 410 and correspondingly engage with one or more of the tapered and engaging surfaces 414, 416. For instance, the detent projection 502 is formed on one side of the detent 314 as shown in FIG. 5, for instance, the left side to allow for engagement between the detent projection 502 and the corresponding features of the spool 312 during rotation of the spool 312. The engagement of the detent projection 502 with this portion of the notch saddle 404 shown in FIG. 4 substantially allows the detent locking of the spool 312 but does not otherwise interfere with the wrapping of the actuator cord 210 within the cord roof 402 and around the cord hook 400. That is to say the actuator cord 210 is wrapped around a more central portion of the spool 312 relative to the engagement of the detent projection 502 along the corresponding features of the notch saddle 404, for instance, along a periphery of the spool 312.

Referring again to FIG. 5, the detent 314 further includes a guide slot 504 sized and shaped to engage with the corresponding feature of the detent housing within the operation hardware body 214. As shown, for instance, in FIG. 3 the detent housing 308 includes a corresponding ridge sized and shaped for reception within the guide slot 504 to thereby guide movement of the detent 314 during operation of the operator mechanism 216. Additionally, the detent body 500 includes, in another example, a bias member recess 506 sized and shaped to receive the detent biasing member 316 therein. As shown in FIG. 3, the detent biasing member 316 is, in one example, a coil spring. One end of the coil spring is received within the bias member recess 506 while the opposed end of the detent biasing member 316 is engaged with a portion of the operation hardware body 214 shown in FIG. 3. The detent is thereby biased inwardly, for instance, towards the spool 312 during operation of the operator mechanism 216.

Figure 6:
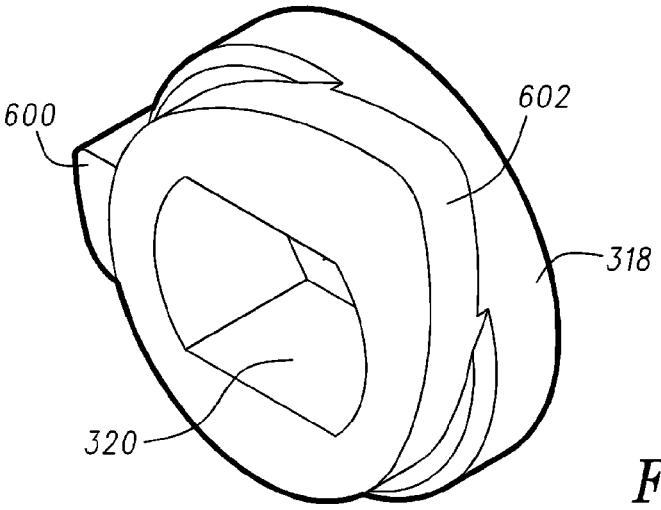
FIG. 6 is a perspective view of one example of a cam fitting for use with the operator shown in FIGS. 2A, B.

FIG. 6 shows another component of the operator mechanism 216 previously shown in FIG. 3. In this example, the cam fitting 318 is shown. As previously described, the cam fitting 318 includes a cam opening 320 having non-circular surfaces. The non-circular surfaces of the cam opening 320 are sized and shaped to engage with the corresponding non-circular surfaces of the shank 302 of the handle 212. The shank 302 is thereby configured to directly transmit rotational movement to the cam fitting 318 through the engagement of the non-circular surfaces of the corresponding cam opening 320 and the shank 302. Referring now to FIG. 6, the cam fitting 318 further includes a spool engagement boss 600 and a reset cam 602. In one example, the spool engagement boss 600 is a projection extending away from the remainder of the cam fitting 318. As will be described in further detail below in one example, the spool engagement boss 600 is sized and shaped for engagement with the spool flange 412. When engaged with the spool flange 412 rotation of the handle 212 and the corresponding cam fitting 318 is directly transmitted to the spool 312 to thereby rotate the spool with the handle 212. Similarly, when the spool engagement boss 600 is disengaged from the spool flange 412 the spool 312 is allowed to rotate relative to the shank 302 and the handle 212. As will be described herein below, disengagement of the spool engagement boss 600 and the spool flange 412 is used to, in one example, reset the operator mechanism 216 and allow for repositioning of each of the latch bolts 204 with the latch mechanisms 202 in a locked configuration. As further shown in FIG. 6, the reset cam 602 extends away from the remainder of the cam fitting 318. The reset cam 602 is sized and shaped to engage with, for instance, the detent including, for instance, the detent projection 502 and thereby position the detent projection 502 outside of one or more of the first and second third notches 406, 408, 410 shown in FIG. 4. Movement of the detent projection 502 out of the corresponding notches 406, 408, 410 allows the bias within each of the latch mechanisms 202, for instance, by way of coil springs to bias the latch bolts 204 outwardly, for instance, into projecting orientations with the latch bolts 204 received within corresponding bolt recesses as shown in FIG. 2A. The reset cam 602 thereby cooperates with the remainder of the operator mechanism 216 to reset the spool 312 and thereby move the latch bolts 204 into the locking engagement with corresponding portions of the frame 102.

Figure 7:
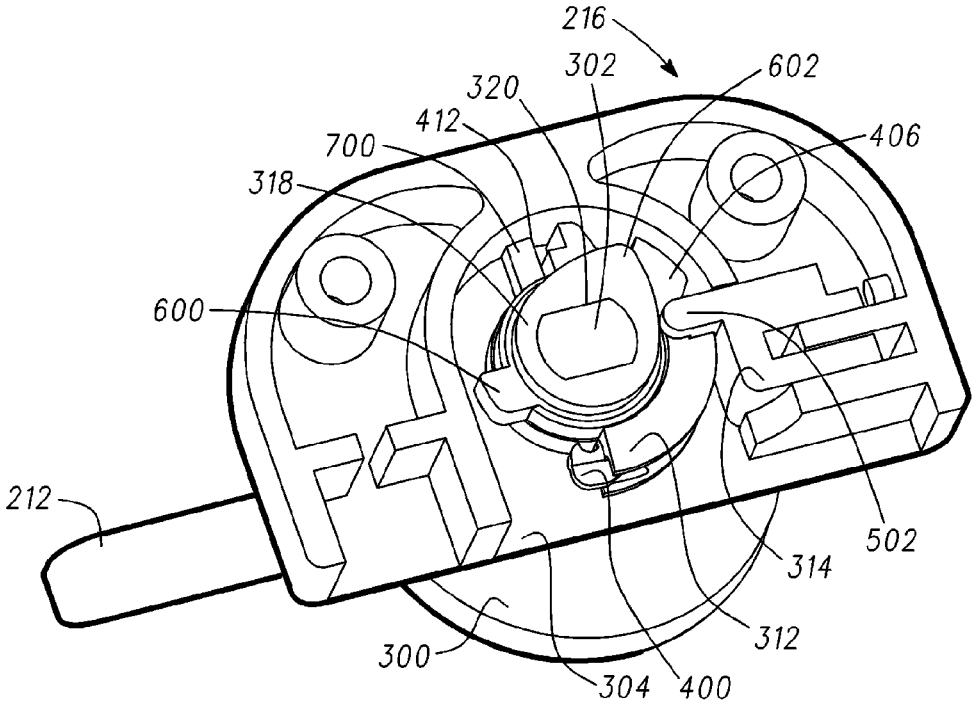
FIG. 7 is a perspective view of the assembled operator shown in FIGS. 2A, B.
Figure 8:
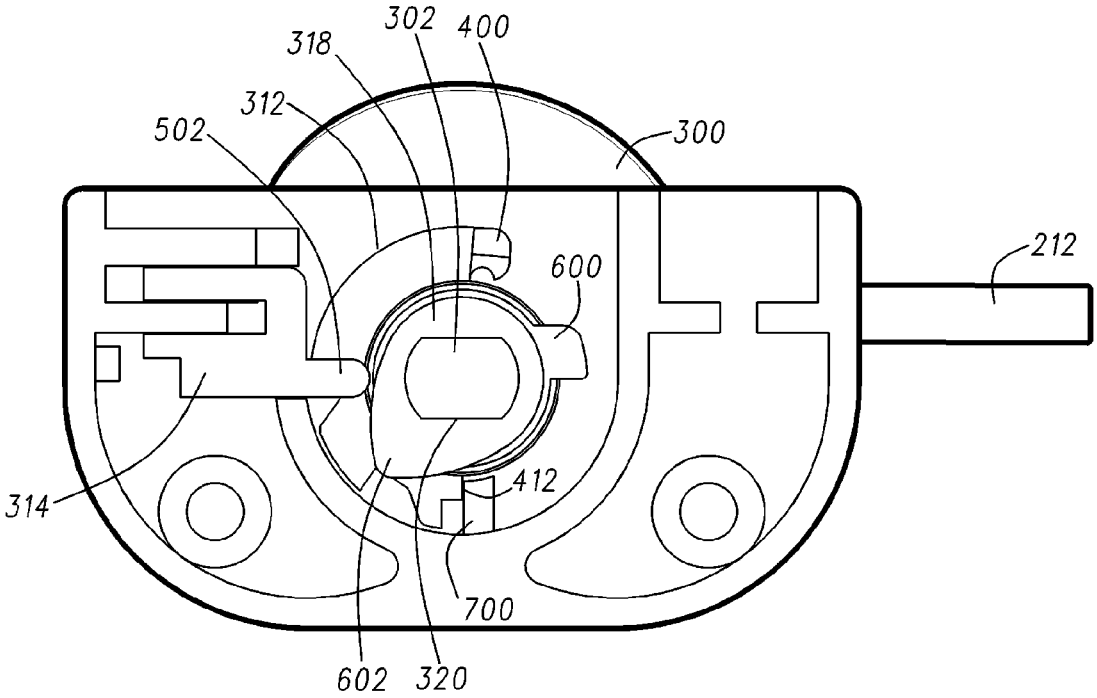
FIG. 8 is a bottom view of the assembled operator shown in FIG. 7.

FIGS. 7 and 8 show respective perspective and bottom views of the operator 116 previously shown in FIG. 1. As shown, each of the components of the operator mechanism 216 for instance the spool 312, detent 314, and cam fitting 318 are provided in an assembled configuration and coupled with the handle 212 for instance by passing the shank 302 through the corresponding spool opening 313 and cam opening 320. As previously described the non-circular cam opening 320 of the cam fitting 318 allows for coupling of the cam fitting 320 with the handle 212 and transmission of rotation from the handle 212 to the cam fitting 318. The spool 312 includes a circular spool opening 313 sized and shaped to rotate relative to the shank 302. Further, as previously described, the cam fitting 318 is provided in one example with a spool engagement boss 600 sized and shaped for engagement with the spool flange 412 to transmit rotational movement to the spool 312 from the cam fitting 318 in the handle 212.

Figure 9:
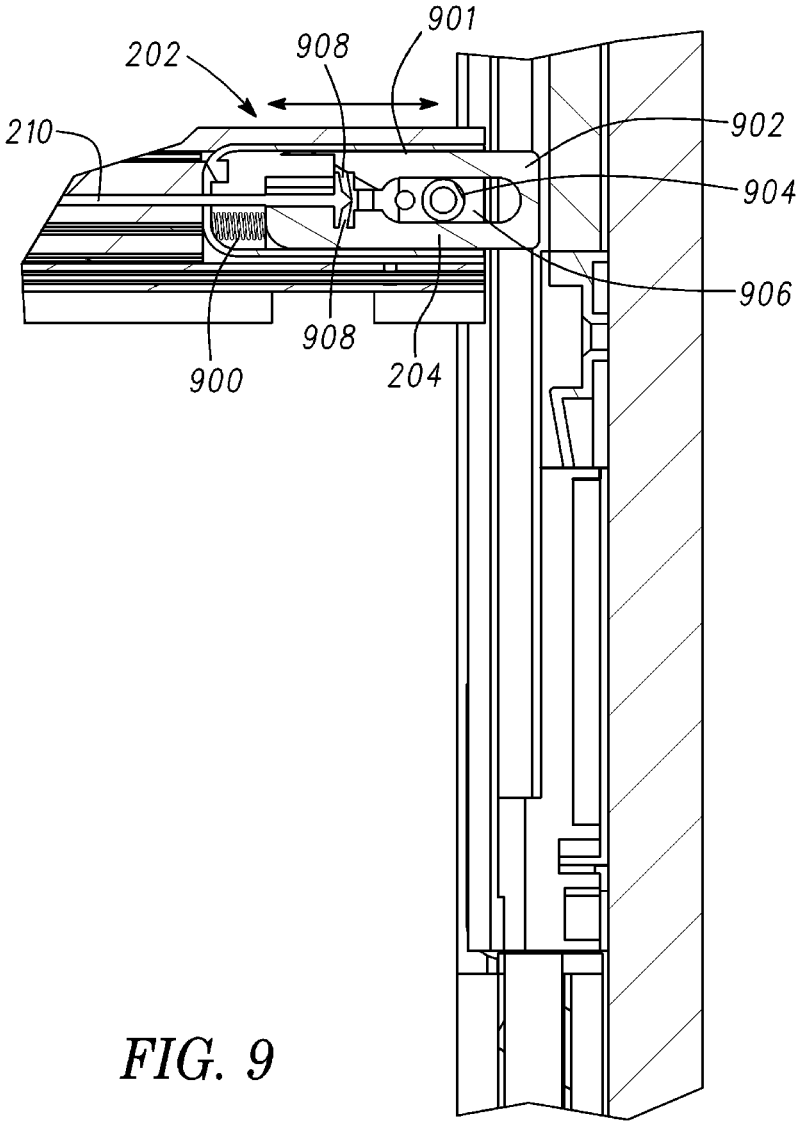
FIG. 9 is a cross sectional view of one example of a latch mechanism installed within a sash.

FIG. 9 shows one example of a latch mechanism such as the latch mechanism 202 previously shown in FIGS. 2A and 2B. As shown in FIG. 9 the latch mechanism 202 includes a latch bolt 204 moveably positioned within a latch housing 901. In one example, the latch bolt 204 includes a latch bolt head 902 sized and shaped for reception within a recess such as the bolt recess 208 shown in FIG. 2A. The latch bolt 204 in another example includes a guide slot 906 sized and shaped to receive a guide pin 904 therein to correspondingly guide movement of the latch bolt 204 during operation of the operation hardware assembly 200. As further shown in FIG. 9, the latch mechanism 202 further includes in another example a latch bolt biasing element 900 such as a coil spring sized and shaped to bias the latch bolt 204 and the latch bolt head 902 outwardly relative to one or more of the sashes including the bottom and top sashes 104, 106 previously shown in FIG. 1. In one example, the latch bolt biasing element 900 includes, but is not limited, to a coil spring elastomeric material and the like. As shown, for instance, in FIG. 9 in one example the latch mechanism 202 is shown installed within the bottom check rail 112 of the bottom sash 104. For instance in one example, the latch bolt mechanism 202 is installed within the bottom check rail 112 and is concealed when viewed from the exterior or interior of the fenestration assembly 100 shown in FIG. 1 (whether the assembly is in an open or closed configuration). In another example, the latch mechanism 202 is installed along a surface of the bottom check rail 112. For instance, a surface facing the opposed upper check rail 114. In the closed configuration shown in FIG. 1, the latch mechanism 202 is thereby concealed by the upper check rail 114 and is not otherwise detract from the aesthetic appeal of the fenestration assembly 100. With the latch mechanism 202 positioned outwardly, for instance, along the periphery of the bottom check rail 112 as opposed to centrally within the bottom check rail the slot and tenon joinery of the various components of the sash, such as the bottom check rail 112 and the styles of the bottom sash 104 is not compromised. In a similar manner, the operator 116 previously described and shown in FIG. 3 is similarly positioned either centrally within the bottom check rail 112 or along the periphery or edge of the bottom check rail 112 in a similar manner to the latch mechanism 202 described herein. In yet another option, the operator 116 and the latch mechanisms 202 are correspondingly positioned centrally within the upper check rail 114 or along an edge surface of the upper check rail 114 opposed to the bottom check rail 112 wherein the top sash 106 includes its own operation hardware assembly 200.

As further shown in FIG. 9, the actuator cord 210 extends through a corresponding channel of the bottom check rail 112 into the latch housing 901 for coupling with the latch bolt 204. In one example the actuator cord 210 is coupled with the latch bolt 204 with a cord retaining feature. The cord retaining feature eliminates the need for the actuator cord 210 to be supplied in a precise length according to the dimensions of the bottom or top sash 104, 106 (e.g., corresponding to their width for instance) and instead allows for accurate installation of the cords and removal of slack in the cords during installation of the operation hardware assembly 200. The cord retaining feature is made up of two opposing fingers 908 that are angled and positioned in such a way as to allow the cord to slide in one direction relative to the opposing fingers 908 (i.e., with the taper of the fingers), but pinch the cord between the opposing fingers when the cord is pulled in an opposite direction (against the taper of the fingers 908).

Figure 10:
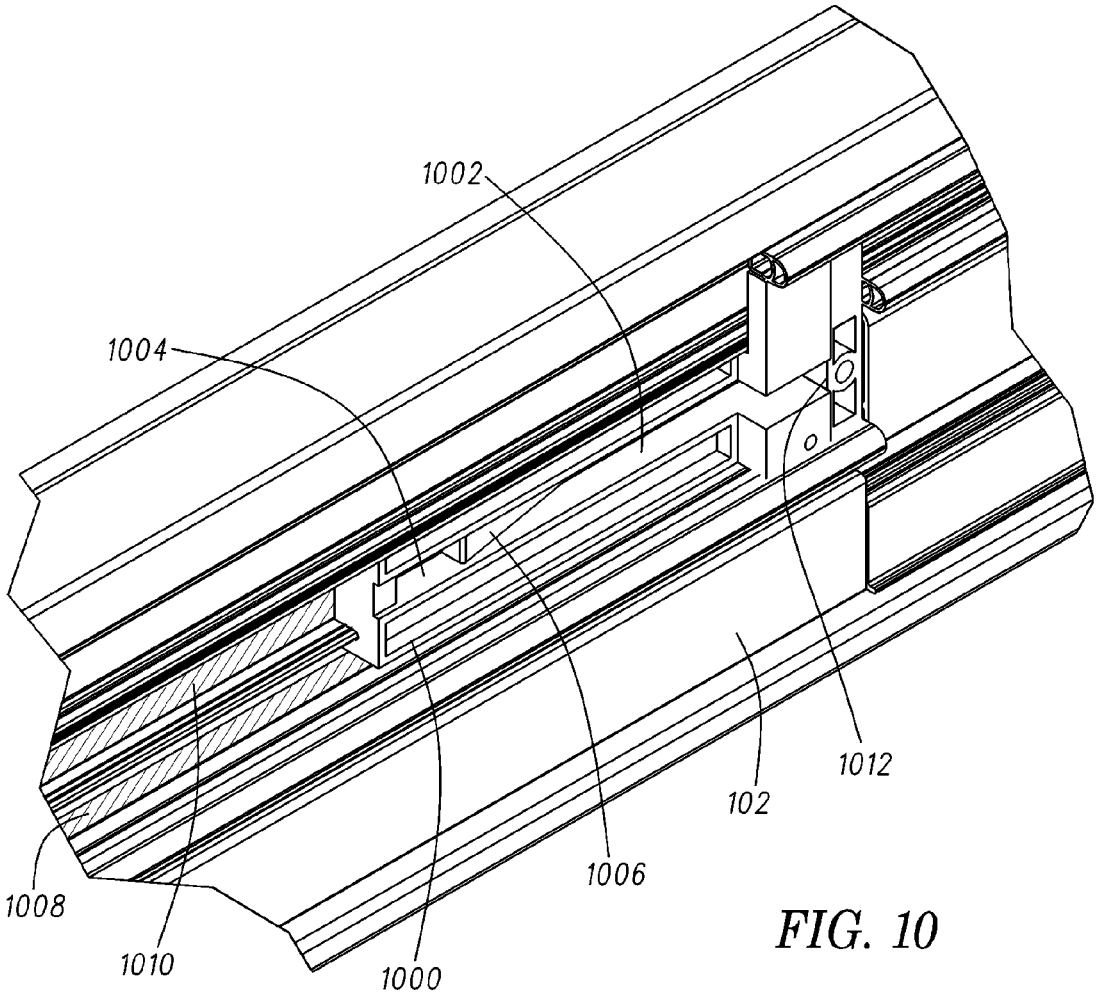
FIG. 10 is an isometric view showing one example of a jamb component of the operation hardware assembly.

FIG. 10 shows one example of a jamb component 1000 sized and shaped to provide engagement with the latch bolt of at least one of the latch mechanisms 202 previously described herein. In one example the jamb component 1000 is installed within a portion of a sash groove 1010. In one example the sash groove 1010 allows for slidable movement of the sashes such as the top and bottom sashes 106, 104 during normal operation of the fenestration assembly 100. In the example shown in FIG. 10 a sash groove cover 1008 is provided over a portion of the sash groove 1010 to provide a transition to the jamb component 1000 and allow for sliding movement of the sash even where the latch bolt 204 is released from the withdrawn position (e.g., the released bolt engages with the cover 1008 before fully projecting).

As shown in FIG. 10, the jamb component 1000 includes a component groove 1002. Where the latch bolt 204 is withdrawn out of a corresponding vent recess 1004 and the bottom or top sash 104, 106 are moved relative to the vent recess 1004 the component groove 1002 allows sliding of the bottom or top sash 104, 106 after resetting of the latch bolt 204 for instance to a projecting configuration. For instance, the jamb component 1000 as shown in FIG. 10 includes a resetting ramp 1006 that tapers away from the vent recess 1004. After resetting of the latch bolts 204 as previously described herein and described in further detail below, the latch bolt 204 may ride down the resetting ramp 1006 toward an opposed end of a component groove 1002 (e.g., toward the closed position shown in FIG. 1). At the opposed end of the component groove 1002 an engagement surface 1012 is provided. The latch bolts 204 allow for the sliding movement of the sash, such as the bottom sash 104, downward into engagement with the engagement surface 1012. The engagement surface 1012 thereafter interrupts or stops further movement of the sash, such as the bottom sash 104 downwardly. As discussed herein, the bottom sash 104 is locked in the closed position (with the latch bolt 204 engaged with the engagement surface 1012) with the optional sweep 300 of the operator 116 engaged with a keeper.

In one example, the engagement surface 1012 is positioned approximately four inches from the vent recess 1004 to thereby correspondingly allow for approximately four inches of upward movement of the bottom sash 104 from the closed position with the latch bolts 204 in a projected position. The projecting latch bolts 204 (e.g., within opposed component grooves 1002 on either side of the frame 102) will ride along the resetting ramp 1006, gradually withdraw according to the tapered engagement, and then project into the vent recesses 1004 upon alignment with the recesses. This automatically and securely locks the bottom sash at a secure vent position (e.g., approximately 4 inches according to the position of the vent recesses 1004).

With withdrawal of the latch bolts 204, for instance into a fully unlocked configuration (corresponding to the second notch 408), the bottom sash 104 used cooperatively with the jamb component 1000 shown in FIG. 10 will continue with upward movement relative to the frame 102 past the vent recess 1004. For instance, the latch bolts 204 such as the latch bolt heads 902 are able to ride along respective sash groove cover 1008 positioned within the sash grooves 1010 of opposed jamb components 1000 on either side of the frame 102.

After resetting of the latch bolt 204, for instance through operation of the handle 212 and the cam fitting 318, the latch bolt 204 projects away from the bottom sash 104 again and as the bottom sash 104 is moved downwardly, the latch bolt 204 falls into the vent recess 1002 (e.g., a secure venting position). If the latch bolt 204 is withdrawn again (or is maintained in the withdrawn configuration without seating in the vent recess 1002) and the bottom sash 104 is further depressed the latch bolt rides along the resetting ramp 1006 toward the engagement surface 1012. As will be described in further detail herein with differing permutations of the jamb component 1000, the operability of the bottom and top sashes 104, 106 can be adjusted according to interaction with the operation hardware assembly 200, as previously described herein.

Referring now to FIG. 11A, the bottom sash 104 is shown in a locked configuration with the frame 102. For instance, the latch bolt 204 is provided in a projected configuration and received within the locking recess 1004 previously shown in FIG. 10. In this example, the operation hardware assembly 200, for instance including the operator 116 and the latch mechanisms 202, may be used with or without a keeper such as a keeper provided on an opposing sash such as the top sash 106. Instead, the latch bolt 204 provides locking engagement between the bottom sash 104 and the frame 102 through engagement of the latch bolt 204 within the locking recess 1004. In another option, the latch bolt 204 or latch bolts 204 of each of the latch mechanisms 202 as shown in FIG. 2A work in combination, for instance with a keeper and sweep between the top and bottom sashes 106, 104. For instance referring to FIG. 3, the handle 212 includes a sweep 300 sized and shaped to be positioned beneath a corresponding keeper provided on the top sash 106. When operation of the sash 104 is desired (e.g., sliding movement of the sash) the operator 116 is actuated. For instance, the handle 212 is rotated to disengage the sweep 300 from the corresponding keeper and the actuator cord 210 shown in FIGS. 2A and 2B is pulled through rotation in the handle 212 and the corresponding spool 312 to pull the latch bolts 204 out of the reception within locking recesses 1004 of the corresponding jamb components 1000. The sash 104 may thereafter be slid upwardly relative to the frame 102. Upon release of the latch bolts 204, the latch bolts 204 ride into the component groove 1003 of the jamb component 1001 and are free to slide within the component groove until engagement with the engagement surface 1012, for instance holding the bottom sash 104 in a secure venting position where the bottom sash 104 cannot otherwise move upwardly until the latch bolts 204 are operated again. In another example, the operator mechanism 216 is actuated in such a manner that spool 312 is retained at an orientation such as with the detent and the second notch 408 to withdraw the sash bolts 204 into the bottom sash 104 and thereby allow the bottom sash 104 to slide freely above the engagement surfaces 1012 of the corresponding jamb components 1001. Upon depression of the sash 104 toward the closed position if the latch bolts 204 are released as described herein, the latch bolts ride over the resetting ramp 1006 for positioning within the locking recess 1004 to automatically lock the bottom sash 104 in the closed configuration.

Referring now to FIG. 11B, another example of a jamb component 1100 is provided. In this example the jamb component 1100 includes two recesses. For instance, a locking recess 1102 similar in some respect to the locking recess 1004 previously shown in FIGS. 10 and 11A and a vent recess 1104. An interposing surface 1106 is provided between the locking recess 1102 and the vent recess 1104 to allow for sliding movement of the latch bolt 204 therebetween an automatic positioning and locking of the bottom sash 104 upon reception of the latch bolt 204 in one of the locking recess 1102 or vent recess 1104.

For instance, during operation as the latch bolt 204 is withdrawn for instance through operation of the handle 212 and corresponding rotation of the spool 312 through engagement of the cam fitting 318 the latch bolt frees the bottom sash 104 to move along the frame 102. While the latch bolts 204 are withdrawn and held in the withdrawn position for instance through cooperation of the detent 314 and the spool 312, the bottom sash 104 is free to slide within the frame 102. Upon release of the latch bolt 204, for instance where the latch bolt 204 is opposed to the interposing surface 1106 or the sash groove cover 1008, the latch bolt 204 projects away from the bottom sash 104 and engages with the corresponding interposing surface 1106 or sash groove cover 1008. Upon depression or elevation of the bottom sash 104 into a position where the latch bolt 204 may drop into one or more of the vent recess 1104 or locking recess 1102, the bottom sash 104 correspondingly becomes locked at that corresponding position. For instance where secure venting of the fenestration assembly 100 is desired, the operation hardware assembly 200 is operated to withdraw the latch bolts 204 and hold the latch bolts in a withdrawn state until the bottom sash 104 is elevated. The latch bolts are thereafter released for instance through operation of the cam fitting 318 to thereby allow for automatic locking of the latch bolts 204 within the vent recesses 1104 to thereby securely hold the bottom sash 104 at a desired position for instance approximately four inches elevated relative to the bottom of the frame 102. The bottom sash 104 cannot thereafter be moved until the operation hardware assembly 200 is thereafter operated again to withdraw the latch bolts 204 from the vent recesses 1104. In a similar manner the latch bolts 204 will automatically position themselves within the locking recesses 1102 to automatically lock the bottom sash 104 in the closed position shown in FIG. 1 upon depression of the bottom sash 104 into the orientation shown in FIG. 1.

In the example shown in FIG. 11B as previously described with FIG. 11A, the operator 116 including, for instance, the handle 212 is optionally provided with a sweep 300 sized and shaped for engagement with a keeper on a corresponding portion of the top sash 106. For instance, in one example the sweep 300 and keeper provide a redundant or complimentary locking system for use with the latch bolts 204 to securely lock the bottom sash 104 in place relative to the frame 102. In another example, the latch bolts 204 are provided independently without the provision of a sweep 300 on the handle 212. In such an example, the bottom sash 104 is locked independently from the top sash 106 through engagement between the latch bolts 204 and the corresponding portions of the frame 102, for instance the jamb component 1100 having the locking recesses 1102. In such an example, the top sash 106 is provided for instance, with its own locking assembly and the top and bottom sashes 106, 104 are thereby able to lock and move independent relative to the opposed sash.

Referring now to FIGS. 11C and 11D, another example of a jamb component 1110 is provided. As shown, the jamb component 1110 is similarly coupled with the frame 102. For instance, the jamb component 1110 is positioned within a sash groove 1010 of the frame 102. As shown, the jamb component 1110 includes a component groove 1112 including a vent ramp 1116 that gradually tapers upwardly toward a vent recess 1114. At an opposed side of the jamb component 1110 the jamb component includes an engagement surface 1118 sized and shaped to engage with the latch bolt 204 while the latch bolt is in a projecting configuration such as the configuration shown in FIG. 11C. In the configuration shown in FIG. 11C, the latch bolt 204 does not provide for a locking of the bottom sash 104 while in the closed configuration (see FIG. 1). For instance, the bottom sash 104 is instead provided with another locking feature such as a sweep (see feature 300 shown in FIG. 3) sized and shaped to engage with a corresponding keeper provided on the opposed sash such as the top sash 106. Upon disengagement of this sweep 300 from the keeper, the bottom sash 104 is able to freely slide upward relative to the frame 102. For instance, the latch bolts 204 and the projected configuration shown in FIG. 11C continue to travel along the component groove 1112 and the vent ramp 1116 eventually falling into the vent recess 1114 thereby locking the bottom sash 104 in a secure venting position. It is only upon operation with the operator 116 for instance through rotation of the handle 212 in corresponding movement of the spool 312 that the actuator cord 210 moves the latch bolts 204 out of their position within the vent recesses 1114 and allow the sash 104 to continue movement either upwardly relative to the frame 102 or downwardly towards the closed position previously shown in FIG. 1.

Referring now to FIG. 11D, the jamb component 1110 previously shown in FIG. 11C is shown again with the sash 104 elevated relative to the orientation provided in FIG. 11C. In this example, the latch bolt 204 is again provided in a projected configuration wherein the latch bolt is positioned within the vent recesses 1114 thereby securely on the bottom sash 104 in a secure vent position. It is only upon actuation, for instance through rotation of the handle 212 and rotation of the spindle 312 coupled with the actuator cord 210 shown in FIGS. 2A and 2B that the latch bolts 204 are withdrawn to facilitate further movement of the bottom sash 104 relative to the frame 102.

Figure 12:
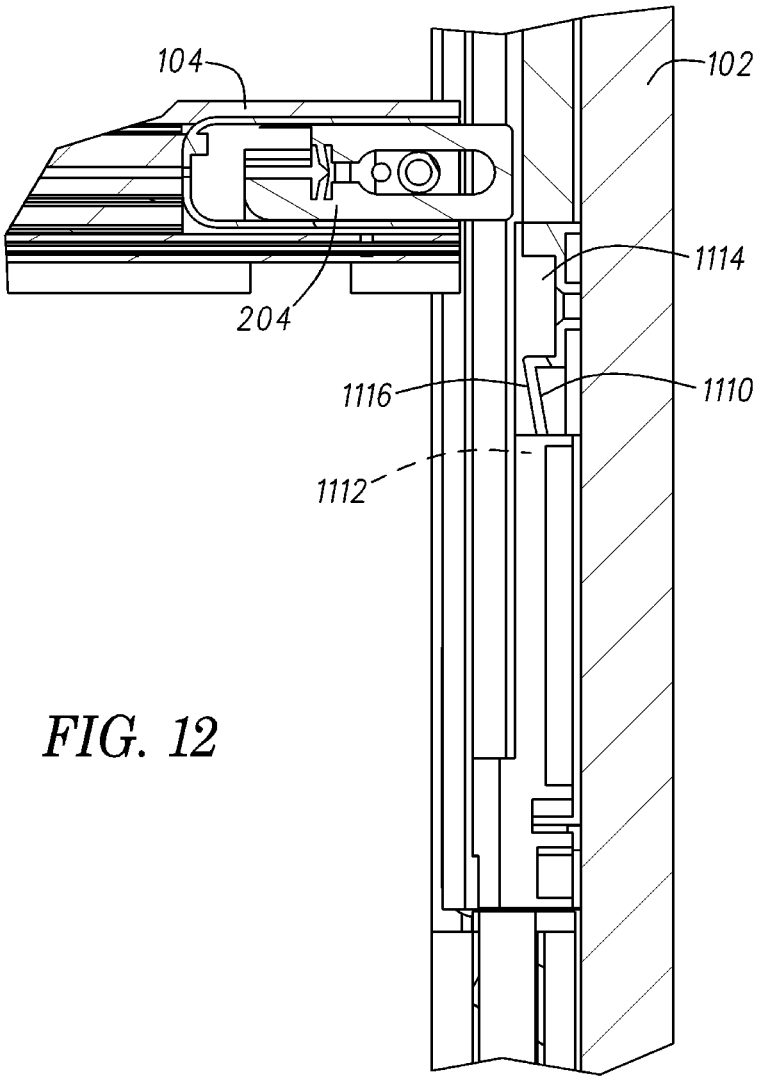
FIG. 12 is a cross sectional view of the jamb component shown in FIGS. 11C, D with the latch bolt in a second withdrawn position that permits tilting of the sash.

Referring now to FIG. 12, the jamb component 1110 coupled with the frame 102 is again shown. In this example, the latch bolt 204 is withdrawn further into the latch mechanism 202. As shown, the latch bolt 204 is completely withdrawn inside the bottom sash 104, for instance the bottom check rail 112. By withdrawing the latch bolt 204 as shown in FIG. 12, the bottom sash 104 is in a position to facilitate tilting of the bottom sash 104, for instance out of the frame 102 to allow for cleaning of both sides of the glass pane 110 previously shown in FIG. 1.

As described herein the operation hardware assembly 200 provides a means to lock and unlock one or more of the sashes 104, 106 relative to the frame to allow the sashes to slidably move within the frame. Additionally another example is the operation hardware assembly 200 also allows for secure positioning of one or more of the sashes 104, 106 in a variety of position for instance a secure venting position where one or more of the latch bolts 204 are positioned within corresponding vent recesses. In yet another option the operation hardware assembly 200 allows for resetting of the latch bolts 204 into a projected configuration only interrupted by features, for instance, along jamb components, and the sash grooves 1110 such as a latch cover 1108 shown in FIG. 10. By resetting the latch bolts 204 the latch bolts are able to automatically lock one or more of sashes 104, 106 at a variety of positions including the closed position, secure vent positions, and the like. Similarly with further operation of the operation hardware assembly 200 in other examples the latch bolts 204 are even further withdrawn to allow for tilting of one or more of the sashes 104, 106 relative to the frame 102 to facilitate cleaning, maintenance and the like. The operation hardware assembly 200 thereby provides a centrally actuated operator 116 that provides one or more of locking, unlocking, automatically locking, retention of one or more of the sashes 104, 106 in desired positions within the frame 102 as well as tilting of one or more of the top and bottom sashes 106, 104 relative to the frame for maintenance, cleaning, and the like.

Figure 13A:
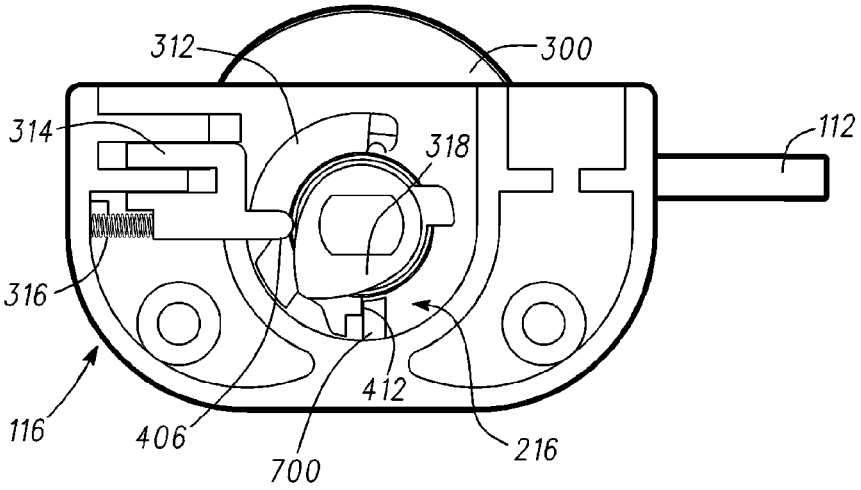
FIG. 13A is a bottom view of the operator shown in FIGS. 7, 8 with the operator interface feature in a locked position.

FIGS. 13A through 13E show various positions of the operator 116 during corresponding actuation of one or more of the latch bolts 204 of the latch mechanisms 202 described herein. Additionally in some examples where the operator 116 includes a sweep 300 provided on the handle 212 the operation hardware assembly 200 similarly actuates locking and unlocking of the top and bottom sashes 106, 104 for instance through engagement and disengagement of the sweep 300 from therebetween. Referring first to FIG. 13A, the handle 112 of the operator 116 is shown in a first locked position. As previously described the shank 302 of the handle 212 is non-rotatably coupled with cam fitting 318. The spool 312 is interposed between the cam fitting 318 and the handle 212. As previously described the spool opening 313 is circular thereby allowing for rotational movement of the spool 312 relative to the shank 302. In the example shown the spool stop 700 is engaged with the spool flange 412 of the spool 312 to substantially prevent unwinding of the actuator core 210 for instance by movement of the spool 312 in a counterclockwise direction. As shown, the detent 314 including for instance the detent projection 502 is positioned within one of the notches such as the first notch 406. The detent thereby provides a redundant locking mechanism to hold the spool 312 in place. In the configuration shown, the operator 116 correspondingly positions the latch bolts 204 within one or more of corresponding recesses within the jamb components of the frame 102. Opposition within such recesses the latch bolts 204 operated by the operator 116 substantially lock one or more of the sashes 104, 106 relative to the frame 102. In an example where the sash bolts 204 are positioned within grooves as opposed to the recesses previously described for the jamb components the engagement of the sweep 300 with a corresponding keeper on an opposed sash thereby locks the sashes in place.

Figure 13B:
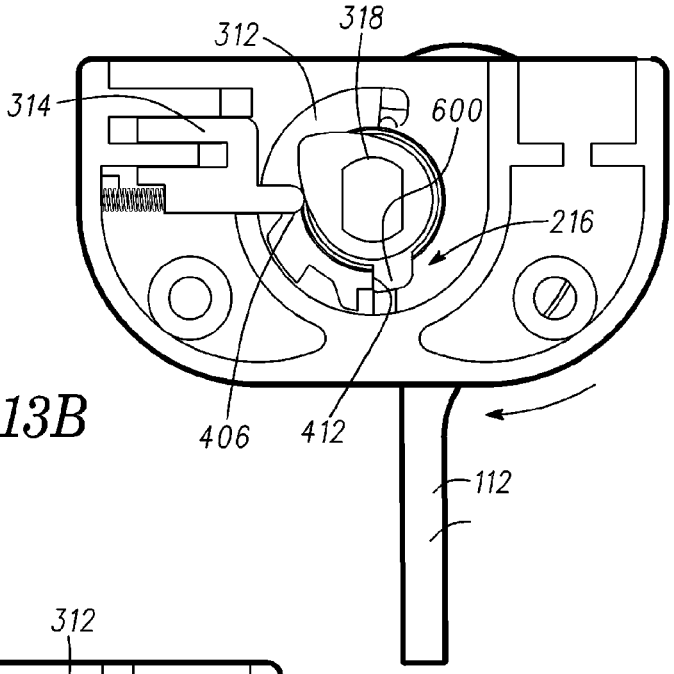
FIG. 13B is a bottom view of the operator shown in FIGS. 7, 8 with the operator interface feature in a first operating position.

Referring now to FIG. 13B, the handle 112 is shown in a transitional position. As shown, the cam fitting 318 is rotated with the handle 112. Spool engagement boss 600 has just engaged the spool flange 412 of the spindle 312. At any point after this engagement, continued rotation of the handle 112 will correspondingly rotate the spool 312 with the cam fitting 318 and the handle. As shown, the detent 314 is still positioned within the first notch 406. In this orientation, the sweep 300 is disengaged from a corresponding keeper on an opposed sash. In this example, with the one or more latch bolts 204 positioned within a groove as described herein, the operation of the rotatable handle 112 into the orientation shown frees the sash such as the bottom sash 104 to move freely relative to the frame 102 until it reaches a recess (if a recess is present).

Figure 13C:
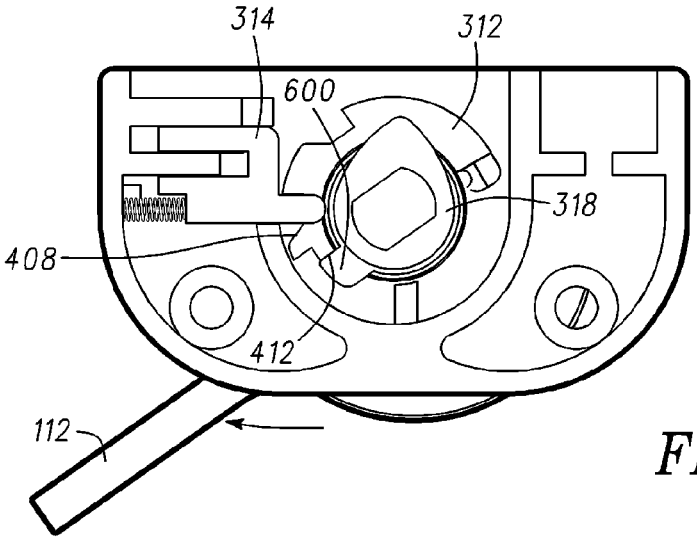
FIG. 13C is a bottom view of the operator shown in FIGS. 7, 8 with the operator interface feature in a second operating position and the spool is rotated with the detent in a second detent recess.

Referring now to FIG. 13C, the rotatable handle 112 continues its rotation in a clockwise fashion. The engagement between the spool engagement boss 600 and the spool flange 412 is maintained and rotation of the handle 112 is correspondingly transmitted to the spool 312. The spool 312 rotates in a clockwise fashion with the handle 112. As shown for instance in FIG. 13C the detent, such as the detent projection 502 is position within the second notch 408. Positioning of the detent within the second notch 408 substantially locks the spool 312 in the position shown and correspondingly moves the latch bolts into the withdrawn positions such as the withdrawn position shown in FIG. 9. In this configuration if the operator lets go of the rotatable handle 112 the detent 314 continues to hold the spool 312 in this orientation and correspondingly locks the latch bolts 204 in the partially withdrawn configuration to allow for sliding movement of the sash such as the bottom sash 104 or top sash 106 relative to the frame 102.

Figure 13D:
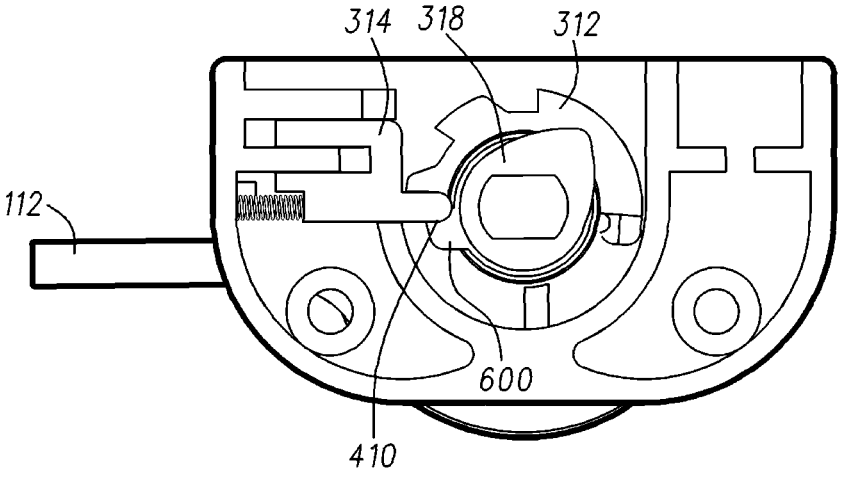
FIG. 13D is a bottom view of the operator shown in FIGS. 7, 8 with the operator interface feature in a third operating position and the spool is further rotated with the detent in the third detent recess.

As shown in FIG. 13D, the rotatable handle 112 is rotated again relative to the orientation shown in FIG. 13C. For instance the rotatable handle 112 is moved approximately 180 degrees relative to the original locked configuration shown in FIG. 13A. In this configuration, as with that configuration shown in FIG. 13C, engagement is maintained between the spool engagement boss 600 and the spool flange 412. (The spool flange 401 is positioned below the detent projection 502 of the detent 314.) As shown the detent projection 502 of the detent 314 is positioned within the third notch 410 to lock the spool 312 in the orientation shown. With this locked configuration the latch bolts 204 are now withdrawn into a position such as that shown in FIG. 12 where the latch bolts 204 are substantially withdrawn out of any grooves within the frame 102 to thereby allow tilting of the sash such as the bottom sash 104 relative to the frame 102. In this tilt mode the sash is thereby able to be removed, maintained or cleaned, for instance including cleaning of both sides of the glass pane 110 shown in FIG. 1.

Figure 13E:
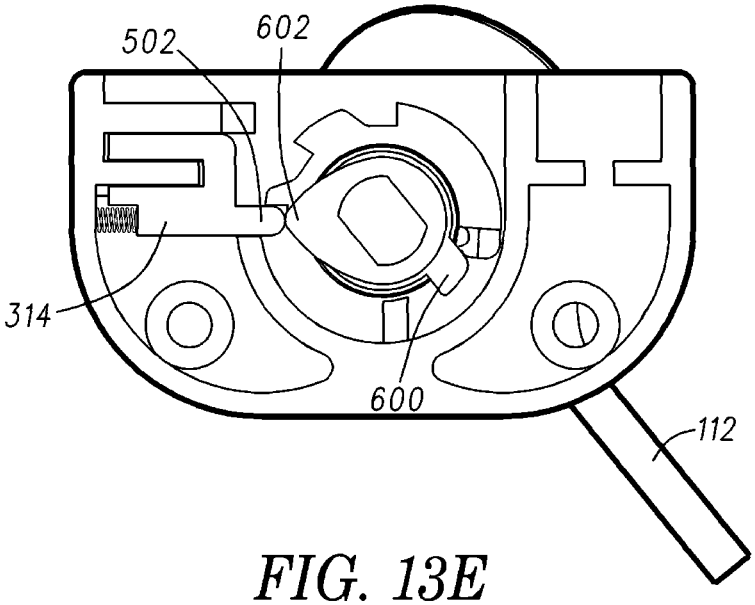
FIG. 13E is a bottom view of the operator shown in FIGS. 7, 8 with the operator interface feature rotated in an opposed direction, and a resetting cam is engaged with the detent.

Referring now to FIG. 13E, when resetting of the locking mechanism such as the operation hardware assembly 200 is desired the rotatable handle 112 of the operator 116 is rotated in a counterclockwise fashion as shown in FIG. 13E. As previously described the cam fitting 318 is non-rotatably coupled with the shank 302 of the handle 112. By moving the handle 112 in a counterclockwise fashion, the spool 312 is maintained in the position shown in FIG. 13D until the reset cam 602 engages and moves the detent projection 502 out of engagement with the engaging surface 416 of the third notch 410 (see FIG. 4). Upon engagement and movement of the detent projection 502 by the reset cam 602 the spool 312 experiences a rotational force in a counterclockwise fashion according to the tension provided in the actuator cord 210 provided by the bias latch bolts 204 as shown in FIGS. 2A and 2B. For instance in one example as previously described and shown in FIG. 9, the latch mechanisms 202 include a latch bolt biasing element sized and shaped to bias the latch bolts 204 outwardly relative to the sash 104. The outward bias correspondingly pulls on the actuator cord 210 and thereby unwinds the spool 312 from the position shown in FIG. 13E to substantially reset the spool into the orientation shown in FIG. 13A. Over rotation of the spool 312 is substantially prevented by the engagement of the spool flange 412 with the spool stops 700 as shown in FIG. 13A.

Figure 14:
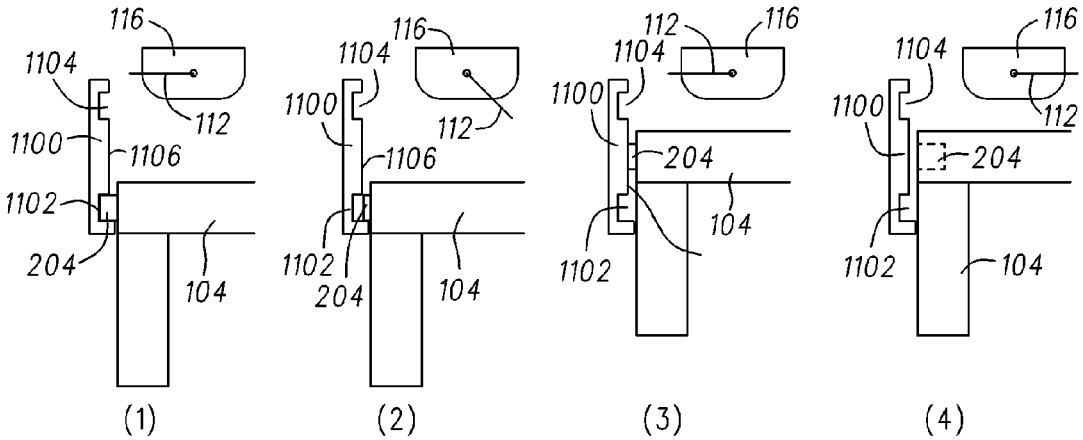
FIG. 14 is a schematic series of views depicting the position of a latch bolt according to remote operation of the operator with a jamb component as shown in FIG. 11B.

FIG. 14 shows a series of views of one example of a fenestration assembly including an operation hardware assembly such as the assembly 200 previously shown and described in FIGS. 2A and 2B. For instance, the operation hardware assembly 200 includes an operator 116 including the rotatable handle 112 in one or more latch bolts 204 as part of one or more latch mechanisms 202 at opposed ends of the sash such as the bottom sash 104. In an example shown in FIG. 14, the latch bolts 204 configured for reception within recesses such as a locking recess 1102 and a vent recess 1104. As previously described herein, in one example, the jamb component 1100 includes the interposing surface 1106 between each of the recesses 1102, 1104. The view shown in FIG. 14 provides one set of permutations the bottom sash 104 may move through according to the combination of the operation hardware assembly 200 with a specified jamb component 1100. As described herein, the jamb component 1100 when paired with the operation hardware assembly 200 allows for automatic locking in the closed configuration of the bottom sash 104 as well as a secure vent configuration when the bottom sash 104 is positioned in an elevated position but is otherwise locked in place to substantially prevent further upward movement of the sash 104 to thereby substantially prevent unintended egress, for instance, by a child or entry by an individual from the exterior of the fenestration assembly. Referring first to view 1 in FIG. 14, the operator 116 including the rotatable handle 112 is shown in a locked configuration as previously described herein in this configuration rotatable handle 112 is disengaged from the spool such as the spool 312 shown in FIG. 3. The latch bolt 204 is positioned within a locking recess 1102 in this configuration the bottom sash 104 is immobilized and thereby prevented from moving upwardly the bottom sash 104 is thereby securely locked through engagement between the bottom sash 104 and the jamb component 1100 coupled with the frame. In such an example, coupling between the bottom sash 104 and, for instance, the top sash 106 shown in FIG. 1 is not necessary, however, in another example the rotatable handle 112 includes a sweep 300 as previously described herein to provide a redundant or supplemental locking system allowing the sweep 300 to be received within a keeper, for instance, positioned on the top sash 106.

Referring now to view 2 within FIG. 14 the rotatable handle 112 is moved into the position shown wherein the handle 112 is pointing substantially downwardly or past vertical approximately 45° in this orientation the latch bolt 204 is partially withdrawn relative to the jamb component 1100. As shown in this configuration with the latch bolt 204 withdrawn the bottom sash 104 is free to move relative to the jamb component 1100 as well as the frame 102. As previously described and shown herein this example, for instance, with the operator 116 including the operator mechanism 216 the detent such as the detent 314 shown in FIG. 3 is engaged with the spool 312 to substantially hold the spool and the actuator cord 210 coupled with the spool in the desired orientation such as the partially withdrawn orientation shown in FIG. 4. For instance, the detent projection 502 shown in FIG. 5 is positioned within the second notch 408 of the spool 312.

Referring now to view 3, the operator 116 is shown in a reset configuration with the rotatable handle 112 repositioned at the original orientation shown in view 1. This orientation the cam fitting 318 non-rotatably coupled with the shank 302 of the rotatable handle 112 has been rotated into engagement with the detent projection 502. Engagement with the detent projection 502 moves the detent projection out of positioning within the notch such as the second notch 408 shown in FIG. 4 and allows the spool 312 to rotate and thereby allow the latch bolts 204 to extend relative to the sash 104. While the bottom sash 104 is moved out of the locking recess 1102 and vent recess 1104 the projection of the latch bolts 204 is interrupted by the interposing surface 1106. The latch bolt 204 and the bottom sash 104 are thereafter able to freely move over the interposing surface 1106 until the latch bolt 204 falls into one of the locking recess 1102 or the vent recess 1104. In the option where the latch bolt 204 falls into the locking recess 1102 the bottom sash 104 is thereby automatically locked in the closed position. In another option where the bottom sash is elevated relative to the position shown in FIG. 3 the latch bolt 204 falls into the vent recess 1104 thereby automatically immobilizing the bottom sash 104 and the secure venting orientation wherein the bottom sash 104 is incapable of further upward or downward movement because of the positioning of the latch bolt 204 within the vent recess 1104. With additional rotation of the handle 112 the spool 312 may again be engaged, for instance, by the cam fitting 318 to withdraw the latch bolt 204 from one of the locking recess 1102 and the vent recess 1104 to permit movement of the bottom sash 104.

Referring now to view 4 of FIG. 14, the latch bolt 204 (shown in phantom lines) is fully withdrawn relative to the jamb component 1100. In this configuration, the operator 116 including the rotatable handle 112 is correspondingly positioned in opposed configuration to that shown in view 1. For instance, the rotatable handle 112 is moved approximately 180° relative to the position shown in view 1. In this configuration, in one example, a detent projection 502 of the detent 314 is positioned within the third notch 410 shown in FIG. 4. In this configuration, the spool 312 is held in place to correspondingly fully withdraw the latch bolts 204 into the sash 104 and thereby allow tilting of the bottom sash relative to the frame 102. As with view 3, where resetting of the latch bolt 204 into the projected configuration as desired the operator rotates the handle 112 into the original position shown in view 1 to release the spool 312 and thereby allow the latch bolts 204 to project away from the bottom sash 104.

Figure 15:
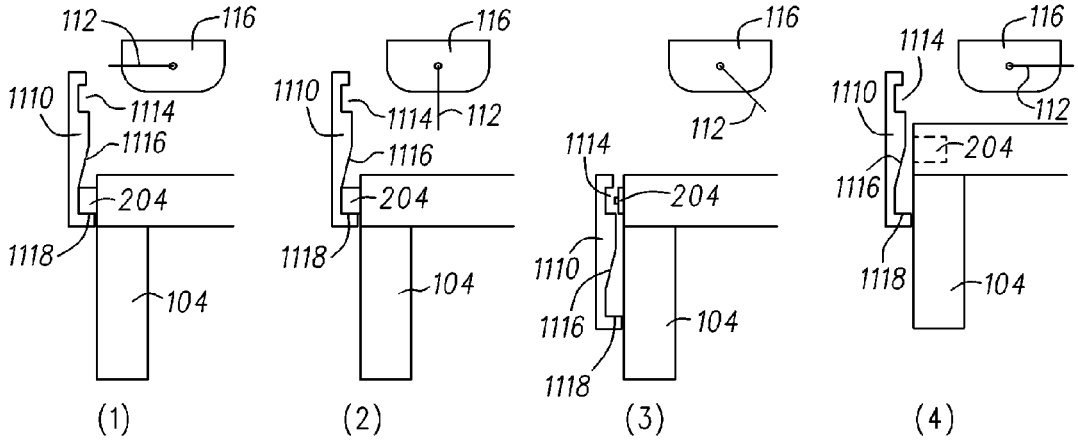
FIG. 15 is a schematic series of views depicting the position of a latch bolt according to remote operation of the operator with a jamb component as shown in FIG. 11C.

FIG. 15 shows another series of views of a bottom sash 104 move through a variety of positions according to operation of the operation hardware assembly 200 and another variation of a jamb component such as the jamb component 1110 previously shown and described in FIGS. 11C and 11D. Referring first to view 1, the latch bolt 204 is shown in a fully projected configuration wherein the latch bolt 204 is positioned adjacent to an engaging surface 1118 of the jamb component 1110. In this configuration the rotatable handle 112 is positioned in a locked orientation with the operator 116. Because the engagement surface 1118 does not provide a locking recess (see the vent ramp 1116) the rotatable handle 112 is provided with a sweep 300 sized and shaped for engagement with a corresponding keeper, for instance, provided on the top sash 106. In the configuration shown in view 1, then the bottom sash 104 is locked in place, for instance, through the engagement of the sweep with the keeper.

Referring now to view 2, the rotatable handle 112 is shown in a moved position relative to that shown in view 1. For instance, the rotatable handle 112 is rotated approximately 90° to move the sweep 300 out of engagement with the keeper to thereby allow movement of the sash 104 upwardly relative to the engagement surface 1118. For instance, in the configuration shown in FIG. 2 the sash bolt 204 is gradually pushed into the bottom sash 104 (e.g., it is deflected inwardly) according to engagement with the vent ramp 1116. Upon movement of the latch bolt 204 across the vent ramp 1116 and into the vent recess 1114 the latch bolt 204 projects outwardly into the vent recess 1114 to thereby hold the bottom sash 104 in an elevated configuration, for instance, 4 inches above the bottom of the frame 102. In this manner, the operation hardware assembly 200 including the latch bolts 204 as well as the operator 116 provides a window opening control device that substantially prevents movement of the bottom sash 104 once positioned in a moderately elevated position, for instance, 4 inches above the frame bottom. In yet another example, the operation hardware assembly 200 including the operator 116 includes a second operating requirement (e.g., a second motion) to provide a redundant method to control locking and unlocking of a sash.

Referring now to view 3, the rotatable handle 112 is further rotated to correspondingly move the cam fitting 318 into engagement with the spool 312 and thereby rotate the spool as previously described herein. Rotation of the spool 312 allows for insertion of the detent projection 502 into one or more of the notches such as the second notch 408 shown in FIG. 4. In this configuration with the detent projection within the second notch 408 the spool 312 is substantially prevented from rotating in a counter fashion. With the spool 312 as shown in the configuration provided for instance in FIG. 13C the latch bolt 204 is partially withdrawn into the bottom sash 104. The bottom sash 104 is thereby able to move relative to the vent recess 1114 without becoming locked therein. In this manner the bottom sash 104 is free to move upwardly or downwardly relative to the jamb component 1110 until the sash bolt 204 engages with the engagement surface 1118 of the jamb component 1110.

Referring now to view 4 of FIG. 15, the rotatable handle 112 is shown rotated into an opposed configuration relative to that shown in view 1. In this configuration, the operator 116, for instance, the spool 312 is further rotated relative to the detent projection 502 in the detent projection is positioned within the third notch 410 as shown in FIG. 13D. In this configuration, the latch bolts 204 (shown in phantom lines) are fully withdrawn into the bottom sash 104 thereby facilitating the tilting of the bottom sash 104, for instance, for maintenance, cleaning of the glass panes 110 and the like.

As will be apparent from the permutations provided by FIGS. 14 and 15 as well as the jamb components provided herein the selection of jamb component when married with the operation hardware assembly 200 described herein provides for a variety of functionality for a fenestration assembly 100. Stated another way fenestration assembly including top and bottom sashes 106, 104 as well as a frame 102 when including the installed jamb components as desired as well as the operation hardware assembly 200 is able to provide one or more of automatic locking, secure venting, window opening control device type function, tilting of the sashes and the like all within a single system including the operation hardware assembly 200 as well as the corresponding jamb components.

Figure 16A:
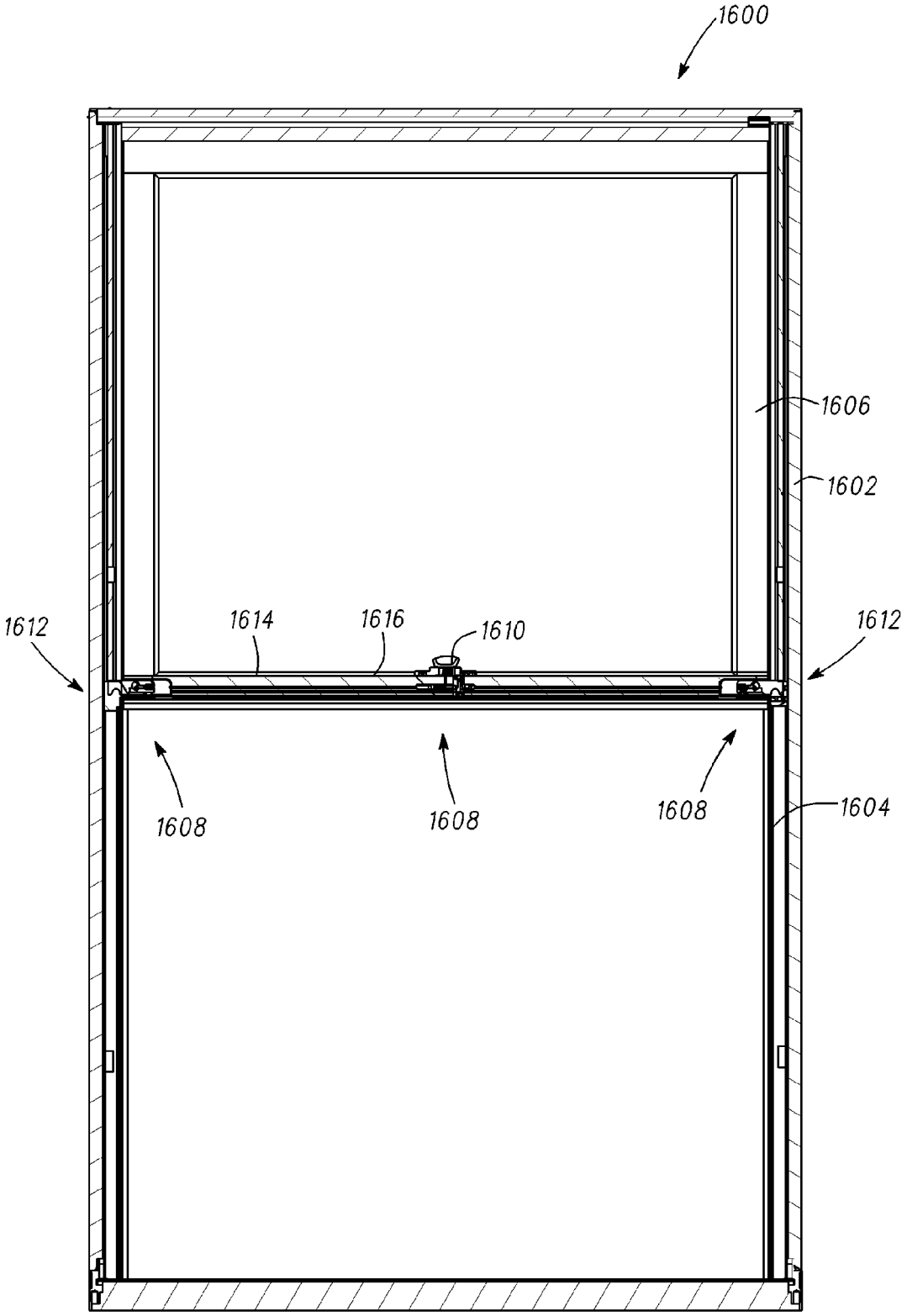
FIG. 16A is a cross sectional view of the fenestration assembly shown in FIG. 1 including another example of an operation hardware assembly installed within the sash.
Figure 16B:
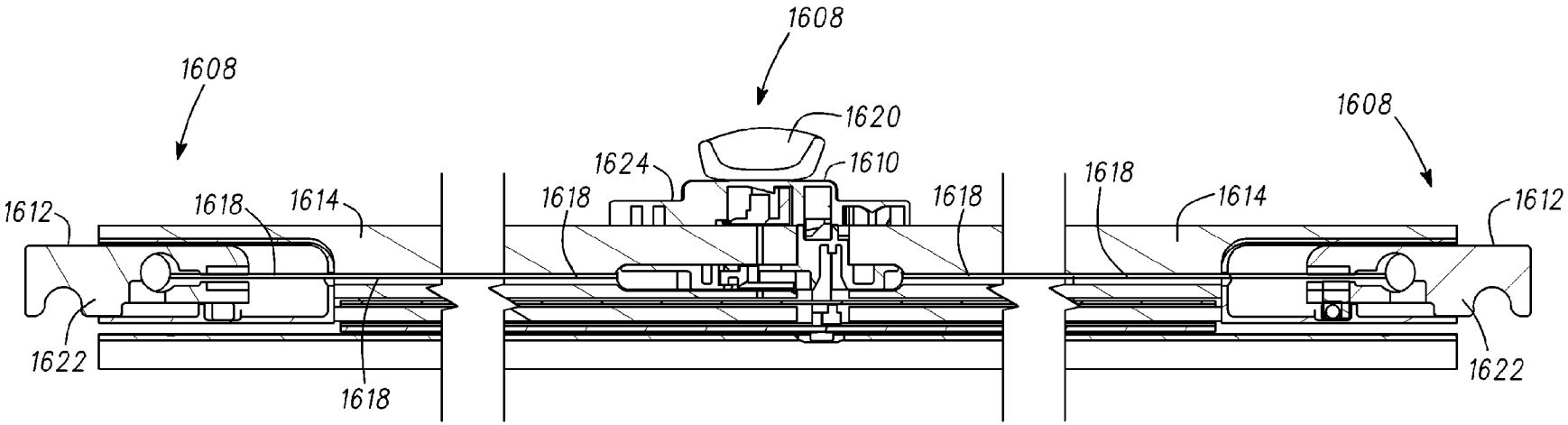
FIG. 16B is a detailed cross sectional view of the sash used with the fenestration assembly including the operation hardware assembly shown in FIG. 16A.

FIGS. 16A and 16B show two examples of a fenestration assembly 1600. FIG. 16B shows a portion of the fenestration assembly, for instance, a bottom check rail 1614 including a fenestration operation hardware assembly 1608 therein. Referring first to FIG. 16A, the fenestration assembly 1600 is shown with a frame 1602 and bottom and top sashes 1604, 1606 slidably positioned within the frame 1602. As shown in FIG. 16A, each of the bottom and top sashes 1604, 1606 include corresponding bottom and top check rails 1614, 1616. In the view shown in FIG. 16A, the bottom check rail 1614 is in front of the top check rail 1616. Stated another way, in the front view shown in FIG. 16A the bottom check rail 1614 and the top check rail 1616 (while the sashes are in the closed position) are coincident with one another.

FIG. 16A further shows another example a of fenestration operation hardware assembly 1608. In one example, the fenestration operation hardware assembly 1608 includes an operator 1610 mounted on the bottom check rail 1614. For instance, as shown in FIG. 16A the operator 1610 is installed within a portion of the bottom check rail 1614. The fenestration operation hardware assembly 1608 further includes one or more latch mechanisms 1612 positioned on either side of the bottom check rail 1614 and remote relative to the operator 1610. As will be described herein, the operator 1610 is operable to move each of the latch mechanisms 1612, for instance latch bolts associated with each of the latch mechanisms to allow for sliding movement of at least the bottom sash 1604 (and optionally the top sash 1606) relative to the frame 1602. In another example, the fenestration operation hardware assembly 1608 including, for instance, the operator 1610 is operable to further operate the latch mechanism 1612 and facilitate tilting of at least the bottom sash 1604 as described herein.

Referring now to FIG. 16B, a detailed cross-sectional view of the bottom check rail 1614 previously shown in FIG.

16A is provided. As shown, the fenestration operation hardware assembly 1608 is distributed along the bottom check rail 1614 with the latch mechanisms 1612 positioned at either end of the bottom check rail 1614 and the operator 1610 positioned substantially centrally within the bottom check rail 1614.

As shown in FIG. 16B, the operator 1610 includes an operator interface feature 1620. In one example, the operator interface feature 1620 includes, but is not limited to, a handle, slide mechanism, finger pull or the like. As shown in FIG. 16B, the operator interface feature 1620 is coupled with an operator housing 1624. In one example, the operator housing 1624 houses the mechanism of the operator 1610 therein and further provides for rotatable coupling of the operator interface feature 1620.

Referring again to FIG. 16B, as previously described, the latch mechanisms 1612 are positioned at either end of the bottom check rail 1614. In the example shown in FIG. 16B, each of the latch mechanisms 1612 includes at least one latch bolt 1622 (e.g., a bottom latch bolt). The latch bolts 1622 are operated, for instance, by pulling on a flexible element such as a tying element 1618 extending between each of the latch bolts 1622 and the operator 1610. As will be described herein, rotation or movement of the operator interface feature 1620 is operable to move the tying element 1618 and accordingly move the latch bolt 1622. For instance, rotation of an operator interface feature 1620 such as a handle is configured to pull the tying element 1618 inwardly (toward the operator 1610) and thereby accordingly withdraw the latch bolt 1622 from the initial projecting position shown in FIG. 16B to one or more withdrawn operating positions that facilitate one or more of sliding of the bottom and top sashes 1604, 1606 for opening and closing of the sashes or tilting of the bottom sash 1604 relative to the frame 1602.

Figure 17A:
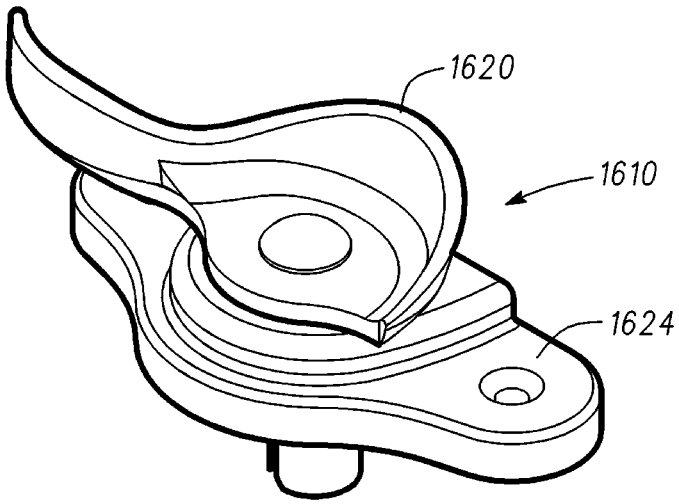
FIG. 17A is a perspective top view of an operator of the operation hardware assembly of FIG. 16A.

FIG. 17A shows the operator 1610 in a perspective view. As shown, the operator interface feature 1620 in this example is a handle rotatably coupled to the operator housing 1622. As will be described herein, the operator housing 1624 in one example houses at least a portion of the mechanism that moves each of the latch mechanisms 1612 including the latch bolts 1622 as well as a retention assembly configured to retain the operator interface feature 1620 in an operating position. For instance, a position configured to retain the latch bolts 1622 in at least a partially withdrawn position to allow for sliding of the bottom sash 1604 (and optionally the top sash 1606).

Figure 17B:
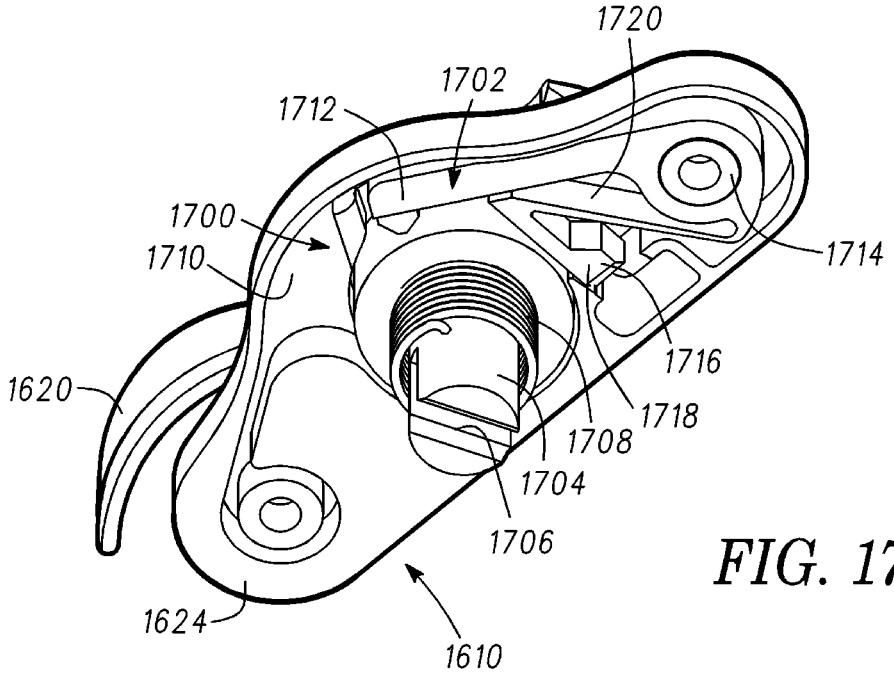
FIG. 17B is a perspective bottom view of the operator.

FIG. 17B shows another view of the operator 1610 previously shown in FIGS. 16A, B. In this bottom view the operator mechanism 1700 configured to operate the latch mechanisms 1612 is shown. As shown in FIG. 17B, the operator mechanism 1700 in one example includes a spool 1704 (e.g., a first spool with a corresponding first diameter). The first spool 1704 in one example includes a tying element recess 1706 sized and shaped to receive the tying element 1618 therein. Rotation of the operator interface features 1620 (e.g., a handle) correspondingly rotates the first spool 1704 and accordingly wraps at least a portion of the tying element 1618 around the first spool 1704. Wrapping of the tying element 1618 around the first spool correspondingly withdraws the latch bolt 1622 to unlock the bottom and top sashes 1604, 1606 and facilitate their movement.

In another example, the operator mechanism 1700 further includes a retention assembly 1702 configured to hold the operator interface feature in an operating position, and a release assembly 1716 configured to release the retaining features of the retention assembly 1702. Referring first to the retention assembly 1702, the assembly includes one or more of a detent 1712 and a corresponding recess within the first spool 1704 (shown herein). In one example, the retention assembly 1702 including, for instance, a rotatable detent 1712 is housed within a mechanism recess 1710 of the operator housing 1624. For instance, in the example shown in FIG. 17B the detent 1712 is rotatably coupled at a pivot point 1714. As will be described further the detent 1712 is biased by a biasing element into engagement with a corresponding groove or recess of the first spool 1704. Reception of the detent 1712 within the recess of the first spool 1704 correspondingly locks or holds the operator interface feature 1620 in a desired position, for instance a first operating position corresponding to a withdrawal of the latch bolt 1622 to facilitate movement of at least the bottom sash 1604 (and optionally the top sash 1606 as described herein).

Referring again to FIG. 17B, the release assembly 1716 is also housed within the operator housing 1624. As shown the release assembly 1716 includes in one example a detent release element 1718 moveably positioned within the operator housing 1624. In one example, the detect release element 1718 is coupled with the detent 1712 for instance by a connecting arm 1720. In another example, the detent 1712 and the detent release element 1718 are separately positioned within the operator housing 1624. That is to say each of the detent release element 1718 and the detent 1712 are installed separately. In each of these examples, the detent release element 1718 and the detent 1712 are moveable separately relative to the other.

As will be described herein, the detent release element 1718 includes one or more features such as beveled faces configured for engagement with corresponding beveled faces of another portion of the release assembly 1716 including for instance a plunger. Movement of the plunger relative to the detent release element 1718 correspondingly biases the detect 1712 out of engagement with the first spool 1704 (e.g., a detent recess) to allow for rotation of the operator interface feature 1620 for instance automatic rotation of the operator interface feature 1620 and relocking of the latch bolt 1622 according to operation of a handle biasing element 1708. In one example, the handle biasing element 1708 is a torsion spring coupled between the first spool 1704 and a portion of the operator housing 1624. The handle biasing element 1708 configured to move the operator interface feature 1720 into a closed position, such as the initial position shown in FIG. 17A. In this manner the handle biasing element 1708 cooperates with corresponding biasing elements of the latch mechanism 1612 to bias each of the latch bolts 1622 into closed (or locking positions) wherein the latch bolts 1622 are received within corresponding recesses within the frame to hold one or both of the bottom and top sashes 1604, 1606 in place.

Referring again to the retention and release assemblies 1702, 1716, the retention assembly 1702 operates to hold the operator interface feature 1620 in an operating position and is thereby configured to retain the operator interface feature 1620 in the operating position despite bias provided by the handle biasing element 1708. Conversely, the release assembly 1716 is configured to disengage the detent 1712 from the first spool 1704 and allow the handle biasing element 1708 to bias the operator interface feature 1620 (as well as the tying element recess 1706 including the tying element 1618 therein) toward the initial position corresponding to locking of each of the latch bolts 1622 within the frame 1602 shown in FIG. 16A. Additionally, release of the operator interface feature allows each of the latch bolts 1622 to project outwardly as described herein. Accordingly, where bottom sash is positioned away from its closed position the latch bolts 1622 are released and able to slide within sash grooves (e.g., grooves 1010) and automatically relock when the sash is closed (e.g., project into lock recesses 1004).

FIGS. 17C1 and 17C2 show dual exploded views (from the top and bottom respectively) of the operator 1610 previously described and shown in FIGS. 17A, B. Referring first to FIG. 17C1, the operator 1610 is shown with the operator interface features 1620 exploded relative to the operator housing 1624. As will be described herein in further detail in one example the first spool 1704 includes a spindle recess 1730 sized and shaped to receive a corresponding spindle of the operator interface feature 1620. Rotation of the operator interface features 1620 accordingly rotates the first spool 1704 and wraps the tying element 1618 around the first spool 1704.

Referring again to FIG. 17C1, the operator mechanism 1700 in another example includes a detent biasing element 1722. For instance, the detent biasing element 1722 is in one example a leaf spring configured to bias the detent 1712 into engagement with the first spool 1704, for instance within a detent recess 1734 sized and shaped to receive the detent 1712 (e.g., a projecting portion of the detent 1712). In one example, the detent biasing element 1722 is coupled with the operator housing 1624 on an opposed side of the detent 1712 and is thereby accordingly configured to bias the detent 1712 toward the first spool 1704.

Referring now to FIG. 17C2 the spindle 1732 previously described with regard to FIG. 17C1 is shown from the bottom perspective of the operator interface feature 1620. As shown the spindle 1732 in one example includes a substantially hour glass shape sized and shaped for reception within a corresponding portion of the spindle recess 1730. In one example, the spindle recess 1730 includes corresponding features to the hour glass shape of the spindle 1732 that allow for the transmission of rotation from the operator interface features 1620 to the first spool 1704. In another example, the spindle 1732 is sized and shaped for movable reception within the spindle recess 1730. That is to say, the spindle recess 1730 includes a shape configured to allow at least some amount of relative rotation between the spindle 1732 and the first spool 1704. Relative rotation in one example is used to facilitate unseating of the detent 1712 from the detent recess 1734 as will be described herein.

Referring again to FIGS. 17C1 and 17C2, in one example, the operator mechanism 1700 further includes an operational stop assembly 1736 configured to cooperate with the operator interface features 1620 and provide an affirmative indication that the operator interface feature 1620 is fully positioned within the first operational position for instance corresponding to approximately 135 degrees where the latch bolts 1622 are at least partially withdrawn to facilitate opening of at least the bottom sash 1604 (as well as optionally the top sash 1606). In one example, the operational stop assembly 1736 includes a stop release 1724 extending through the operator interface feature 1620. In one example, the stop release 1724 is passed through a bar biasing element 1728 and seated and coupled with a stopping bar 1726. As shown in FIG. 17C1 the stopping bar 1726 is in one example received within the spindle recess 1730 of the first spool 1704.

Referring now to FIG. 17C2, the operational stop assembly 1736 further includes one or more ramped plateaus 1738 coupled with the operator housing 1624. The stopping bar 1726 is configured for sliding movement along the ramp plateaus 1738. As will be described in detail herein, in one example, the ramp plateaus 1738 include operator stops (e.g., stopping surfaces) sized and shaped to engage the stopping bar 1726 as the operator interface feature 1620 is rotated into the first operational position corresponding to withdrawal of the latch bolts 1622. For instance, the engagement of the stopping bar assembly 1726 with the corresponding operator stop provided by the ramp plateau 1738 arrests movement of the operator interface feature 1620 and provides an affirmative indication that the first operational position has been reached. In another example, the operational stop assembly 1736 is further operable for instance through depression of the stop release 1724 to allow for further movement of the operator interface feature 1620 for instance past the first operational position to a second operational position. In one example, the second operational position as described herein corresponds to a further withdrawn position of the latch bolts 1622, for instance, a tilting position of the latch bolt 1622. That is to say, with movement of the operator interface feature 1620 into a second operational mode corresponding to a tilting mode of the bottom sash 1604, the bottom sash 1604 is tiltable relative to the frame 1602.

Accordingly, the fenestration operation hardware assembly 1608 is accordingly operable with a single operator 1610 to allow for sliding movement of the bottom and top sashes 1604, 1606 within the frame 1602 as well as tilting movement of at least the bottom sash 1604 relative to the frame 1602. Accordingly, the functions of tilting as well as unlocking and slidable movement of the sashes 1604, 1606 are consolidated into a single operative hardware assembly 1608.

Figure 18A:
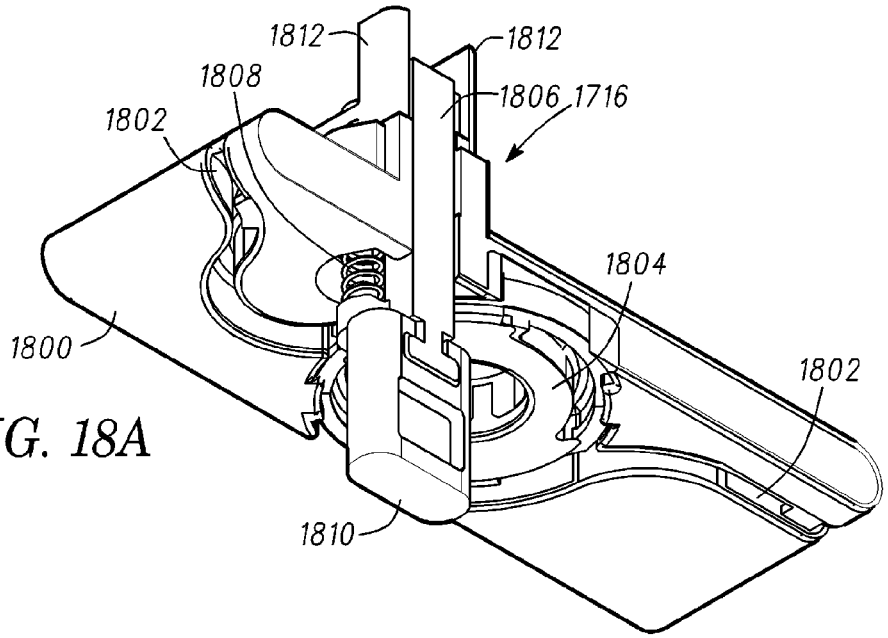
FIG. 18A is a perspective bottom view of one example of a second spool and a plunger assembly.
Figure 18B:
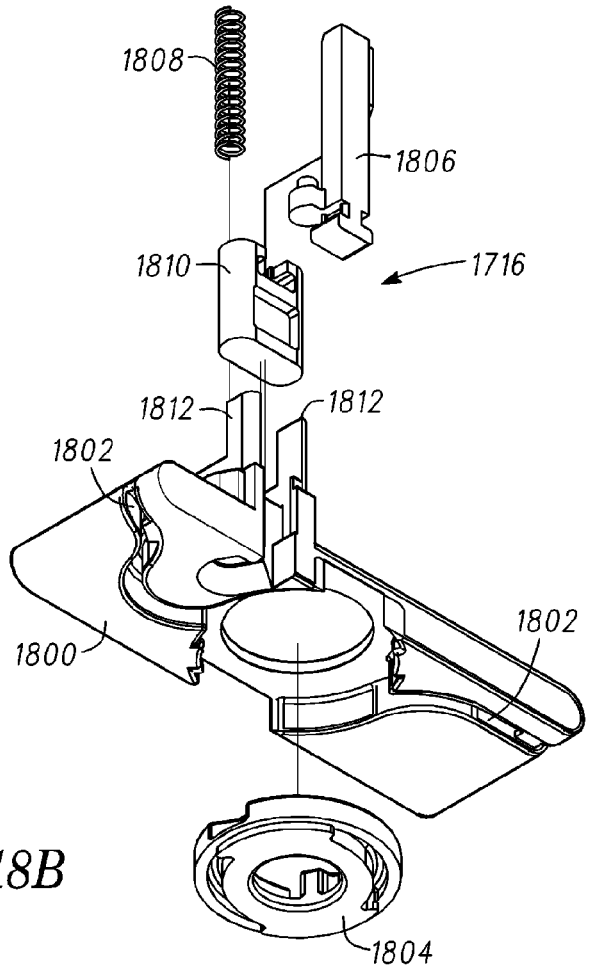
FIG. 18B is an exploded view of the second spool and the plunger assembly of FIG. 18A.

FIGS. 18A, 18B show one example of a cord flange 1800. As described herein, in one example the cord flange 1800 is an optional portion of the fenestration assembly 1600 configured to route the tying element 1618 to the spool such as the first spool 1704 and second spool 1804 (e.g., larger spool) described herein. Referring first to FIG. 18A, the cord flange 1800 is shown as including a cord groove 1802 configured to route the tying element 1618 to the spools 1704, 1804. In one example the cord groove 1802 provides a non-linear or curved route for the tying element 1618 through the cord flange 1800 to facilitate the delivery of the tying element to the first and second spools 1704, 1804.

Referring again to FIG. 18A, in one example a portion of the release assembly 1716 is optionally coupled with the cord flange 1800. For instance, a plunger 1806 as well as an optional plunger cap 1810 is shown slidably coupled with the cord flange 1800. In one example, a plunger biasing element 1808, for instance a compression spring, is coupled between the cord flange 1800 and a portion of the plunger 1806. The plunger biasing element 1808 correspondingly biases the plunger 1806 downwardly relative the cord flange 1800. As further shown in FIG. 18A, the opposed end of the plunger 1806 is in one example positioned within an installation fork 1812. In one example the installation fork 1812 is configured for coupling with a portion of the fenestration operation hardware assembly 1608, for instance, the operator housing 1624 previously described and shown in FIG. 16B.

Referring now to the FIG. 18B, the portions of the release assembly 1716 are shown in an exploded view. For instance, the plunger 1806 is shown decoupled from the plunger cap 1810. Additionally, the plunger biasing element 1808 is shown exploded relative to the plunger 1806 and the cord flange 1800. As further shown in FIG. 18B, the second spool 1804, for instance, a spool having a larger diameter or perimeter configured for wrapping the tying element 1618 there around is shown spaced from the cord flange 1800. As will be described herein, in one example the second spool and the first spool 1804, 1704 are coupled together. For instance, the first spool 1704 is received within the second spool 1804 to allow for relative rotation therebetween as well as binding engagement between the tying element 1618, the first spool 1704 and the second spool 1804 as described herein below.

As will be described herein, the plunger 1806 forms a portion of the release assembly 1716. Accordingly, the release assembly 1716 with the plunger 1806 is configured to selectively operate the detent release element 1718 with movement of the bottom sash 1604 for instance into a closed position. That is to say, the plunger 1806 (e.g., the optional plunger cap 1810) is sized and shaped to engage with a corresponding portion of the opposed top sash 1606. For instance, upon closing of the bottom sash 1604 the plunger 1806 (for instance the plunger cap 1810) engages with a portion of the top check rail 1616 to bias the plunger 1806 upwardly relative to the position shown in FIG. 18A. This biased movement of the plunger 1806 correspondingly translates the detent release element 1718 shown in FIG. 17B to push the detent 1712 out of engagement with the first spool 1704. The first spool 1704 is thereby automatically released allowing the operator interface features 1620 to rotate to the initial position (corresponding to locking of the latch bolt 1622). Accordingly, the latch bolts 1622 shown in FIG. 16B are released and allowed to return to the initial position shown in FIG. 16B corresponding to a locking position where the latch bolts 1622 are received within corresponding recesses (e.g., lock recess 1004) of the frame 1602.

As will be described in further detail below, in another example with movement of the top sash 1606, for instance from the closed position shown in FIG. 16A to an open position (prior to movement of the bottom sash 1604) the release assembly 1716 cooperates with the retention assembly 1702, for instance the detent 1712, to rotate the detent release element 1718 thereby avoiding translation of the detent release element 1718 and corresponding unseating of the detent 1712 from the corresponding detent recess 1734 shown in FIG. 17C1. That is to say, where the opening of both the top and bottom sashes 1606 and 1604 is desired, the top sash 1606 is moved first, and the release assembly 1716 is not operated in a fashion that releases the operator interface feature (and correspondingly, the latch bolts 1622 or the latch bolts of the top sash).

Figure 19:
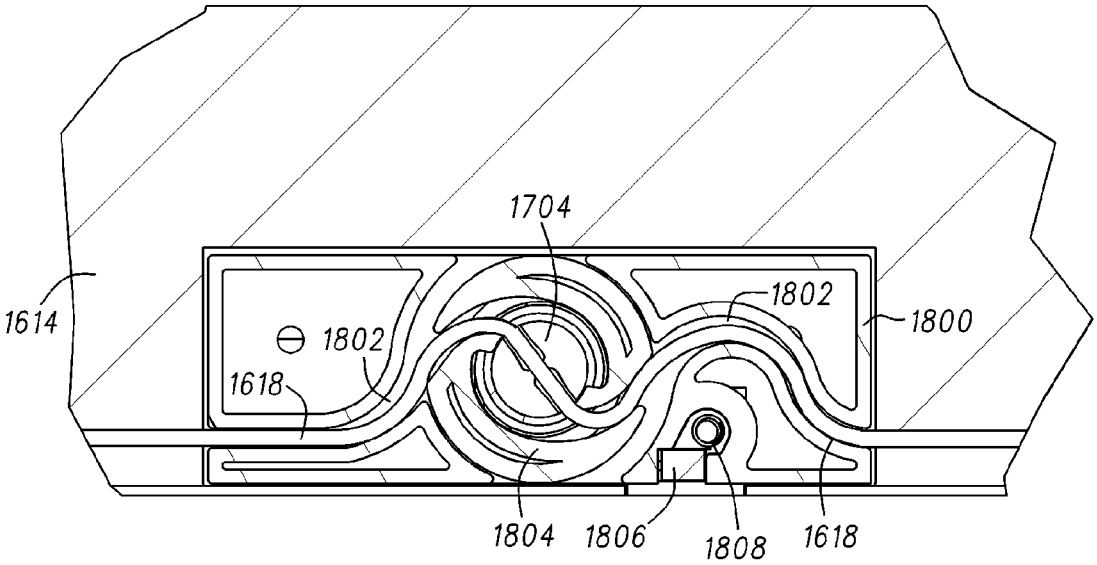
FIG. 19 is a bottom view of a tying element extending through first and second spools.

Referring now to FIG. 19, the cord flange 1800 is shown installed within the bottom check rail 1614, for instance in a position below the operator housing 1624 shown in FIG. 16B. As shown, the first spool 1704 is received within the second spool 1804. The tying element 1618 extends through the cord grooves 1802 to the second and first spools 1804, 1704. Rotation of each of the spools 1704, 1804 correspondingly wraps the tying element 1618 around one or both of the first and second spools 1704, 1804 and accordingly withdraws the latch bolts 1622 of the latch mechanisms 1612 as previously described herein.

As further shown in FIG. 19, the plunger 1806 is shown extends through the cord flange 1800 upwardly. The plunger biasing element 1808 is also shown installed within the check rail 1614, for instance coupled between the cord flange 1800 and a portion of the plunger 1806. In the example shown in FIG. 19, the plunger biasing element 1808 is shown with an optional offset installation with the plunger biasing element 1808 parallel to non-coincident with the plunger 1806.

Figure 20:
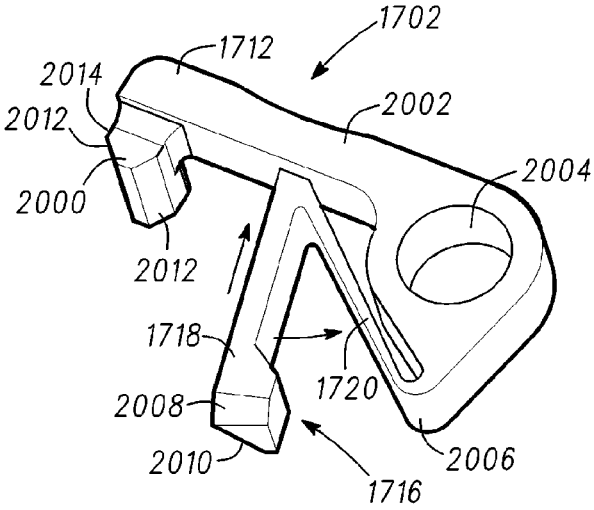
FIG. 20 is a perspective view of one example of one example of a detent and a detent release.

Referring now to FIG. 20, one example of the detent 1712 and detent release element 1718 are shown. As previously described, the detent 1712 and the detent release element 1718 are in one example formed as a composite part configured for coupling within the operator housing 1620 (FIG. 17B). Referring first to the detent 1712, detent 1712 in one example includes a plurality of faces for instance one or more detent beveled faces 2012 and one or more detent engagement surfaces 2014. As will be described herein, the detent engagement surfaces 2014 are sized and shaped for reception within the detent recess of the first spool 1704. Reception of the detent 1712 within the detent recess 1734 holds the first spool 1704 in place and thereby accordingly holds the latch bolts 1622 previously shown in FIG. 16B in a withdrawn position for instance in the operational position allowing sliding movement in one or more of the bottom and top sashes 1604, 1606. In another example, the detent beveled faces 2012 cooperate with corresponding features of the first spool 1704 (as described herein) to facilitate the biasing of the detent 1712 out of the detent recess 1734 to allow for rotation of the first spool 1704 as well as the operator interface feature 1620. As has been described herein release of the first spool 1704 allows for the latch bolts 1622 of the latch mechanism 1612 to return to their projecting position to accordingly lock or facilitate locking of at least the bottom sash 1604 with the frame 1602.

As shown in FIG. 20, the detent 1712 in one example includes a detent arm 2002 extending from a pivot recess 2004. Referring again to FIG. 17B, the detent 1712 is shown rotatably coupled with the pivot point 1714 of the operator housing 1624. The pivot recess 2004 facilitates the reception of the pivot point 1714 therein and accordingly allows for rotation of the detent 1712 relative to the remainder of the operator mechanism 1700 including the first spool 1704.

Referring again to FIG. 20, the detent release element 1718 is shown in this example coupled with the detent 1712, for instance by the connecting arm 1720. In one example, the connecting arm 1720 is coupled with the remainder of the detent 1712 for instance by a release biasing element 2006 corresponding in at least some regards to a leaf spring. The release biasing element 2006 cooperates with the remainder of the detent 1712 for instance that portion of the detent coupled with the pivot recess to bias the detent release element 1718 into a configuration as it is shown in FIG. 20. Accordingly, translation (e.g., toward the detent 1712) and rotation of the detent release element 1718 for instance toward the pivot recess 2004 is opposed by the bias provided by the release biasing element 2006. As previously described, in another example, the detent release element 1718 is formed as a separate element relative to the detent 1712. In this embodiment, the detent release element 1718 includes the connecting arm 1720. The connecting arm 1720 is in this fashion not coupled with the remainder of the detent 1712. Instead, the connecting arm 1720 is engaged against a feature of the operator housing 1624 for instance against a portion of the detent 1712 to thereby apply the bias (translationally and rotationally) to the detent release element 1718.

Figure 21:
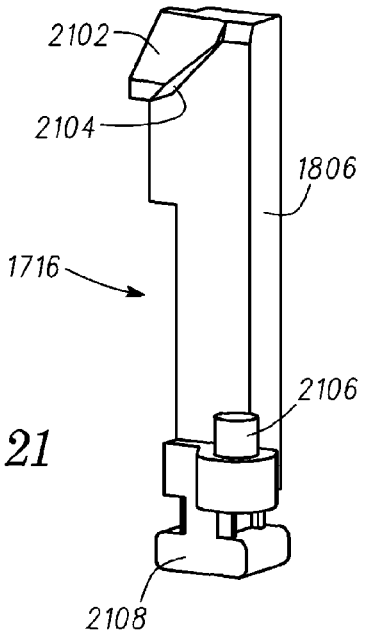
FIG. 21 is a perspective view of one example of a plunger.

The plunger 1806 previously described in some regards with regard to the detent release element 1718 shown in FIG. 20 is shown in FIG. 21. As shown the plunger 1806 is part of the release assembly 1716 as is the detent release element 1718 previously shown in FIG. 20. The plunger 1806 includes an optional plunger cap fitting 2108 sized and shaped to receive the plunger cap 1810 previously shown in FIG. 18A thereon. Additionally, in another example, the plunger 1806 includes a plunger biasing element pin 2106 sized and shaped to receive an end of the plunger biasing element 1808 shown in FIG. 18A coupled between the cord flange 1800 and the plunger 1806. As described above, the bias provided by the plunger biasing element 1808 biases the plunger 1806 into a lowered configuration wherein the plunger 1806 is biased away from the remainder of the operator mechanism 1700 including for instance the detent release element 1718. Engagement of the plunger cap 1810 (e.g., biasing of the plunger cap through engagement of the bottom and top check rails 1614, 1616) biases the plunger 1806 upwardly and accordingly moves one or more of the faces of the plunger across the corresponding faces of the detent release element 1718 to release the operator first spool and the latch bolts 1622 as described herein.

Referring now to the faces of the plunger 1806, the plunger includes a plunger axial face 2102 having a beveled or tapered configuration as well as a plunger lateral face 2104 also having a beveled (or tapered) configuration. Each of the plunger axial face 2102 and the plunger lateral face 2104 face in differing directions and are sized and shaped to engage with the corresponding axial and lateral faces 2008, 2010 of the detent release element 1718. For instance, with closing movement of the bottom sash relative to the top sash (or closing movement of the top sash relative to the bottom sash) the plunger 1806 is biased upwardly past the detent release element 1718. In one example, as the bottom sash 1604 is closed the plunger cap 1810 shown in FIG. 18A engages with the corresponding portion of the top check rail 1616 and is depressed. The upward movement causes the plunger axial face 2102 to engage with the corresponding release axial face 2008 and accordingly biases the detent release element 1718 along the axial arrow shown in FIG. 20 to correspondingly move (e.g., rotate) the detent arm 2002 as well as the detent head 2000. The detent head 2000 including the detent engagement surface 2014 is thereby unseated from the detent recess 1734 of the first spool 1704. Accordingly the first spool 1704, the remainder of the operator interface feature 1620 and the tying element 1618 tensioning the latch bolt 1622 are released to facilitate automatic locking of the bottom and sashes 1604, 106.

Conversely, downward opening movement of the top sash 1606 (or upward opening movement of the bottom sash 1604) allows the plunger 1806 to project downward relative to the cord flange 1800 shown in FIG. 18A as well as the detent release element 1718 shown in FIG. 20. The detent release element 1718 and the detent 1712 are shown in the bottom side up configuration. The right side up configuration for these features is better shown in FIG. 17B installed within the operator mechanism 1700). The downward movement of the top sash 1606 (or upward movement of the bottom sash 1604) allows the plunger 1806 to correspondingly move downward while the plunger lateral face 2104 slides over the corresponding release lateral face 2010 of the detent release element 1718 to accordingly rotate the release element 1718 along the arcuate arrow shown in FIG. 20. The detent release element 1718 is rotated without substantial translation and does not move the detent 1702 to unseat the detent from the detent recess 1734. Accordingly, the detent 1712 remains seated within the first spool 1704.

With this arrangement of axial and lateral faces between the plunger 1806 and the detent release element 1718 the release assembly 1716 is able to cooperate with the retention assembly 1702 to thereby ensure automatic locking of the fenestration operation hardware assembly 1608 with closing of both of the sashes 1606, 1604 and is further able to maintain the latch bolts 1622 in a partially withdrawn first operating position with opening of the top sash relative to the bottom sash 1604 (or opening of the bottom sash 1604).

Figure 22:
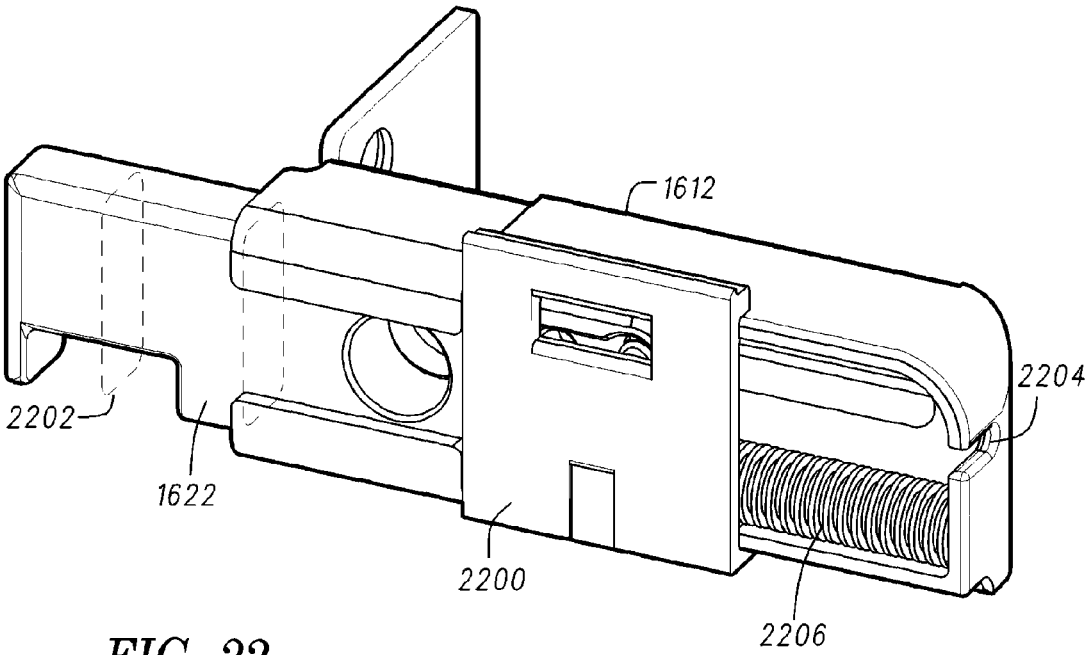
FIG. 22 is a perspective view of another example of a bottom latch mechanism.

Referring now to FIG. 22, one example of the latch mechanism 1612 previously shown in FIGS. 16A and 16B is provided. In the example shown in FIG. 22 the latch mechanism 1612 corresponds to a bottom latch mechanism sized and shaped to lock and facilitate the movement of the bottom sash 1604 shown in FIGS. 16A and 16B. The latch mechanism 1612 shown in FIG. 22 includes a latch bolt 1622 (e.g., a bottom latch bolt) slidably received within a bottom latch bolt housing 2200. In one example, the bottom latch bolt housing 2200 (and the latch bolt 1622) is constructed with, but not limited to, metal, plastic or other materials having sufficient strength and durability for installation within the bottom check rail 1614 to facilitate the repeated translation of the latch bolts 1622, and maintenance of the projecting (locked) configuration of the latch bolts 1622.

The latch mechanism 1612 further includes a latch biasing element 2206 extending between the bottom latch housing 2200 and a portion of the latch bolt 1622. The latch biasing element 2206 is configured to bias the latch bolt 1622 into a projecting position, for instance, where the latch bolt 1622 is received within a corresponding recess (e.g., lock recess 1004) provided in the frame 1602 to accordingly lock the bottom sash 1604 in place. In another example, the latch mechanism 1612 includes a tying element orifice 2204 sized and shaped to receive the tying element 1618 therethrough and facilitate the sliding movement of the tying element relative to the latch mechanism 1612. As shown in FIG. 16B, the tying element 1618 is coupled with the latch bolt 1622 and tensioning of the tying element, for instance, by rotation of the operator interface features 1620 and corresponding rotation of the first spool 1704 (and optionally the second spool 1804), withdraws the latch bolt 1622 into the latch bolt housing 2200 to thereby facilitate one or more of the sliding movement of the sash 1604 (and 1606) or tilting of the sash 1604 as described herein. In another example, the latch bolt 1622 includes a paddle recess 2202. As will be described herein, the paddle recess 2202 allows for the transmission of translational movement of the latch bolt 1622 to another latch bolt, for instance, a top latch bolt associated with the latch mechanism provided with the top sash 1606.

Figure 23:
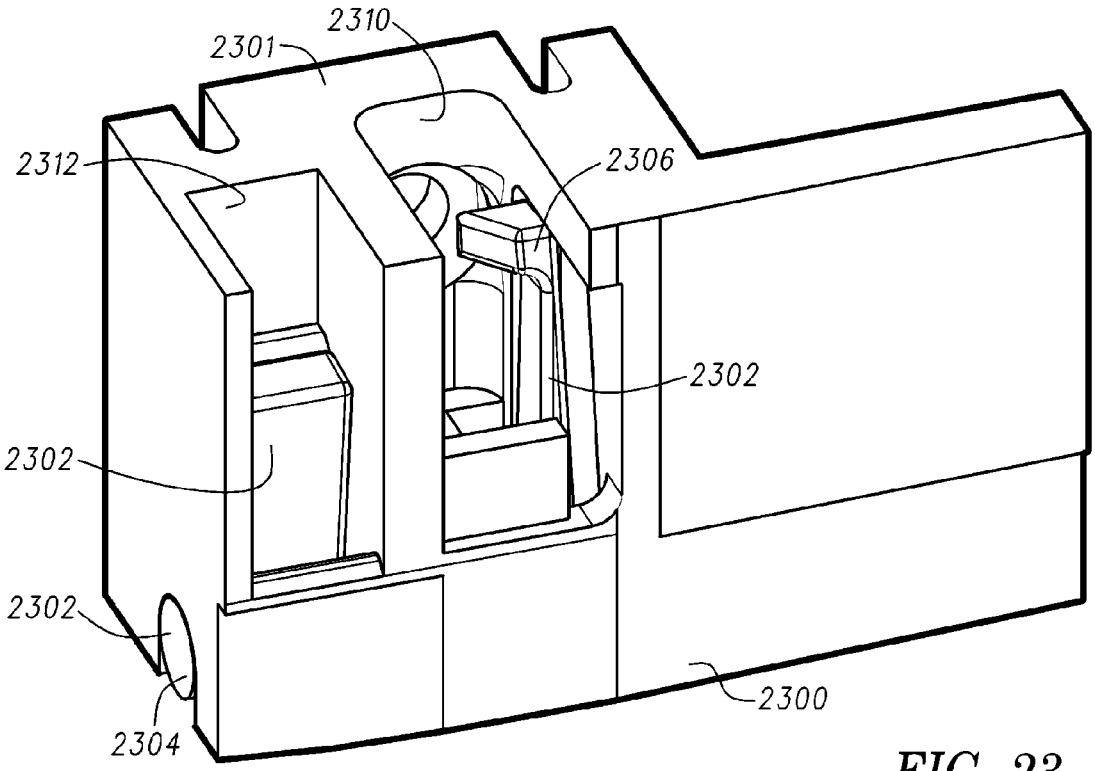
FIG. 23 is a perspective view of one example of a paddle configured to transmit rotation of one latch bolt to another latch bolt.
Figure 24:
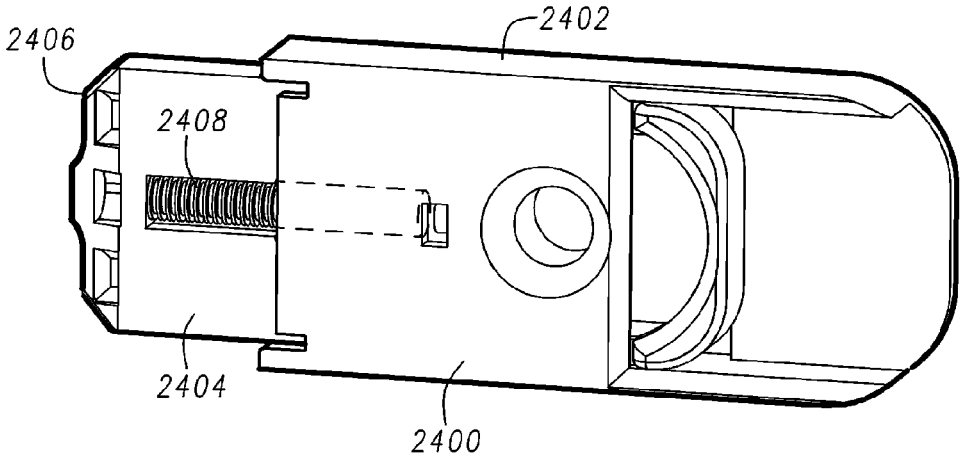
FIG. 24 is a perspective view of another example of a top latch mechanism.

FIG. 23 shows one example of a transmission assembly 2301 configured to transmit movement, for instance, translational movement of the latch bolt 1622 previously shown if FIG. 22 to a top latch bolt (further described and shown in FIG. 24). In the example shown, the transmission assembly 2301 includes a jamb receiver block 2300 sized and shaped for installation within the frame 1602. The jamb receiver block 2300 includes a paddle 2302 therein. As shown, the paddle 2302 includes a paddle pivot 2304 rotatably coupled with the jamb receiver block 2300 to facilitate rotation of the paddle 2302. The paddle 2302 includes a bottom latch bolt arm 2306 (e.g., a latch cam) coupled with the paddle pivot 2304. In a similar manner, the paddle 2302 includes a top latch bolt arm 2308 (e.g., a latch follower) similarly coupled with the paddle pivot 2304.

The arrangement shown in FIG. 23 allows for the transmission of movement from the bottom latch bolt 1622 shown in FIG. 22 (and operated, for instance, by the fenestration operation hardware assembly 1608) to a top latch bolt through rotation of the paddle 2302. Each of the top latch bolt arm and the bottom latch bolt arm 2308, 2306 are positioned in a respective top latch bolt recess 2312 and a bottom latch bolt recess 2310. As will be described further herein, rotation of the bottom latch bolt arm is transmitted to the top latch bolt arm 2308, for instance, by the paddle pivot 2304.

Referring now to FIG. 24, one example of a top latch mechanism 2400 configured for installation with the top sash 1606 is provided. As shown, the top latch mechanism 2400 includes a top latch bolt housing 2402 and a top latch bolt 2404 slidably received within the housing 2402. In one example, a latch biasing element 2408 is engaged between the top latch bolt housing 2402 and the top latch bolt 2404. In a similar manner to the latch biasing element 2206 of the latch mechanism 1612, the latch biasing element 2408 biases the top latch bolt 2440 to a projected position thereby biasing the top latch bolt 2404 into a locking engagement with the frame 1602 having a recess (e.g., lock recess) corresponding in size and shape to the top latch bolt 2404. As is further shown in FIG. 24, the top latch bolt 2404 includes a paddle engagement face 2406. The paddle engagement face 2406 described herein cooperates with the top latch bolt arm 2308 shown in FIG. 23 to allow for the transmission of a rotational movement from the paddle 2302 to the top latch bolt 2404.

In operation, as the bottom latch bolt 1622 is drawn into the latch bolt housing 2200 (for instance, by operation of fenestration operation hardware assembly 1608) the bottom latch bolt arm 2306 of the paddle 2302 (shown in FIG. 23) is similarly withdrawn with the bottom latch bolt 1622. Movement of the bottom latch bolt 1622 moves the latch bolt out of the bottom latch bolt recess 2310 and accordingly allows for slidable movement of the bottom sash 1604 relative to the frame 1602. Additionally, with withdrawal of the bottom latch bolt 1622 and movement of the bottom latch bolt arm 2306 the rotational movement of the paddle 2302 is transmitted along the paddle pivot 2304, for instance, to the top latch bolt arm 2308. The top latch bolt arm 2308 as previously described is engaged with the paddle engagement face 2406, and the rotational movement of the top latch bolt arm 2308 is thereby transmitted to the paddle engagement face 2406 and accordingly biases the top latch bolt 2404 into the top latch bolt housing 2402 (to unlock the top sash 1606 and allow sliding movement). That is to say, with withdrawal of the bottom latch bolt 1622 the top latch bolt 2404 similarly withdraws into its respective top latch bolt housing 2402 by way of operation of the paddle 2302. As long as engagement is retained between the bottom latch bolt 1622, the paddle 2302 and the top latch bolt 2404 transmission of movement between the latch bolts is maintained.

When either or both of the bottom latch bolt 1622 or the top latch bolt 2404 are disengaged from the paddle 2302 the other of latch bolt is no longer biased by the operation of the paddle 2302. For instance, in the operational position if the bottom sash 1604 is first moved upwardly relative to the paddle 2302 the bottom latch bolt 1622 disengages with the paddle 2302. For instance, the bottom latch bolt arm 2306 disengages from within the paddle recess 2202 and the natural bias in the latch biasing element 2408 of the top latch bolt 2404 biases the bolt 2404 into an outward projected position (e.g., the top latch bolt 2404 is automatically relocked). Accordingly, if opening of both the bottom and top sashes 1604, 1606 is desired the top sash 1606 is moved first while the top latch bolt 2404 is the withdrawn position. Movement of the top sash 1606, for instance, lowering of the top sash disengages the top latch bolt 2404 from the paddle 2302. This disengagement does not result in an automatic locking of the top latch bolt 2404 instead the depression of the top sash 1606 allows the previously withdrawn top latch bolt 2404 to ride within a guide channel (groove) of the frame 1602 and accordingly continue its downward movement. Upon movement of the top sash 1606 to a position where the top latch bolt 2404 may project into the top latch bolt recess 2312 (e.g., lock recess) the top latch bolt 2404 will lock (according to the relative position of the paddle 2302 as dictated by the latch bolt 1622).

Accordingly, the fenestration operation hardware assembly 1608 through cooperation of the top and bottom latch bolts 2404, 1622 is able to control the opening, closing and locking of each of the bottom and top sashes 1604, 1606 through rotation of the operator interface feature 1620 previously shown in FIGS. 16A, B. Each of opening, closing and locking of the bottom and top sashes 1604, 1606 is consolidated into a single hardware assembly that provides distributed control of the corresponding latch mechanisms 1612, 2400 associated with each of the sashes.

Figure 25:
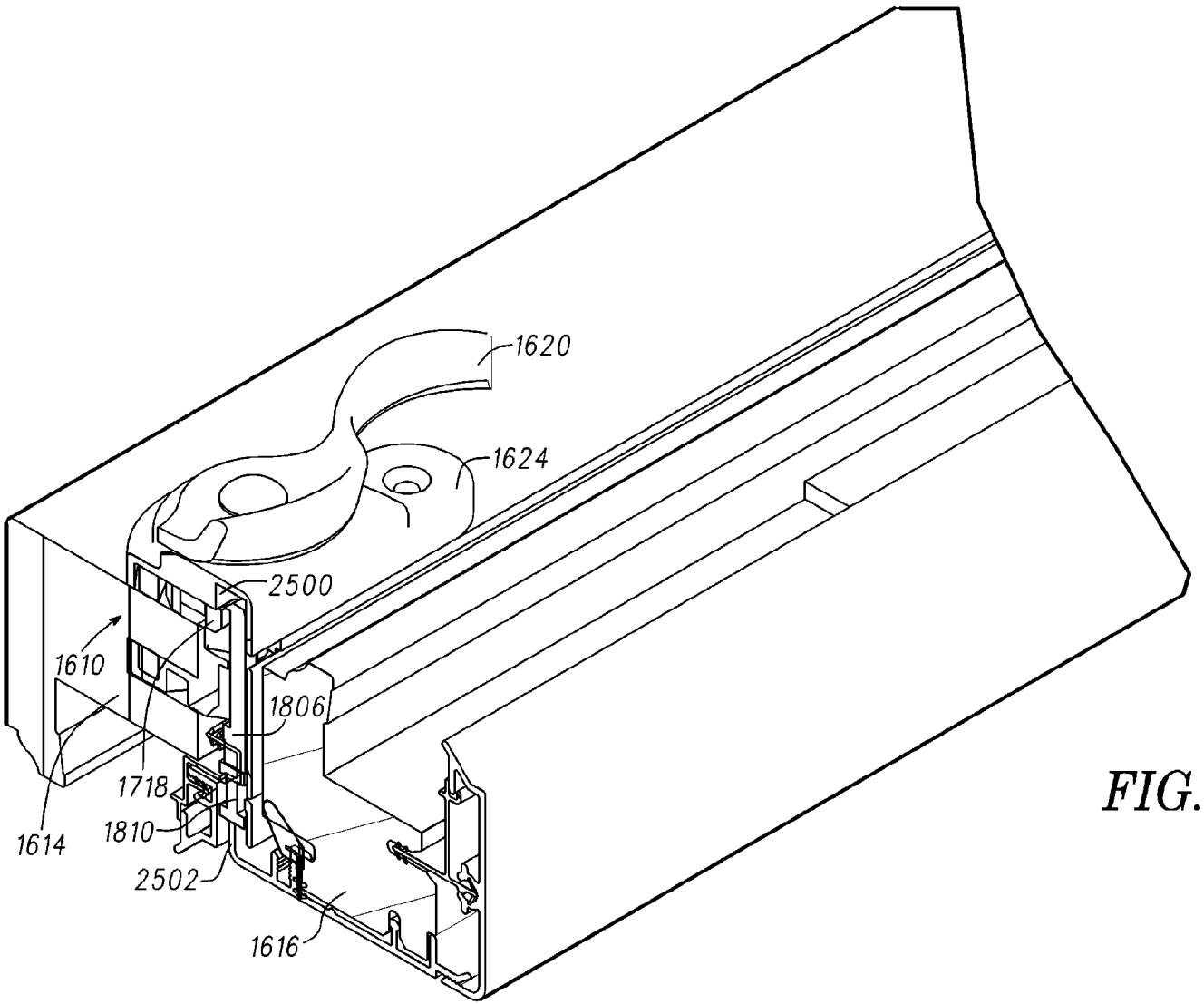
FIG. 25 is a cross sectional view of the fenestration assembly including the operator shown in FIG. 17A in an initial configuration with the top and bottom panels closed.

FIG. 25 shows a cross-sectional view of the fenestration assembly 1600 previously shown in FIG. 16A. The bottom check rail 1614 and the top check rail 1616 are shown in a closed orientation similar to that shown in FIG. 16A. As shown, the operator 1610 is sectioned to provide views of the plunger 1806 as well as the detent release element 1718 as they are positioned in the initial configuration. For instance, a portion of the plunger 1806 including, for instance, the plunger axial and lateral faces 2102, 2104 is positioned within a plunger recess 2500 provided in the operator housing 1624. As shown in FIG. 25, the plunger 1806 is biased into the position shown in the figure by a top sash interlock 2502 positioned within a corresponding portion of the bottom check rail 1614. For instance, the top check rail 1616 includes a fitting such as a plastic or aluminum fitting that extends at least partially into a portion of the bottom check rail 1614 and is thereby engaged with the plunger cap 1810 to accordingly bias the plunger 1806 (upwardly) into the orientation shown in FIG. 25.

As further shown in FIG. 25, the operator interface features 1620 (e.g., a handle) is in an initial configuration. In one example, the initial configuration corresponds to a position with each of the latch bolts 1622 (FIG. 16B) are in a projecting orientation. While the bottom sash 1604 is positioned in a closed position like that shown in FIG. 16A (and shown in the cross sectional view of FIG. 25) the latch bolts 1622 are correspondingly projected and received in the recesses (lock recesses, for instance formed within the jamb receiver block 2300) within the frame 1602 to accordingly hold the bottom sash 1604 in the closed position.

Figure 26:
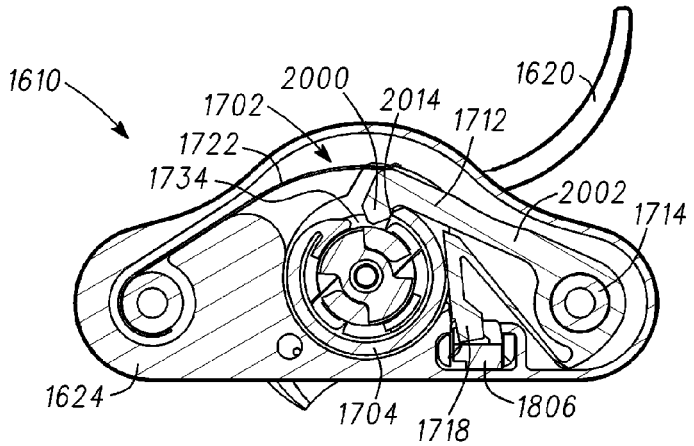
FIG. 26 is a bottom view of the operator in a first operating configuration.

Referring now to FIG. 26, the operator 1610 is shown in a bottom view with the operator interface feature 1620 rotated to an operational position (e.g., a first operational position). For instance, the operator interface feature 1620 is rotated approximately 135 degrees relative to the orientation shown in FIG. 25. Rotation of the operator interface feature 1620 rotates the first spool 1704 as shown. Rotation of the first spool 1704 wraps the tying element 1618 (FIG. 16B) around the first spool 1704 and accordingly withdraws the latch bolts 1622 of each of the latch mechanisms 1612 at least partially into the check rail 1614. In the orientation shown in FIG. 26 with the latch bolts 1622 correspondingly withdrawn into a first operating position (corresponding to the first phantom lined version of the latch bolt 1622 shown to the left in FIG. 22) the bottom sash 1604 is configured for sliding movement within the frame 1602. Similarly through operation of the paddle 2302 installed within the frame 1602 the top latch bolt 2404 is similarly withdrawn to allow for sliding movement of the top sash 1606 within the frame 1602.

Referring again to FIG. 26 as shown the detent 1712 including, for instance, the detent head 2000 having the detent engagement surfaces 2014 is positioned within the detent recess 1734 previously shown in FIG. 17C1. In this configuration, the operator interface feature 1620 is substantially locked in place through engagement of the detent 1712 within the detent recess 1734 of the first spool 1704. Accordingly, the latch bolts 1622 in the first operating position previously described are correspondingly locked in place as well. The bottom sash 1604 as well as the top sash 1606 are thereby able to move while in this open configuration.

Referring again to FIG. 23, with movement of the bottom sash 1604 (e.g., raising) the bottom latch bolt 1622 will disengage from the bottom latch bolt arm 2306 and automatically allow the top latch bolts 2404 to return to their closed position corresponding to the projecting position shown in FIG. 24. In contrast, with movement of the top sash 1606 prior to movement of the bottom sash 1604 the top latch bolts 2404 slide into corresponding grooves of the frame and even when disengaged from the paddle 2302 the top sash 1606 may continue to slide. The bottom sash 1604 remains movable as long as the retention assembly 1702 including the detent 1712 is seated within the detent recess 1734.

Referring again to FIG. 26, as previously described the detent 1712 is received within the detent recess 1734 of the first spool 1704. In one example, the detent biasing element 1722 provides a bias to the detent 1712 and ensures that the detent 1712 remains seated within the detent recess 1734. Accordingly, the first spool 1704 and the operator interface feature 1620 are locked at the position shown in FIG. 26 and the latch bolts 1622 are correspondingly locked in the first operational position previously described. Stated another way, with rotation of the first spool 1704 for instance provided by the operator interface feature 1620 the detent recess 1734 is gradually moved relative to the operator housing 1724 until the detent recess 1734 is aligned with the detent head 2000 of the detent 1712. Thereafter the detent head 2000 is received within the detent recess 1734 to correspondingly lock the first spool 1704 in place.

Referring again to FIG. 25, as the bottom or top sash is moved relative to the other of the top and bottom sash 1606, 1604 the engagement between the top sash interlock 2502 and the plunger cap 1810 is gradually discontinued. For instance, as the bottom sash 1604 is raised relative to the top sash or the top sash is lowered relative to the bottom sash the top sash interlock 2502 gradually lowers relative to the plunger cap 1810 and accordingly the engagement between the plunger 1806 and the top sash interlock 2502 ends. Accordingly as shown in FIG. 25, the plunger 1806 is gradually biased downward, for instance, by the plunger biasing element 1808 previously shown in FIG. 18A. As the plunger 1806 depresses relative to the orientation shown in FIG. 25 the plunger including the plunger axial face 2102 and the plunger lateral face 2104 move out of the plunger recess 2500 and are repositioned below the detent release element 1718.

Figure 27A:
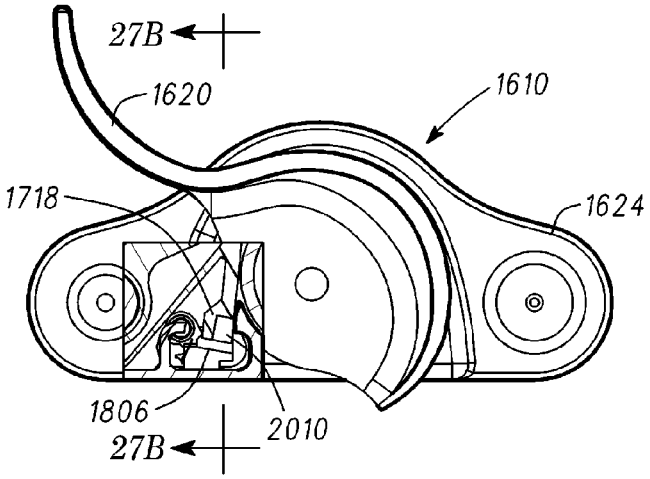
FIG. 27A is a top view of the operator with the plunger in an extended position.
Figure 27B:
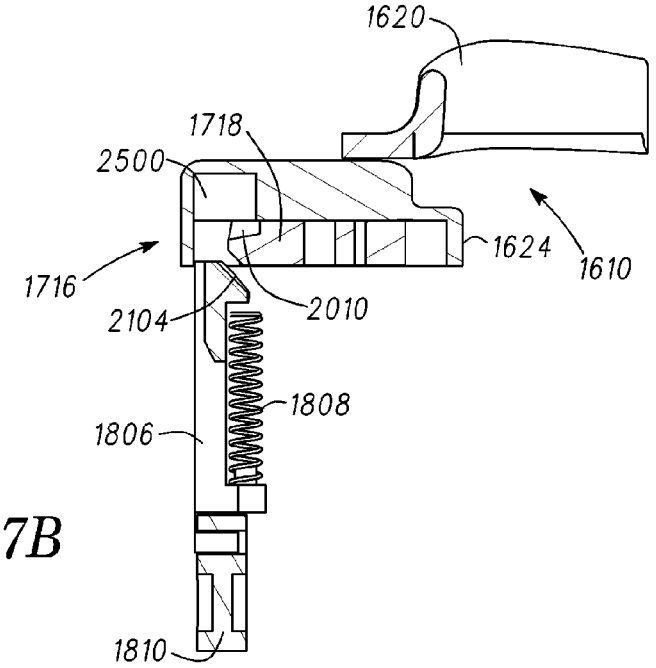
FIG. 27B is a cross sectional of the operator with the plunger in an extended position.

Referring now to FIGS. 27A and 27B, the operator 1610 is shown in an orientation with the plunger 1806 is depressed relative to the position shown in FIG. 25. Referring first to FIG. 27A, the detent release element 1718 is shown relatively positioned above the plunger 1806. Referring to FIG. 27B a cross-sectional side view of the view shown in FIG. 27A is provided. For instance, the operator interface feature 1620 is again shown at approximately the 135 degree position corresponding to a first operational position of the latch bolt 1622.

As previously described, one of the functions of the release assembly 1716, for instance, incorporating the detent release element 1718 as well as the plunger 1806 is to bias the detent 1712 out of the detent recess 1734 and accordingly allow for rotation of the first spool 1704 and the operator interface feature 1620 to the initial position shown, for instance, in FIG. 25. Rotation of the operator interface features 1620 and the first spool 1704 to this position allows for the latch bolts 1622 to automatically reset to the projecting orientations shown in FIGS. 22 and 24.

In contrast to the automatic resetting feature, where opening of the bottom or top sash 1604, 1606 is desired the movement of the plunger 1806 (as it depresses and disengages from the top sash interlock 2502) should not unseat the detent 1712 from the detent recess 1734. Instead, as the plunger 1806 moves past the detent release element 1718 the engagement of the detent 1712 within the detent recess 1734 and the corresponding immobilization of the first spool 1704 is maintained. Accordingly as shown in FIG. 27B, the release lateral face 2010 of the detent release element 1718 and the plunger lateral face 2104 of the plunger 1806 engage in sliding movement that rotates the detent release element 1718 without translating the detent element and accordingly moving the detent 1712. For instance, as shown in FIG. 20 the release lateral face 2010 has a side beveled configuration that correspondingly engages with the plunger lateral face 2104 as the plunger 1806 moves downwardly relative to the release lateral face 2010. This engagement biases the detent release element 1718 in a rotational fashion according to the arrow shown in FIG. 20 (for instance, toward the connecting arm 1720). The rotation of the detent release element 1718 occurs substantially without translation of the detent release element 1718 toward the detent arm 2002 of the detent 1712. Accordingly, the detent head 2000 of the detent 1712 remains seated within the detent recess 1734.

As will be described in further detail herein upon closing of the bottom and top sashes 1604, 1606 the opposed faces of the plunger 1806 and the detent release element 1718 (e.g., the release axial face 2008 and the plunger axial face 2102) engage in sliding movement configured to bias the detent release element 1718 in a translational fashion (for instance, in the direction of the arrow shown in FIG. 20) and into engagement with the detent arm 2002. Accordingly the detent head 2000 is biased out of the detent recess 1734 thereby allowing the first spool under bias provided by the handle biasing element 1708 to reset to the closed configuration shown for instance in FIG. 25 thereby allowing the latch bolts 1622 to return their reset locking position.

Figure 28:
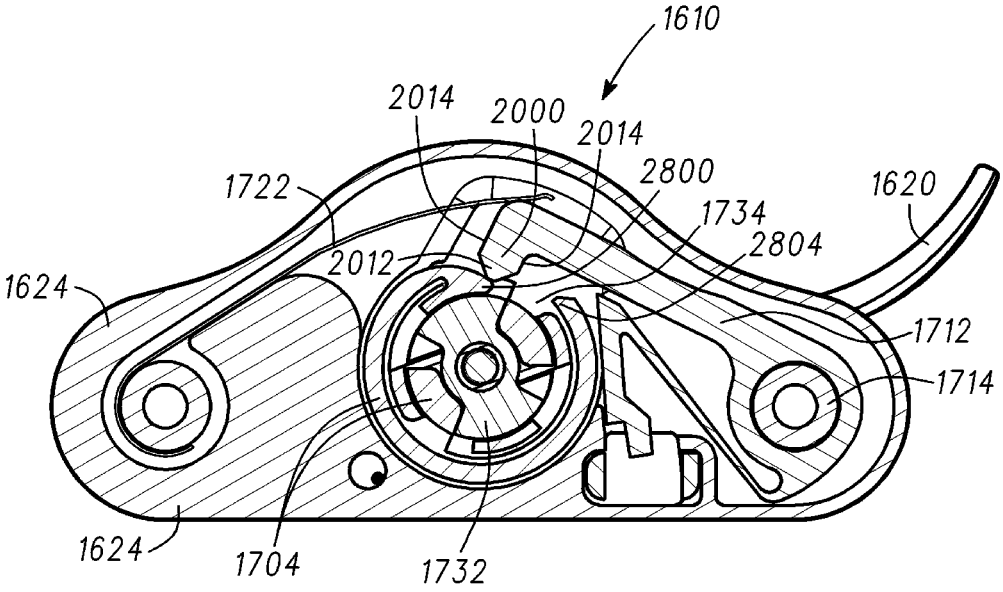
FIG. 28 is a bottom view of the operator of FIG. 17A transitioning to a second operation configuration.

FIG. 28 shows a cross-sectional bottom view of the operator 1610 in a tilting configuration. For instance, the operator interface feature 1620 is further rotated from the position shown in FIGS. 26 and 27A, B into a second operational position with the operator interface features rotated approximately 180 degrees relative to the position originally shown in FIG. 25. As shown in FIG. 26, prior to rotation to the second operation position the detent 1712 including the detent head 2000 having the detent engagement surfaces 2014 is seated within the detent recess 1734. Accordingly, the first spool 1704 is held in place and the latch bolts 1622 are in a first withdrawn position configured to allow for sliding movement of the bottom sash 1604 within the frame 1602. As shown in FIG. 28, the operator interface feature 1620 is further rotated and the detent 1712 is biased out of the detent recess 1734. In one example, the first spool 1704 includes one or more spool engagement faces 2800 sized and shaped to engage the detent beveled faces 2012 to accordingly bias the detent 1712 out of the detent recess 1734 to facilitate further movement of the operator interface feature 1620 and corresponding additional withdrawal of the latch bolts 1622 (e.g., to allow for tilting of the bottom sash 1604 relative to the frame 1602).

As shown for instance in FIG. 26, with the detent 1712 (e.g., the detent head 2000) positioned within the detent recess 1734 the detent engagement surfaces 2014 are engaged in surface to surface contact with the corresponding surface of one or more of the first spool 1704. When biasing of the detent 1712 out of the detent recess 1734 is desired (e.g., to providing the tilting configuration) to further withdraw the bottom latch bolts 1622 the spool engagement face 2800 having a beveled configuration is rotated into engagement with the detent beveled face 2012 as shown in FIG. 28. This engagement gradually biases the detent 1712 out of the detent recess 1734. After the detent 1712 is biased out of the detent recess 1734 by the engagement between the spool engagement face 2800 and the detent beveled face 2012 the spindle 1732 as well as the first spool 1704 are free to further rotate and accordingly draw the tying element 1608 and the latch bolts 1622 further into the bottom check rail 1614. Accordingly, the latch bolts 1622 are moved out of reception with the frame 1602 to allow tilting of the bottom sash 1604.

As described above, with the operator interface feature 1620 in the position shown in FIG. 28 the bottom sash 1604 is tilted relative to the frame 1602. If during tilting or after replacement of the sash 1604 within the frame 1602 the operator interface feature 1620 is released the operator interface feature is biased in the opposed direction (e.g., the counterclockwise direction in the view shown in FIG. 28) by the handle biasing element 1708 previously shown in FIG. 17B. Accordingly, the detent 1712 reseats itself within the detent recess 1734 and the detent engagement surface 2014 engages the spool engagement face 2804 thereby preventing further rotation of the operator interface feature 1620 and the first spool 1704. Accordingly, the latch bolts 1622 are arrested from moving to the fully projected position by this engagement and are accordingly reset to the first operational position corresponding to a sliding engagement within the frame 1602.

Figure 29A:
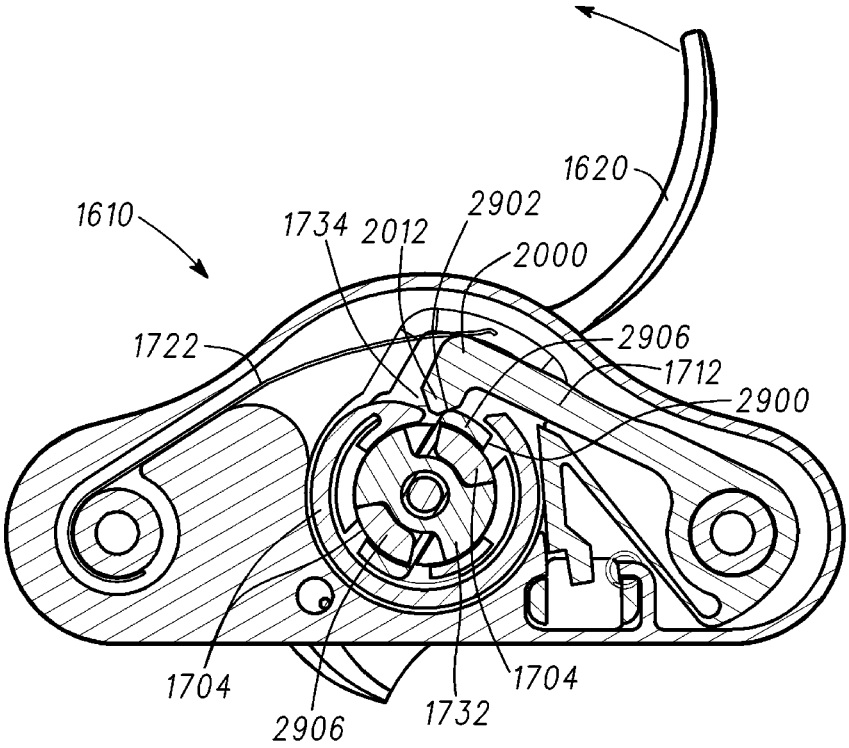
FIGS. 29A-C are bottom views of the operator of FIG. 17A being reset.
Figure 29B:
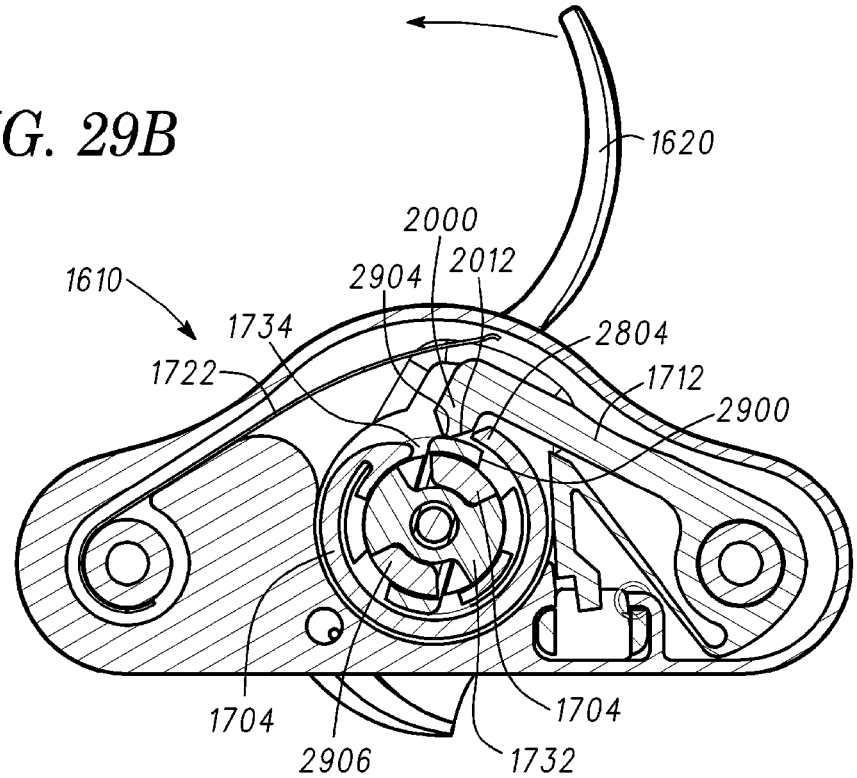
Figure 29C:
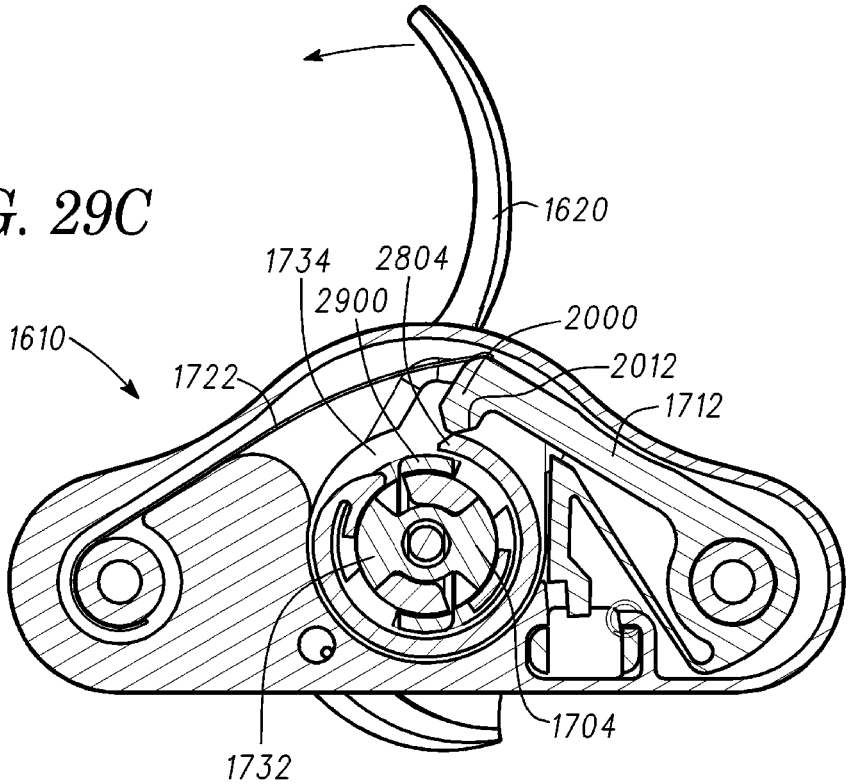

Referring now to the series of cross-sectional views shown in FIGS. 29A-C the operator 1610 is shown as it is manually reset, for instance by rotation of the operator interface feature 1620 from the first operational position previously described herein toward the initial position shown in FIG. 25. As previously described, the detent 1712 at the initiation of this procedure is seated within the detent recess 1734. As first shown in FIG. 29A the operator interface feature 1620 is rotated in a counterclockwise fashion (clockwise when viewed from above). As the operator interface feature 1620 is rotated the first spool 1704 as well as the spindle 1732 are rotated counterclockwise. In one example, rotation of the operator interface features 1620 rotates one or more prongs 2900, for instance projections coupled with the operator interface feature 1620 including the spindle 1732. In one example, the spindle 1732 is fixedly coupled to the prongs 2900. As will be described herein, in one example the prongs 2900 are incorporated into a stopping bar (movable to some degree relative to the spindle 1732) and configured to provide stopping engagement to the operator interface features 1620 for instance as it is moved into the first operational position. Further, in another example, the spindle 1732 has an hourglass configuration and the hourglass configuration provides for at least some rotational movement of the spindle 1732 (and the prongs 2900 of the stopping bar) relative to the first spool 1704. Accordingly with rotation of the operator interface feature 1620 the prongs 2900 are able to rotate relative to the first spool 1704. As shown for instance in FIG. 29A a prong engagement face 2902 (e.g., a detent biasing face) of the prongs 2900 is engaged with the detent beveled face 2012 of the detent 1712. This engagement by the prongs 2900 biases the detent 1712 upwardly.

Referring now to FIG. 29B, continued rotation of the operator interface feature 1620 transitions the detent 1712 onto a prong peripheral face 2904. The detent 1712 continues to slide along the prong peripheral face 2904 as shown in FIG. 29B. Rotation of the operator interface feature 1620 (and the spindle 1732) rotates the first spool 1704. Accordingly continued rotation of the operator interface feature 1620 rotates the first spool 1704 including for instance the spool engagement face 2804 previously shown in FIG. 28 into close engagement with the detent 1712. The spool engagement face 2804 is engaged with the detent beveled face 2012 (now raised and aligned with the face 2804) at one side of the detent head 2000. Accordingly, with continued rotation of the first spool 1704 for instance as shown now in FIG. 29C the detent 1712 is further biased upwardly and out of the detent recess 1734 by the spool engagement face 2804 (e.g., a second detent biasing face). In this configuration with the detent 1712 elevated out of the detent recess 1734 the operator interface feature 1620 may be released and the handle biasing element 1708 will continue to provide torque to the first spool 1704 as well as the operator interface features 1620 through their engagement to accordingly move the operator interface feature 1620 and the first spool 1704 to the initial configuration shown in FIG. 25. Accordingly the tying element 1618 unwinds from the first spool 1704 thereby allowing for movement of the latch bolts 1622 into the projected locking configuration previously shown in FIG. 16B.

Figure 30:
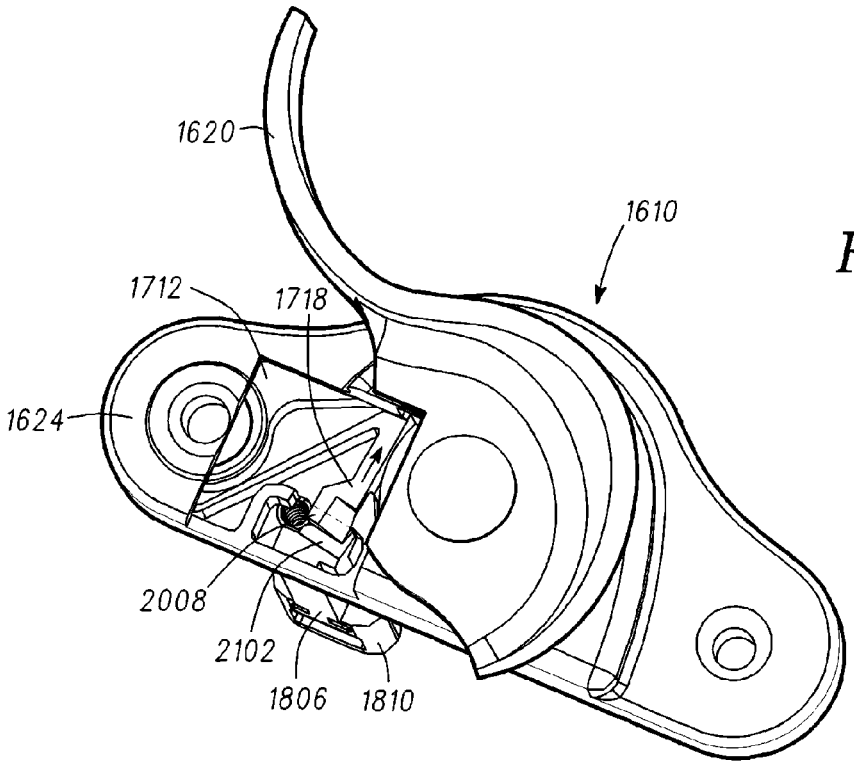
FIG. 30 is a perspective view of the operator of FIG. 17A being automatically reset to the orientation shown in FIG. 25 through closing of the top and bottom panels.
Figure 31:
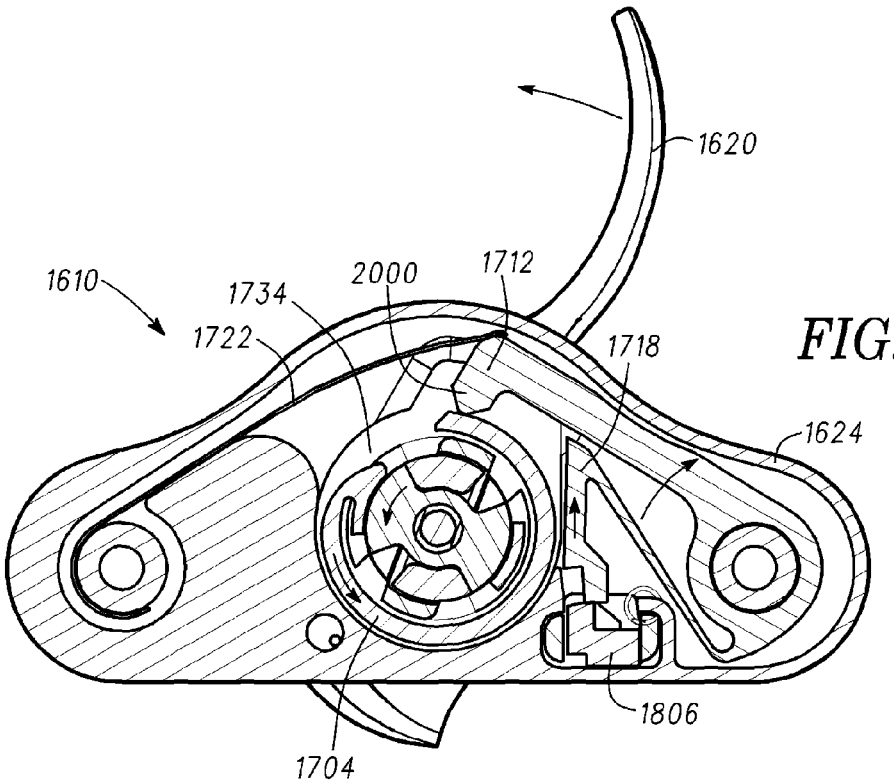
FIG. 31 is a bottom view of the operator of FIG. 30.

Referring now to FIGS. 30 and 31, opposed views of the operator 1610 are provided. For instance, in FIG. 30 a top view of the operator in a first operational position is provided and a corresponding bottom view of the operator 1610 is provided in FIG. 31. The fenestration operation hardware assembly 1608 is configured to automatically reset (accordingly relocking the latch bolts 1622) with closing of the bottom and top sashes 1604, 1606 (see FIG. 16A). For instance, as previously shown in FIG. 25 the top sash interlock 2502 is configured to engage a portion of the plunger 1806 for instance a plunger cap 1810 and accordingly bias the plunger into a plunger recess 2500 as shown in FIG. 25. With the arrangement of the plunger 1806 and the detent release element 1718 (the release assembly 1716) these features are configured to automatically unseat the detent 1712 and accordingly release the locking engagement provided by the retention assembly 1702 including for the detent 1712 and the first spool 1704 having the detent recess 1734.

Referring first to FIG. 30, the plunger 1806 is shown in an upwardly moving configuration where the plunger axial face 2102 is positioned immediately below the release axial face 2008 shown in FIG. 20 (the view shown in FIG. 20 is an inverted view of the detent 1712 and the detent release element 1718). As the plunger 1806 is biased upwardly for instance by engagement with the top sash interlock 2502 (shown in FIG. 25) the axial faces 2102 and 2008 engage against each other and thereby accordingly bias the detent release element 1718 translationally toward the detent 1712. As shown in FIG. 30, with the arrow provided along the detent release element 1718 the axially engaging faces 2008, 2102 bias the detent release element 1718 into engagement with the detent 1712 and accordingly move the detent 1712 and the detent head 2000 out of the detent recess 1734.

As shown for instance in FIG. 31, the detent 1712 is in a biased upward position that counters the bias provided by the detent biasing element 1722. The detent release element 1718 and the plunger 1806 are shown in an engaged configuration where the detent release element 1718 is translated toward the detent 1712. In this configuration the spool 1704 is able to rotate (e.g., according to the handle biasing element 1708) relative to the detent 1712 and is correspondingly able to rotate the operator interface feature 1620 to the initial position shown in FIG. 25. Accordingly, the first spool 1704 rotates in a counterclockwise fashion (clockwise in the orientation shown in FIG. 30) to thereby unwind the tying element 1618 from the first spool 1704 and release the latch bolts 1622 to deploy into corresponding recesses for instance within the frame 1602. Accordingly, with closing of both of the top and bottom sashes and corresponding engagement of a portion of the top sash (e.g., the top sash interlock 2502) with the plunger 1806 the release assembly 1716 is configured to automatically disengage the detent 1712 from the detent recess 1734 of the first spool 1704 and accordingly allow for resetting of each of the latch bolts 1622 into a locking position.

With one or both of the sashes 1604, 1606 in an open position closing of one or both of those sashes into the configuration shown in FIG. 16A automatically operates the fenestration operation hardware assembly 1608 and accordingly relocks the operation hardware assembly by operation of the release assembly 1716 to bias the detent 1712 out of engagement with the first spool 1704. After release of the first spool 1704, the plunger 1806 (for instance the plunger lateral and axially faces 2104, 2102) are positioned within the plunger recess 2500 and the operator 1610 of the fenestration operation hardware assembly 1608 is reset to the configuration shown in FIG. 25 and ready for continued operation for instance rotation of the operator interface features 1620 to the first (and optional second) operational position.

Figure 32A:
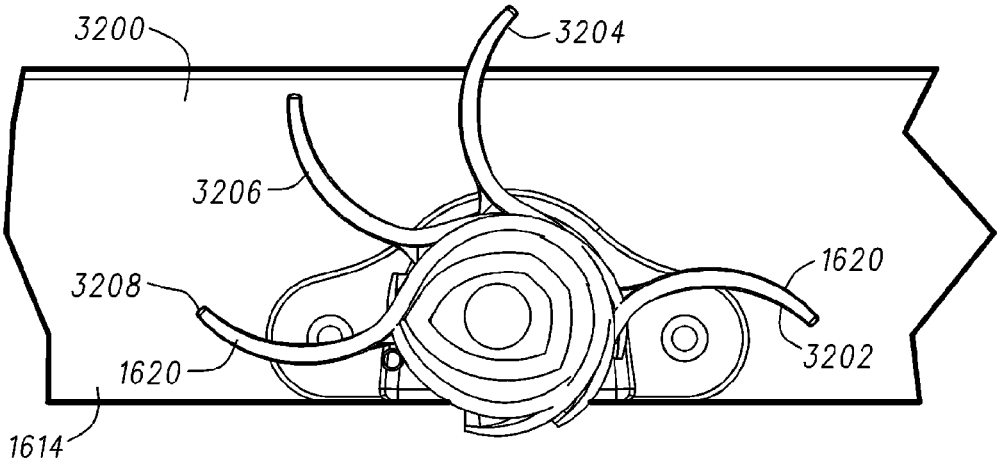
FIG. 32A is a composite top view of the operator of FIG. 17A with the operator interface feature in closed, first operating, second operating and intermediate positions.

Referring now to FIG. 32A, the operator interface feature 1620 is shown in a plurality of orientations. For instance, the operator interface feature 1620 is shown in an initial position 3202, the first operational position 3206 and a second operational position 3208 (corresponding for instance to a tilting orientation). Additionally, a transitional position 3204 is provided between the initial position 3202 and the first operational position 3206. As previously described herein, rotation of the operator interface feature 1620 from the initial position 3202 to the first operational position 3206 correspondingly withdraws the latch bolts 1622 to permit sliding movement of at least the bottom sash 1604 (and optionally the top sash 1606) relative to the frame 1602. Further rotation of the operator interface feature 1620 for instance into the second operational position 3208 further withdraws the latch bolt 1622 and in an example allows for tilting of the bottom sash 1604 relative to the frame 1602. As shown in FIG. 32A, in each of the operational positions 3206, 3208 as well as the initial position 3202 the operator interface feature 1620 is retained within the footprint 3200 of the bottom check rail 1614 for instance the operator interface feature 1620 is fully positioned within the perimeter provided by the bottom check rail 1614 and does not extend in a retained configuration (configuration where the operator interface feature 1620 is held during operation or in the initial position) at any point during the actual operation of the fenestration operation hardware assembly 1608. The only time that the operator interface feature 1620 extends beyond the bottom check rail 1614 is in the transitional position 3204 as the feature 1620 is moved from the initial position 3202 to the first operational position 3206.

The tying element 1618 withdraws the latch bolt 1622 in a substantially linear fashion. For instance, withdrawal of the tying element 1618 correspondingly withdraws the latch bolt 1622 a similar distance according to the perimeter of the first spool 1704. As shown for instance in FIG. 22 the latch bolt 1622 is withdrawn into the second operating position, for instance shown with the phantom lines shown adjacent to the bottom latch bolt housing 2200. This second withdrawn position requires additional movement of the tying element 1618 than would be an indicated by corresponding movement between the first and second operational positions 3206, 3208. Stated another way, based on a linear rate of movement of the tying element 1618 additional rotation beyond that shown at the second operational positions 3208 would be needed to draw the latch bolt 1622 into the bottom latch bolt housing 2200 and facilitate tilting of the bottom sash 1604. The assembly of the first and second spools 1704, 1804 as will be described herein facilitates dual rates of withdrawal of the tying element 1618 to realize each of the first and second operational positions shown in FIG. 22. The first and second spools 1704, 1804 further ensure that the operator interface feature 1620 is retained within the footprint 3200 of the bottom check rail 1614 when the operator interface feature 1620 is held at the initial position 3202 or either of the first and second operational positions 3206, 3208.

Figure 32B:
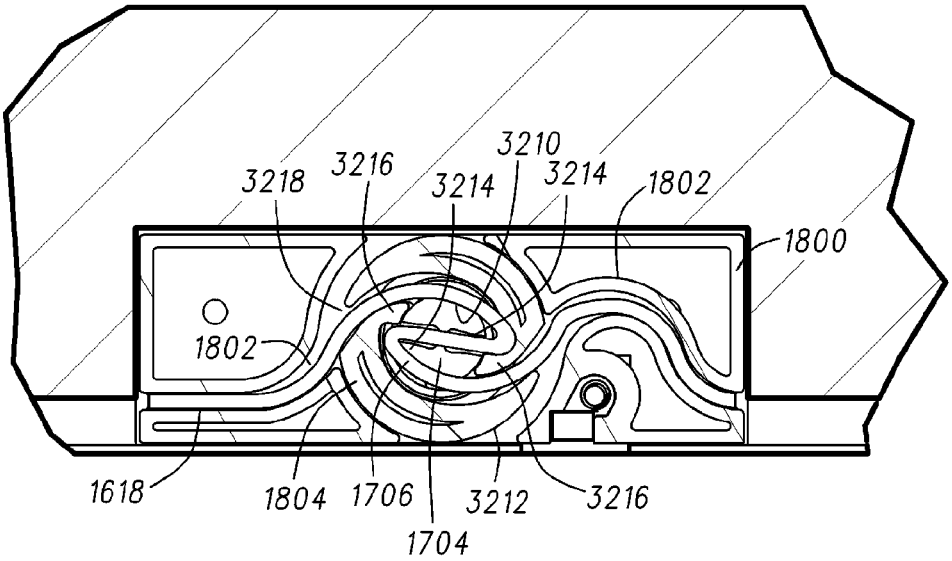
FIG. 32B is a bottom view of the first and second spools as the operator interface feature is rotated from the first operating position to the second operating position.

Referring now to FIG. 32B, the arrangement of the first spool 1704 within the second spool 1804 is shown. As previously described in one example, the first and second spools 1704, 1804 are received and held at least partially within a cord flange 1800 installed in the check rail 1614. As shown, the tying element 1618 extends through both of the first and second spools 1704, 1804, for instance through a tying element recess 1706 of the first spool 1704 and a second tying element recess 3218 of the second spool 1804. Rotation of the first spool 1704 correspondingly wraps the tying element 1618 around the first spool and withdraws the latch bolt 1602 into a first operational position. The first spool 1704 has a first perimeter 3210, and the tying element is wrapped around the first spool at a first rate of withdrawal based on the first perimeter 3210.

In contrast, the second spool 1804 has a second larger perimeter 3212. The first and second spools 1704, 1804 are sized and shaped to transition the wrapping of the tying element 1618 to the second spool 1804 at approximately the rotational position shown in FIG. 32A corresponding to the first operational position 3206. As shown in FIG. 32B, the first spool 1704 is rotated into the first operational position 3206. At this point a first jaw 3214 of the first spool 1704 is engaged against the tying element 1618 and an opposed second jaw 3216 of the second spool 1804 is engaged on the opposed side of tying element 1618. The engagement between the tying element 1618 by the first and second jaws 3214, 3216 transmits rotation from the first spool 1704 to the second spool 1804. Accordingly, the tying element is wrapped around the second perimeter 3212 with continued rotation of the operator interface 1620 from the first operational position 3206 to the second operational position 3208.

The tying element 1618 accordingly wraps around the second perimeter 3212 at a greater rate relative to wrapping around the first perimeter 3210. Accordingly, the latch bolts 1622 are withdrawn into the latch bolt housing 2200 in an accelerated fashion between the first and second operational positions 3206, 3208. With this configuration of the first and second spools 1704, 1804 the operator interface feature 1620 is able to move between the initial position 3202 to the first operational position 3206 and from there to the second operational position 3208 (for tiling) and retain the operator interface feature 1620 in each of these positions without the feature extending beyond a footprint 3200 of the bottom check rail 1614. Stated another way, in each of the operational positions 3206, 3208 and the initial position 3202 the operator interface feature 1620 is maintained within the bottom check rail 1614 (e.g., behind the front edge of the bottom check rail 1614) and accordingly minimizes any extending projections, snags or the like otherwise presented by the operator interface feature 1620.

Figure 33:
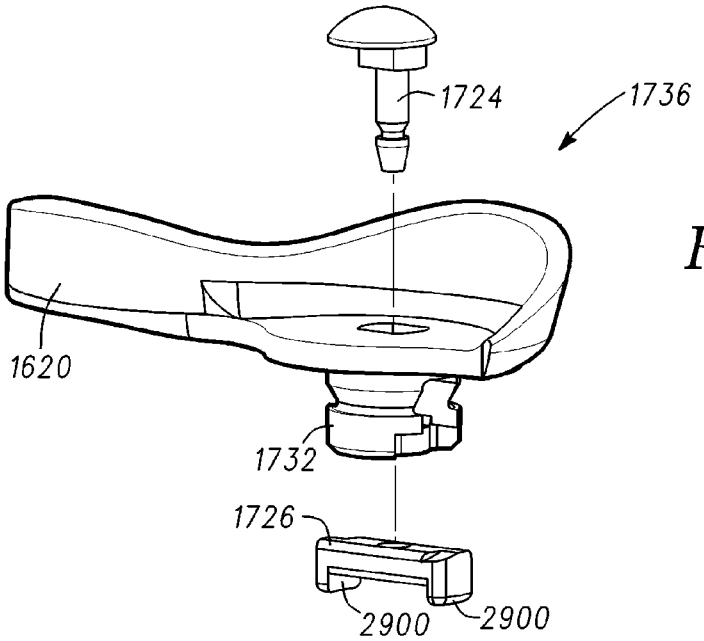
FIG. 33 is an exploded view of one example of an operator interface feature including a tilt transition feature.

FIG. 33 shows an exploded view of one of the example of an operational stop assembly 1736. As shown, the operational stop assembly includes a stop release 1724 and a stopping bar 1726. As further shown in FIG. 33, the stop release 1724 extends through a portion of the operator interface feature 1620, for instance an orifice having a corresponding shape to at least a portion of the stop release 1724 (e.g., a non-rotatable or non-circular shape to accordingly transmit rotation between the stop release 1724 and the stopping bar 1726). In one example, the stopping bar 1726 is coupled with the spindle 1732 of the operator interface feature 1620. The stopping bar 1726 provides one or more prongs 2900 (previously shown in FIGS. 29A-C).

As will be described herein, the operational stop assembly 1736 is configured to provide an affirmative stop for rotation of the operator interface feature 1620 for instance in a position along its arcuate path when rotated relative to the initial position (e.g., shown in FIGS. 25 and 32A). In one example, the operational stop assembly 1736 provides an affirmative stop that indicates the fenestration operation hardware assembly 1608 is in a configuration having the latch bolt 1622 withdrawn at least in the first operational position corresponding to the first operational position 3206 shown in FIG. 32A.

Figure 35A:
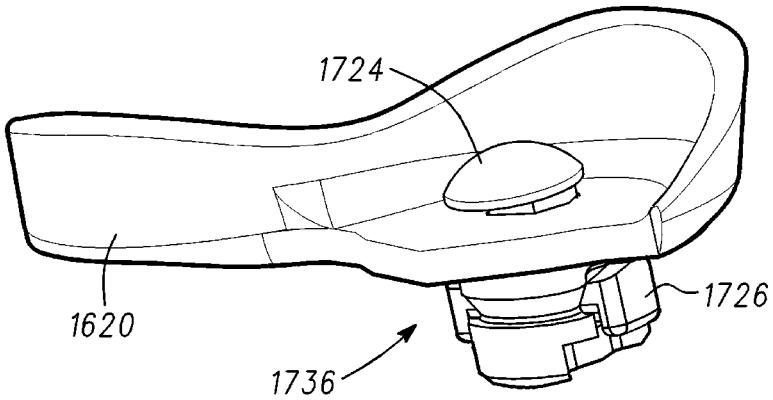
FIG. 35A is a perspective view of the operator interface feature of FIG. 33 in a second transitional position.

FIGS. 35A, B and 36A, B show the operator interface feature 1620 as well as the operational stop assembly 1736 in a series of transitional configurations with concluding with the stopping bar 1726 engaged with an operator stop 3406 to accordingly provide an affirmative engagement between the operator interface feature 1620 and the operator housing 1624 Accordingly, an affirmative indication is provided to a user that the fenestration operational hardware assembly 1608 is in the first operational position and that at least the bottom sash 1604 and optionally the top sash 1606 are unlocked and ready for sliding movement within the frame 1602.

Figure 34A:
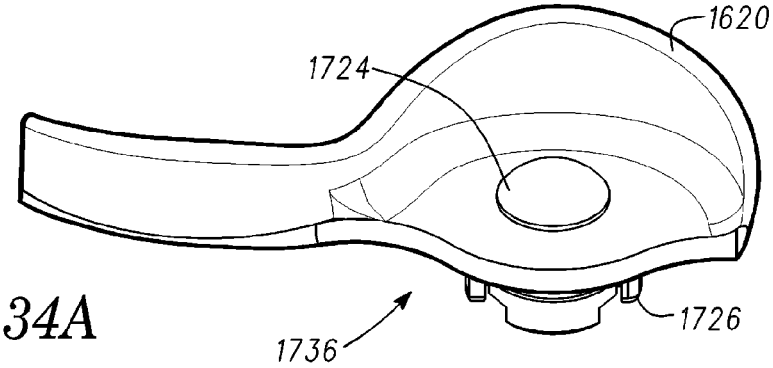
FIG. 34A is a perspective view of the operator interface feature of FIG. 33 in a first transitional position.
Figure 34B:
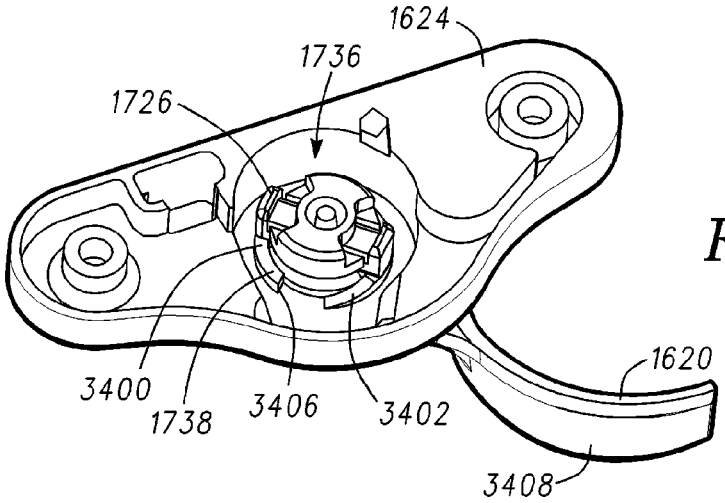
FIG. 34B is a bottom perspective view of one example of the operator including a stopping bar in the first transitional position.

Referring first to FIGS. 34A, B, the operator interface feature 1620 is shown in a first transitional position 3408. For instance the stopping bar 1726 is shown positioned along a plateau portion 3400 of the ramped plateau 1738 of the operator housing 1624. In this configuration the operator interface feature 1620 as shown in FIG. 34B is rotatable in a clockwise fashion (counterclockwise as shown in the view of FIG. 34A). The stopping bar 1726 is slidable along the plateau portion 3400 and is transitioning onto the ramp portion 3402 of the ramped plateau 1738.

Figure 35B:
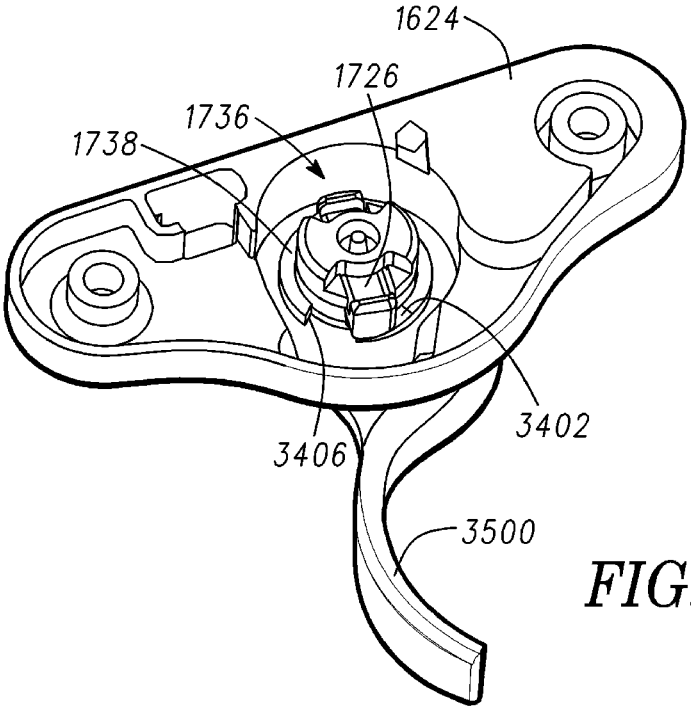
FIG. 35B is a bottom perspective view of one example of the operator including a stopping bar in the second transitional position.

Referring now to FIGS. 35A, B, the operator interface feature 1620 is shown in a second transitional position 3500. For instance, the second transitional position 3500 is between the first transitional position and the first operational positional 3206 previously shown in FIG. 32A. Referring first to FIG. 35B the stopping bar 1726 is shown positioned on the ramped portion 3402 of the ramped plateau 1738. As shown, the stopping bar 1726 is approaching an operator stop 3406 configured to arrest movement of the stopping bar 1726 and correspondingly arrest further movement (rotation) of the operator interface feature 1620.

Referring now to FIG. 35A as shown the stop release 1724 is in an upward position relative to the position shown in FIG. 34A. As previously discussed the stopping bar 1726 is positioned on the ramped portion 3402 of the plateau 1738 and also coupled with the stop release 1724. In one example, a biasing element 1736 (See FIGS. 17C1, C2) is provided between the spindle 1732 and the stopping bar 1726 to bias the stopping bar 1726 upwardly (into the page as shown in FIG. 35B) and thereby accordingly moves the stop release 1724 as it advances along the ramp portion 3402 into an elevated position as shown in FIG. 35A. The elevated position of the stop release 1724 provides an immediate indication to the user that the operator interface feature 1620 is approaching the first operational position.

Figure 36A:
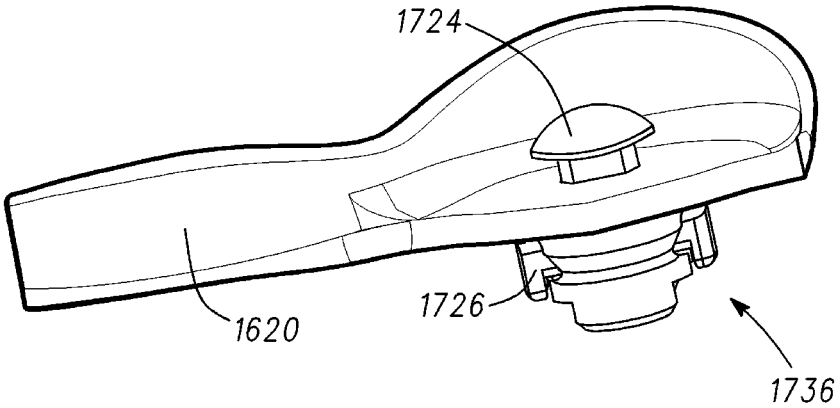
FIG. 36A is a perspective view of the operator interface feature of FIG. 33 in the first operational position.
Figure 36B:
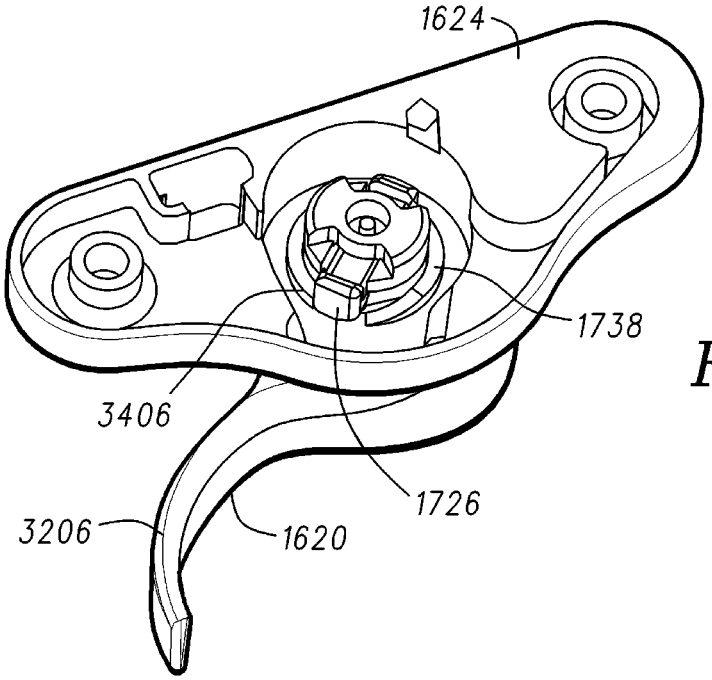
FIG. 36B is a bottom perspective view of one example of the operator including a stopping bar in the first operational position.

Referring now to FIGS. 36A, B, the operator interface feature 1620 is shown in the first operational position 3206. As previously described the first operational position 3206 corresponds to a withdrawn configuration of the latch bolts 1622 that allows for sliding movement of at least the bottom sash 1604 (and optionally the top sash) 1606 relative to the frame 1602 (see FIG. 16A). Referring first to FIG. 36B the stopping bar 1726 is shown positioned adjacent to and in engagement with an operator stop 3406 formed by the ramped plateau 1738. For instance, the ramped plateau 1738 includes a squared edge sized and shaped to engage with the stopping bar 1726. Engagement of the stopping bar 1726 with the operator stop 3406 arrests further rotation of the stopping bar 1726 and correspondingly arrests rotation of the operator interface feature 1620.

Referring now to FIG. 36A, the stop release 1724 is shown in a fully elevated position relative to the initial position shown in FIG. 34A and the partially elevated position shown in FIG. 35A. In this configuration the stopping bar 1726 is biased upwardly by the biasing element 1736 within the spindle 1732 to accordingly elevate the stop release 1724. In the arrangement shown in FIGS. 36A, B the operator interface feature 1620, without further interaction by the operator, is unable to rotate beyond the first operational position 3206 for instance to a second operational position configured to allow tilting of the bottom sash 1604 relative to the frame 1602.

If tilting of the bottom sash 1604 is desired the operator depresses the stop release 1724. Depression of the stop release 1724 biases the stopping bar 1726 in an opposed direction. Accordingly, the stopping bar 1726 moves in a downward fashion (as shown in FIG. 36B, out of the page) and is able to pass over the operator stop 3406 and accordingly continue over the plateau portion 3400 and continue rotation there along. In a similar fashion the operator interface feature 1620 is thereafter freed and able to rotate relative to the operator housing 1624 and accordingly move the first spool 1704 and the optional second spool 1804 to accordingly further wrap the tying element 1618 there around and further withdraw the latch bolts 1622 to facilitate tilting of the bottom sash 1604 relative to the frame 1602.

Various Notes & Examples

Example 1 can include subject matter such as a fenestration operation hardware assembly comprising: at least one latch mechanism, the latch mechanism is configured for coupling with a sash slidable within a frame, the latch mechanism includes a latch bolt movable between a withdrawn position and a projecting position, the withdrawn position allowing movement of the sash relative to the frame and the projecting position limiting movement of the sash within the frame; an operator remote from the latch mechanism, the operator is configured for coupling with the sash, the operator includes: an operator interface feature movable between at least initial and operating positions, in the initial position the latch bolt is in the projecting position, and in the operating position the operator interface feature moves the latch bolt into the withdrawn position, and an operator mechanism coupled with the operator interface feature, the operator mechanism includes a retention assembly configured to retain the operator interface feature in the operating position and accordingly the latch bolt in the withdrawn position; and a tying element coupled between the operator mechanism and the latch bolt, wherein operation of the operator interface feature is transmitted to the latch bolt through the tying element.

Example 2 can include, or can optionally be combined with the subject matter of Example 1, to optionally include wherein the projecting position locks the sash relative to the frame.

Example 3 can include, or can optionally be combined with the subject matter of one or any combination of Examples 1 or 2 to optionally include wherein the operator is positioned within a check rail of the sash, and the at least one latch mechanism is positioned at one or more ends of the check rail.

Example 4 can include, or can optionally be combined with the subject matter of one or any combination of Examples 1 through 3 to optionally include wherein the operator mechanism includes a first spool rotatable with the operator interface feature, and rotation of the first spool wraps the tying element around a first perimeter of the first spool and moves the latch bolt from the projecting position to the withdrawn position.

Example 5 can include, or can optionally be combined with the subject matter of one or any combination of Examples 1-4 to optionally include wherein the operator mechanism includes a second spool positioned around the first spool, and the second spool has a second perimeter for wrapping the tying element therearound, the second perimeter is greater than the first perimeter, and rotating the first and second spools wraps the tying element around the second perimeter.

Example 6 can include, or can optionally be combined with the subject matter of Examples 1-5 to optionally include wherein the tying element wraps around the first perimeter at a first rate through a first range of rotation of the operator interface feature, and the tying element wraps around the second perimeter at a second rate through a second range of rotation of the operator interface feature, the second rate is greater than the first rate, and the second range of motion is smaller than the first range of motion.

Example 7 can include, or can optionally be combined with the subject matter of Examples 1-6 to optionally include wherein the first spool includes at least one detent recess movable according to rotation of the spool, and the retention assembly includes: a detent adjacent to the first spool, positioning of the detent within the at least one detent recess retains the operator interface feature in the operating position, and a detent biasing member coupled with the detent, the detent biasing member biases the detent toward the spool and the at least one detent recess.

Example 8 can include, or can optionally be combined with the subject matter of Examples 1-7 to optionally include wherein the operator includes a release assembly configured to move the detent out of the at least one detent recess with one or more of closing of the sash or movement of the operator interface feature from the operating position toward the initial position.

Example 9 can include, or can optionally be combined with the subject matter of Examples 1-8 to optionally include wherein the release assembly includes: a detent release element coupled with the detent, and a plunger movably coupled with the detent release element, wherein movement of the plunger caused by closing of the sash moves the detent release element and moves the detent out of the at least one detent recess.

Example 10 can include, or can optionally be combined with the subject matter of Examples 1-9 to optionally include wherein the release assembly includes a detent biasing face coupled with the operator interface feature, and movement of the operator interface feature from the operating position toward the initial position engages the detent basing face with the detent and biases the detent away from the at least one detent recess.

Example 11 can include, or can optionally be combined with the subject matter of Examples 1-10 to optionally include wherein the first spool includes a second detent biasing face, and movement of the first spool by the operator interface feature from the operating position toward the initial position engages the second detent biasing face with the detent and biases the detent away from the at least one detent recess.

Example 12 can include, or can optionally be combined with the subject matter of Examples 1-11 to optionally include wherein the latch bolt is movable into a second withdrawn position allowing tilting of the sash relative to the frame, and the operator interface feature is movable to a tilting position, and in the tilting position the operator interface feature moves the latch bolt into the second withdrawn position.

Example 13 can include, or can optionally be combined with the subject matter of Examples 1-12 to optionally include wherein the retention assembly allows movement of the operator interface feature to the tilting position from the operating position, and the retention assembly resumes retaining of the operator interface feature in the operating position upon release of the operator interface feature from the tilting position.

Example 14 can include, or can optionally be combined with the subject matter of Examples 1-13 to optionally include wherein the operator interface feature includes a stopping bar, and the stopping bar is configured to engage against an operator stop at the operating position and arrest movement of the operator interface feature.

Example 15 can include, or can optionally be combined with the subject matter of Examples 1-14 to optionally include wherein a stop release is coupled with the stopping bar, and movement of the stop release unseats the stopping bar from the operator stop and permits movement of the operator interface feature.

Example 16 can include, or can optionally be combined with the subject matter of Examples 1-15 to optionally include a fenestration operation hardware assembly comprising: at least one latch mechanism, the latch mechanism is configured for coupling with a sash slidable within a frame, the latch mechanism includes a latch bolt movable between a withdrawn position and a projecting position, the withdrawn position allowing movement of the sash relative to the frame and the projecting position limiting movement within the frame; an operator remote from the latch mechanism, the operator is configured for coupling with the sash, the operator includes: a handle rotatably coupled with an operator housing, the handle is movable between at least initial and operating positions, and the handle moves the latch bolt from the projecting position to the withdrawn position when rotated from the initial position to the operating position, a retention assembly configured to selectively retain the handle in the operating position and accordingly retain the latch bolt in the withdrawn position, wherein the retention assembly retains the handle in the operating position and the latch bolt in the withdrawn position with movement of the sash, and a release assembly coupled with the retention assembly, the release assembly releases the handle to the initial position and the latch bolt to the projecting position as the sash is closed; and a tying element coupled between the handle and the latch bolt, wherein rotation of the handle is transmitted to the latch bolt through the tying element.

Example 17 can include, or can optionally be combined with the subject matter of Examples 1-16 to optionally include wherein the release assembly releases the handle to the initial position and the latch bolt to the projecting position as the sash is closed and a portion of the sash engages with a portion of a second sash.

Example 18 can include, or can optionally be combined with the subject matter of Examples 1-17 to optionally include a first spool rotatable with the handle, and rotation of the first spool wraps the tying element around a first perimeter of the first spool to move the latch bolt from the projecting position to the withdrawn position.

Example 19 can include, or can optionally be combined with the subject matter of Examples 1-18 to optionally include wherein the first spool includes at least one detent recess, and the retention assembly includes: a detent adjacent to the first spool, positioning of the detent within the at least one detent recess retains the operator interface feature in the operating position, and a detent biasing member coupled with the detent, the detent biasing member biases the detent toward the spool and the at least one detent recess.

Example 20 can include, or can optionally be combined with the subject matter of Examples 1-19 to optionally include wherein the release assembly includes: a detent release element coupled with an operator housing, the detent release element is rotatable and translatable relative to the operator housing, and a plunger movably coupled with the detent release element, wherein movement of the plunger caused by closing of the sash translates the detent release element and moves the detent out of the at least one detent recess, and movement of the plunger caused by opening of the sash rotates the detent release element and maintains the detent within the at least one recess.

Example 21 can include, or can optionally be combined with the subject matter of Examples 1-20 to optionally include wherein the detent release element includes a release axial face and a release lateral face, and the plunger includes a plunger axial face and a plunger lateral face; and wherein the plunger axial face slides over the release axial face with closing of the sash to translate the detent release element and move the detent out of the at least one detent recess, and the plunger lateral face slides over the release lateral face with opening of the sash to maintain the engagement of the detent with the handle lock retainer through pivoting movement of the detent release element.

Example 22 can include, or can optionally be combined with the subject matter of Examples 1-21 to optionally include wherein the release assembly includes a detent biasing face coupled with the handle, and movement of the handle from the operating position toward the initial position engages the detent biasing face with the detent and biases the detent away from the at least one detent recess.

Example 23 can include, or can optionally be combined with the subject matter of Examples 1-22 to optionally include wherein the first spool includes a second detent biasing face, and movement of the first spool by the handle from the operating position toward the initial position engages the second detent biasing face with the detent and biases the detent away from the at least one detent recess.

Example 24 can include, or can optionally be combined with the subject matter of Examples 1-23 to optionally include wherein the handle includes a stopping bar, and the stopping bar is configured to engage against an operator stop at the operating position and arrest movement of the handle.

Example 25 can include, or can optionally be combined with the subject matter of Examples 1-24 to optionally include wherein a stop release is coupled with the stopping bar, and movement of the stop release unseats the stopping bar from the operator stop and permits movement of the handle to a tilting position, and the latch bolt is movable into a second withdrawn position with movement of the handle to the tilting position.

Example 26 can include, or can optionally be combined with the subject matter of Examples 1-25 to optionally include wherein the handle is within a checkrail footprint of a checkrail of the sash in each of the initial, operating and tilting positions.

Example 27 can include, or can optionally be combined with the subject matter of Examples 1-26 to optionally include wherein the operator includes a handle biasing element coupled between the handle and the operator housing, the biasing element biases the handle toward the initial position.

Example 28 can include, or can optionally be combined with the subject matter of Examples 1-27 to optionally include wherein the at least one latch mechanism includes a latch biasing element coupled with the latch bolt, the latch biasing element biases the latch bolt toward the projecting position and biases the handle toward the initial position.

Example 29 can include, or can optionally be combined with the subject matter of Examples 1-28 to optionally include a method for using a fenestration operation hardware assembly comprising: actuating an operator interface feature from an initial position to an operating position, the operator interface feature remotely positioned relative to at least one latch mechanism on a sash, the at least one latch mechanism including a movable latch bolt on the sash; withdrawing the latch bolt from a projecting position to a withdrawn position according to actuation of the operator interface feature from the initial position to the operating position, in the withdrawn position the sash is movable within a frame; and retaining the operator interface feature in the operating position and accordingly the latch bolt in the withdrawn position with a retention assembly coupled with the operator interface feature.

Example 30 can include, or can optionally be combined with the subject matter of Examples 1-29 to optionally include releasing the operator interface feature and the latch both after retention in the respective operating and withdrawn positions with closing of the sash.

Example 31 can include, or can optionally be combined with the subject matter of Examples 1-30 to optionally include wherein releasing the operator interface and the latch bolt with closing of the sash includes: depressing a plunger through engagement of the plunger with a second sash, translating a detent release coupled with the plunger, and moving a detent out of at least one detent recess of a first spool coupled with the operator interface feature according to the translation of the detent release.

Example 32 can include, or can optionally be combined with the subject matter of Examples 1-31 to optionally include wherein retaining the operator interface feature in the operating position and the latch bolt in the withdrawn position includes maintaining retention with moving of the sash.

Example 33 can include, or can optionally be combined with the subject matter of Examples 1-32 to optionally include wherein retaining the operator interface feature in the operating position and the latch bolt in the withdrawn position includes maintaining retention with opening of the sash.

Example 34 can include, or can optionally be combined with the subject matter of Examples 1-33 to optionally include wherein retaining the operator interface feature in the operating position with opening of the sash includes: extending a plunger through disengagement of the plunger with a second sash, rotating a detent release coupled with the plunger, and retaining a detent within at least one detent recess of a first spool coupled with the operator interface feature.

Example 35 can include, or can optionally be combined with the subject matter of Examples 1-34 to optionally include comprising releasing the operator interface feature and the latch both after retention in the respective operating and withdrawn positions with manual resetting of the operator interface feature.

Example 36 can include, or can optionally be combined with the subject matter of Examples 1-35 to optionally include wherein manual resetting of the operator interface feature includes: rotating the operator interface feature having a detent biasing face from the operating position toward the initial position, and moving a detent away from at least one detent recess of a first spool through engagement of the detent biasing face with the detent.

Example 37 can include, or can optionally be combined with the subject matter of Examples 1-36 to optionally include wherein manual resetting of the operator interface feature includes: rotating the first spool by the operator interface feature from the operating position toward the initial position, the first spool including a second detent biasing face, and moving the detent away from the at least one detent recess through engagement of the second detent biasing face with the detent.

Example 38 can include, or can optionally be combined with the subject matter of Examples 1-37 to optionally include wherein actuating the operator interface feature from the initial position to the operating position includes engaging a stopping bar of the operator interface feature with an operator stop at the operating position, and arresting movement of the operator interface feature.

Example 39 can include, or can optionally be combined with the subject matter of Examples 1-38 to optionally include wherein actuating the operator interface feature includes wrapping a tying element around a first spool having a first perimeter, the tying element coupled between the operator interface feature and the at least one latch bolt.

Example 40 can include, or can optionally be combined with the subject matter of Examples 1-39 to optionally include actuating the operator interface feature from the operating position to a tilting position including; and withdrawing the latch bolt from the withdrawn position to a second withdrawn position according to actuation of the operator interface feature from the operating position to the tilting position, and in the second withdrawn position the sash is tiltable relative to the frame; wherein actuating the operator interface feature form the operating position to the tilting position includes wrapping the tying element around a second spool having a second perimeter greater than the first perimeter.

Example 41 can include, or can optionally be combined with the subject matter of Examples 1-40 to optionally include wherein actuating the operator interface feature includes positioning the operating interface feature within a checkrail footprint of a checkrail of the sash at each of the initial, operating and tilting positions.

Example 42 can include, or can optionally be combined with the subject matter of Examples 1-41 to optionally include wherein actuating the operator interface feature from the operating position to the tilting position includes engaging the tying element between the first spool and the second spool to engage the first and second spools.

Example 43 can include, or can optionally be combined with the subject matter of Examples 1-42 to optionally include wherein actuating the operator interface feature includes actuating a stop release to unseat a stopping bar from an operator stop, unseating of the stopping bar permitting actuation of the operator interface feature to the tilting position.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A fenestration assembly comprising:

a frame including at least one sash groove and at least one locking recess within the at least one sash groove;

at least one sash slidable within the frame, the at least one sash including first and second sashes;

a fenestration hardware assembly coupled with the first sash, the fenestration hardware assembly includes:

an operator including an operator interface feature coupled with the first sash, a first latch mechanism coupled with the first sash and remote from the operator, the first latch mechanism includes a movable first latch bolt, a tying element coupled between the first latch bolt and the operator interface feature, the tying element transmits movement of the operator interface feature to the first latch bolt;

a second latch mechanism including a second latch bolt coupled with the second sash;

a transmission assembly coupled with the frame, the transmission assembly transmits movement of the operator interface feature and the first latch bolt coupled with the first sash to the second latch bolt coupled with the second sash; and wherein the first latch bolt is movable between at least a projecting position and a first withdrawn position according to movement of the operator interface feature:

in the projecting position the first latch bolt is received within the at least one locking recess to arrest sliding movement of the at least one sash within the frame, in the first withdrawn position the first and second latch bolts are withdrawn from the at least one locking recess with the operator interface feature and are within the at least one sash groove and the first and second sashes are slidable within the frame.

2. The fenestration assembly of claim 1, wherein the first latch bolt is movable to a second withdrawn position according to movement of the operator interface feature, and in the second withdrawn position the first last latch bolt is withdrawn from the at least one sash groove and the sash is tiltable relative to the frame.

3. The fenestration assembly of claim 2, wherein the operator includes a stop and a stop release, and the operator is movable between initial, first operating and second operating positions that move at least the first latch bolt between the projecting, first withdrawn and second withdrawn positions, respectively, and wherein:

the stop constrains movement of the operator interface feature to between the initial position and the first operating position, the stop release releases movement of the operator interface feature to the second operating position.

4. The fenestration assembly of claim 3, wherein the stop includes a stopping bar, and the operator includes an operator stop engaged with the stopping bar at the first operating position.

5. The fenestration assembly of claim 2 comprising a biasing element coupled with the operator interface feature and a retention assembly selectively coupled with the operator interface feature, and wherein in the first withdrawn position the retention assembly retains the operator interface feature in a first operating position, and the retained operator interface feature retains the at least one latch bolt in the first withdrawn position, and in the second withdrawn position the biasing element biases the operator interface feature from a second operating position toward the first operating position and the at least one latch bolt moves from the second withdrawn position toward the first withdrawn position.

6. The fenestration assembly of claim 1, wherein the frame includes at least one vent recess within the at least one sash groove, the at least one vent recess is spaced from the locking recess along the at least one sash groove, and in the projecting position the first latch bolt is received within the at least one vent recess to hold the at least one sash at a vent position within the frame.

7. The fenestration assembly of claim 1 comprising a second latch mechanism coupled with the first sash and remote from the operator and positioned at an opposed end of the at least one sash relative to the first latch mechanism, the second latch mechanism includes a movable second latch bolt.

8. The fenestration assembly of claim 7, wherein the second latch bolt is movable between projecting and first withdrawn positions according to movement of the operator interface feature, and the at least one sash groove and the at least one locking recess includes first and second sash grooves and first and second locking recesses, respectively:

in the projecting position the first and second latch bolts are received within the respective first and second locking recesses to arrest sliding movement of the at least one sash within the frame, and in the first withdrawn position the first and second latch bolts are withdrawn from the respective first and second locking recesses and are within the respective first and second sash grooves and the sash is slidable within the frame.

9. The fenestration assembly of claim 1, wherein the transmission assembly includes:

a paddle rotatably coupled with the frame, the paddle including first and second latch bolt arms, the first latch bolt arm is configured for engagement with the first latch bolt of the first sash, and the second latch bolt arm is configured for engagement with the second latch bolt of the second sash.

10. A method for using a fenestration assembly comprising:

arresting sliding movement of at least a first sash within a frame with positioning of a first latch bolt of the first sash at a projecting position within at least one locking recess of the frame; and sliding the first sash within the frame according to operation of an operator interface feature of the first sash remote from the first latch bolt, a tying element coupling the operator interface feature with the first latch bolt, sliding including:

moving the operator interface feature from an initial position to a first operational position, withdrawing the first latch bolt to a first withdrawn position corresponding to the first operational position, in the first withdrawn position the first latch bolt is within a sash groove of the frame and withdrawn from the at least one locking recess;

transmitting the withdrawing movement of the first latch bolt to a second latch bolt of a second sash with a transmission assembly, and withdrawing the second latch bolt of the second sash from the at least one locking recess to the first withdrawn position based on the withdrawing movement transmitted with the transmission assembly, the second sash slidable within the frame based on the withdrawing of the second latch bolt.

11. The method of claim 10 wherein sliding the first sash within the frame includes sliding the first sash to a vent position, and comprising locking the first sash in the vent position with the first latch bolt positioned within a vent recess of the frame.

12. The method of claim 10, wherein the at least one locking recess includes first and second locking recesses within respective first and second sash grooves, and withdrawing the first latch bolt and withdrawing the second latch bolt includes withdrawing the first and second latch bolts to the first withdrawn position with the first and second latch bolts within the respective first and second sash grooves and withdrawn from the respective first and second locking recesses.

13. The method of claim 10 comprising regulating movement of the operator interface feature from the first operational position to a second operational position for tilting of at least the first sash including:

engaging an operator stop with the operator interface feature to interrupt movement of the operator interface feature to the second operational position, and releasing engagement of the operator stop with the operator interface feature with operation of a stop release.

14. The method of claim 10 comprising biasing the operator interface feature toward the initial position with a biasing element coupled with the operator interface feature.

15. The method of claim 10 comprising:

tilting the first sash within the frame according to operation of the operator interface feature, tilting including:

moving the operator interface feature from the first operational position to a second operational position, and withdrawing the first latch bolt to a second withdrawn position corresponding to the second operation position, in the second withdrawn position the first latch bolt is withdrawn from the sash groove.

16. The method of claim 15, wherein sliding the first sash within the frame includes retaining the operator interface feature in the first operational position after moving the operator interface feature to the first operational position, the retained operator interface feature retains the first latch bolt in the first withdrawn position, and tilting the first sash within the frame includes biasing the operator interface feature from the second withdrawn position toward the first withdrawn position after moving the operator interface feature to the second operational position and first latch bolt is biased from the second withdrawn position toward the first withdrawn position.

17. A fenestration assembly comprising:

a frame including at least one sash groove and at least one locking recess within the at least one sash groove;

first and second sashes, and at least one of the first and second sashes are slidable within the frame;

a fenestration hardware assembly coupled with the first sash, the fenestration hardware assembly includes:

an operator including an operator interface feature movable between initial and operating positions, a first latch mechanism coupled with the first sash and remote from the operator, the first latch mechanism includes a movable first latch bolt, a tying element coupled between the first latch bolt and the operator interface feature, a retention assembly coupled with the operator, and a release assembly coupled with the retention assembly, a portion of the release assembly aligned with the second sash;

wherein the first latch bolt is movable between at least a projecting position and a first withdrawn position according to movement of the operator interface feature:

in the projecting position the first latch bolt is received within the at least one locking recess and the operator interface feature is in the initial position, and in the first withdrawn position the first latch bolt is withdrawn from the at least one locking recess and is within the at least one sash groove and the sash is slidable within the frame, and the operator interface feature is retained in the operating position and the first latch bolt is retained in the first withdrawn position by the retention assembly; and wherein the first latch bolt and the operator interface feature are released from retention by engagement of the release assembly with the second sash.

18. The fenestration assembly of claim 17, wherein the portion of the release assembly aligned with the second sash includes a plunger.

19. The fenestration assembly of claim 17, wherein the retention assembly includes a detent configured for engagement with the operator in the operating position, and the release assembly includes a detent release coupled with the detent, wherein engagement of the portion of the release assembly with the second sash is configured to operate the detent release and disengage the detent from the operator.

20. The fenestration assembly of claim 17, wherein the first latch mechanism includes a latch biasing element configured to bias the first latch bolt toward the projecting position and bias the operator interface feature toward the initial position.

21. The fenestration assembly of claim 17 comprising:

a second latch mechanism including a second latch bolt coupled with the second sash; and a transmission assembly coupled with the frame, the transmission assembly transmits movement of the operator interface feature and the first latch bolt of the first sash to the second latch bolt of the second sash.

22. The fenestration assembly of claim 21, wherein in the first withdrawn position the first and second latch bolts are withdrawn from the at least one locking recess and are within the at least one sash groove and the first and second sashes are slidable within the frame.

* * * * *